US007047721B2

(12) United States Patent
Chia et al.

(10) Patent No.: US 7,047,721 B2
(45) Date of Patent: May 23, 2006

(54) JEWELRY ROPE CHAIN LINK ELEMENT AND METHODS OF MANUFACTURE

(76) Inventors: Meang K. Chia, 412 W. 6th St., Suite 1104, Los Angeles, CA (US) 90014; Cheo K. Chia, 412 W. 6th St., Suite 1104, Los Angeles, CA (US) 90014; Huy K. Chia, 412 W. 6th St., Suite 1104, Los Angeles, CA (US) 90014

( * ) Notice: Subject to any disclaimer, the term of this patent is extended or adjusted under 35 U.S.C. 154(b) by 418 days.

(21) Appl. No.: 10/002,297

(22) Filed: Oct. 24, 2001

(65) Prior Publication Data

US 2002/0035828 A1 Mar. 28, 2002

Related U.S. Application Data

(63) Continuation-in-part of application No. 09/337,455, filed on Jun. 21, 1999, now Pat. No. 6,560,955, which is a continuation-in-part of application No. 09/287,972, filed on Apr. 7, 1999, now Pat. No. 6,209,306.

(51) Int. Cl.
*B21L 5/02* (2006.01)

(52) U.S. Cl. ..... 59/80; 59/35.1; 59/82

(58) Field of Classification Search ..... 59/80, 59/82, 6, 35.1; D11/13
See application file for complete search history.

(56) References Cited

U.S. PATENT DOCUMENTS

| | | | |
|---|---|---|---|
| 848,299 | A | 3/1907 | Feid |
| 1,055,751 | A | 3/1913 | Hurley |
| 1,886,784 | A | 11/1932 | Boppenhausen |
| 4,348,861 | A | 9/1982 | Nakagawa |
| 4,493,183 | A | 1/1985 | Bucefari et al. |
| 4,651,517 | A | 3/1987 | Benhamou et al. |
| 4,679,391 | A | 7/1987 | Tizzi |
| 4,934,135 | A | 6/1990 | Rozenwasser |
| D313,372 | S | 1/1991 | Kulla |
| D313,771 | S | 1/1991 | Kulla |
| 4,996,835 | A | 3/1991 | Rozenwasser |

(Continued)

FOREIGN PATENT DOCUMENTS

DE 43 24 387 A1 1/1995

(Continued)

OTHER PUBLICATIONS

All Karats International, Edizioni, Primavera-Estate/*Spring-Summer,* Sixth Edition, Two-tone Diamond Cut Rope Chain; 2 pages (1998).

(Continued)

*Primary Examiner*—David Jones
(74) *Attorney, Agent, or Firm*—Ladas & Parry LLP

(57) ABSTRACT

Rope chain constructed of an assembly of link elements and a manufacturing process to make such link elements, each link element exhibiting a unique visual property, such as coloration, surface texture, reflectivity, design feature or characteristic, shape, or other visually attractive appearance. Methods of construction include surface pre-texturing, stamping, simultaneous surface texturing and stamping, and strip bending. Such unique visual property traits for the succession of link elements results in a more attractive, fanciful, more delicate and interesting fashion item. Each of the interconnected link elements along the rope chain may have the same or different visual properties, and may have multiple portions of varying color, texture, shape, or other visual properties. In another aspect of the invention, each link element may have exterior edges, or edge portions, exhibiting a flat, smooth, highly light reflective surface.

74 Claims, 30 Drawing Sheets

U.S. PATENT DOCUMENTS

| | | | | |
|---|---|---|---|---|
| D321,148 | S | | 10/1991 | Chiaramonti et al. |
| D326,065 | S | | 5/1992 | Borgogni |
| 5,125,225 | A | | 6/1992 | Strobel |
| 5,129,220 | A | | 7/1992 | Strobel |
| D329,828 | S | | 9/1992 | Bedoyan |
| D330,175 | S | | 10/1992 | Kahan |
| D330,343 | S | | 10/1992 | Bedoyan |
| 5,185,995 | A | | 2/1993 | Dal Monte |
| D334,152 | S | | 3/1993 | Rozenwasser |
| D335,834 | S | | 5/1993 | Grotto |
| D340,422 | S | | 10/1993 | Grando |
| D343,136 | S | | 1/1994 | Grando |
| D343,806 | S | | 2/1994 | Bedoyan |
| 5,285,625 | A | | 2/1994 | Ofrat et al. |
| 5,301,498 | A | | 4/1994 | Chia et al. |
| 5,303,540 | A | | 4/1994 | Rozenwasser |
| 5,309,704 | A | | 5/1994 | Grando |
| 5,339,655 | A | | 8/1994 | Grando |
| 5,353,584 | A | | 10/1994 | Strobel et al. |
| 5,361,575 | A | | 11/1994 | Rozenwasser |
| D353,556 | S | | 12/1994 | Chia et al. |
| 5,408,820 | A | | 4/1995 | Strobel et al. |
| 5,412,935 | A | | 5/1995 | Rozenwasser |
| D359,010 | S | | 6/1995 | Rozenwasser |
| 5,425,228 | A | | 6/1995 | Hillel |
| 5,437,149 | A | | 8/1995 | Strobel |
| D362,203 | S | | 9/1995 | Grando |
| 5,452,572 | A | | 9/1995 | Alvaro et al. |
| 5,471,830 | A | | 12/1995 | Gonzales |
| 5,487,264 | A | | 1/1996 | Strobel |
| D368,048 | S | | 3/1996 | Rozenwasser |
| D370,184 | S | | 5/1996 | Rozenwasser |
| D370,426 | S | | 6/1996 | Rozenwasser |
| 5,526,639 | A | | 6/1996 | Gonzales |
| 5,531,065 | A | | 7/1996 | Rozenwasser |
| 5,537,812 | A | | 7/1996 | Rozenwasser |
| 5,542,244 | A | * | 8/1996 | Chia et al. ..... 59/35.1 |
| 5,544,477 | A | | 8/1996 | Rozenswasser |
| D376,119 | S | | 12/1996 | Rozenwasser |
| 5,581,993 | A | | 12/1996 | Strobel |
| 5,626,012 | A | | 5/1997 | Fabbro |
| 5,653,100 | A | | 8/1997 | Dal Monte |
| 5,660,036 | A | | 8/1997 | Rozenwasser |
| 5,682,736 | A | | 11/1997 | Chia et al. |
| 5,775,088 | A | | 7/1998 | Grosz |
| 5,797,258 | A | | 8/1998 | Strobel et al. |
| D398,551 | S | | 9/1998 | Kupelian |
| 5,911,677 | A | | 6/1999 | Kupelian |
| D424,964 | S | | 5/2000 | Chia et al. |
| 6,209,306 | B1 | | 4/2001 | Chia et al. |

FOREIGN PATENT DOCUMENTS

| | | |
|---|---|---|
| EP | 0 470 937 A1 | 7/1991 |
| FR | 2 446 612 | 9/1980 |
| GB | 2 279 227 A | 1/1995 |
| IL | 15948 | 1/1990 |

OTHER PUBLICATIONS

Armbrust Chain Company; Providence, Rhode Island; pp. 15, 145, 151, 188 (1975).

Aurora s.r.l.; Vicenza; gold bracelet, necklace, earrings; p. 25 (1997).

Bisarello Pietro s.r.l.; Cavazzale (Vicenza) Italy; untitled page and p. 29 (1971).

Chrysos S.r.l.; (Treviso), Italy; cover page.

Crafford Precision Products Co. Brochure., Crafford Precision Products Co., Riverside, Rhode Island; "The Link-O-Matic" Model 534: 4 pages (1997).

Empress Rope Chain, A.K.S. International; New York; 2 pages.

Fancy Jewelry Imports; Los Angeles, CA; p. 45.

Filk SPA-Catene; via S. Giuseppe; (Vicenza) Italy, *763 VI; p. B 05, B 19 BIS, A 18, B 21.

Istor; Nuruosmaniye Vezirhan Cd. No.: 64 Cemberlitas-istambul/Turkey; p. 22.

*JO Magazine;* "Images From our exciting new collection"; 3 pages total.

K Mart, Item #76617103508, Sterling Silver Two-tone Solid Diamond Cut Rope Chain; 3 pages.

Leslie's Jewelry at New York, vol. 698; Item 203-3/2.9/Bi-Color; p. 65.

*L'Oromeccanica Catalog,* L'Oromeccanica SPA; Via Marchesane 115A/36061 Bassano Del Grappa (Vicenza) Italy; cover page, p. 36, 44, 50, one page (1982).

QVC, Item #J64656, 36" Two-tone Solid Rope Necklace, 14K Gold 7.5 grams; 2 pages.

Solid Gold Bracelets, p. 7.

Steven Kretchmer Design; Palenville, NY; 1 page.

Wards D45-9738400, 17" Rope Chain Necklace; #45-9738301, 7" and 18" Rope Chain Bracelet and Necklace; 3 pages.

* cited by examiner

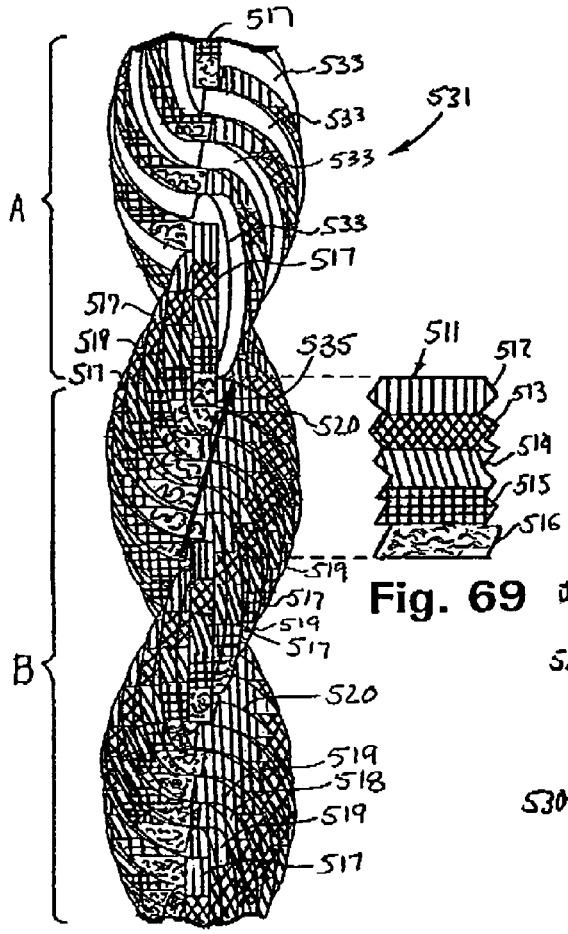
Fig. 70
Fig. 69
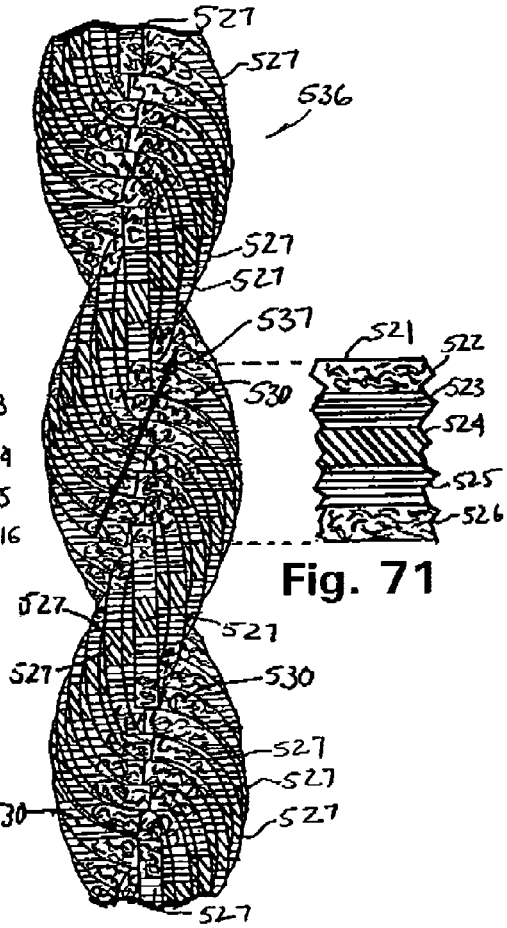
Fig. 72
Fig. 71

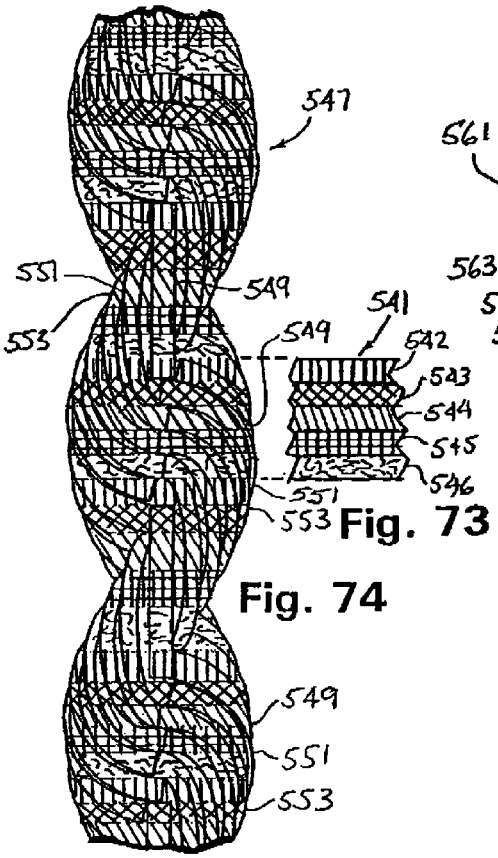
Fig. 73
Fig. 74
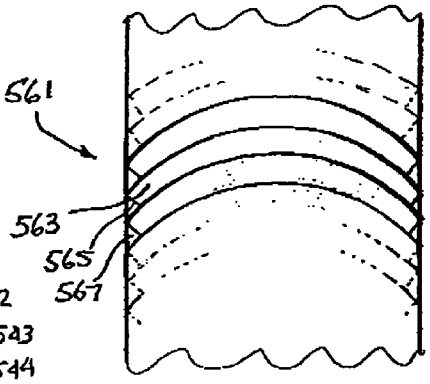
Fig. 76
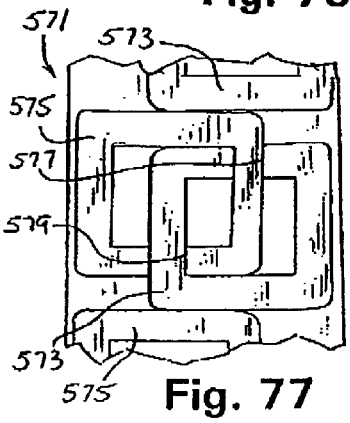
Fig. 77
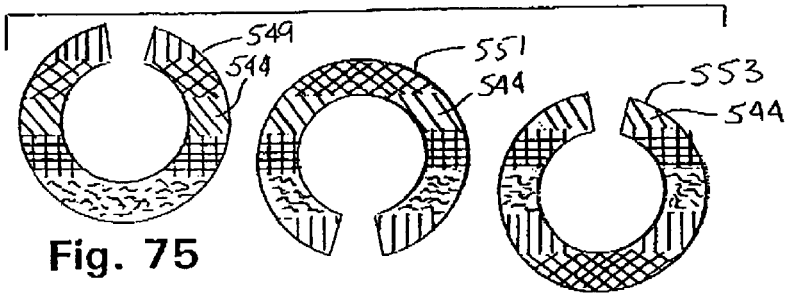
Fig. 75

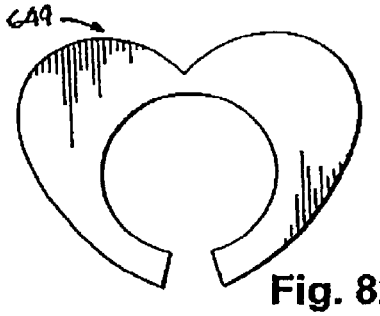
Fig. 82J
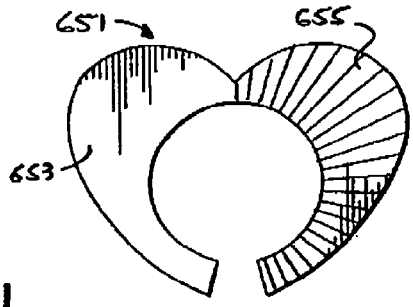
Fig. 82K
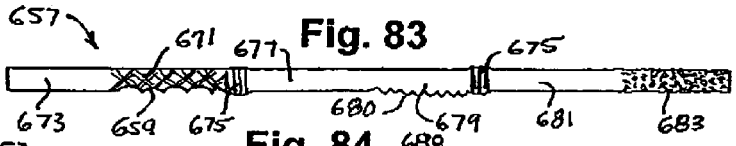
Fig. 83
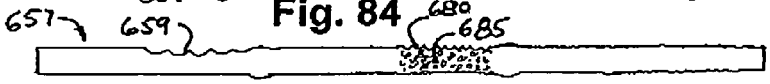
Fig. 84
Fig. 85A
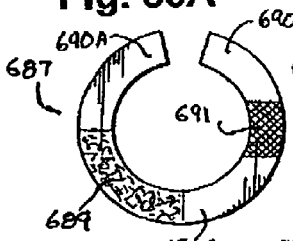
Fig. 85B
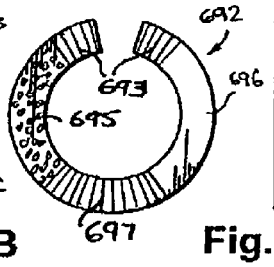
Fig. 85C
Fig. 85D
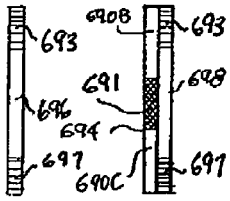
Fig. 85E

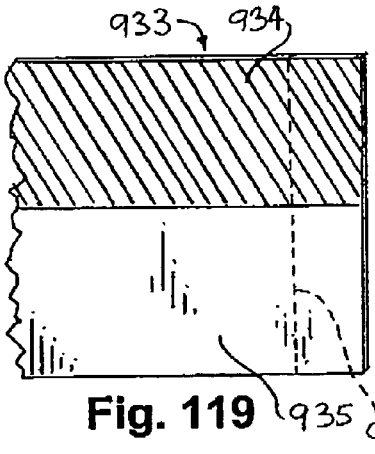
Fig. 119
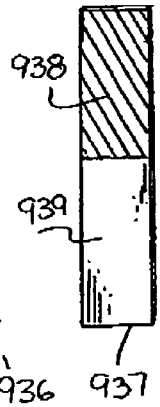
Fig. 120
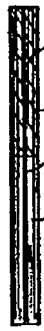
Fig. 121
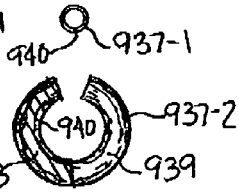
Fig. 122
Fig. 123
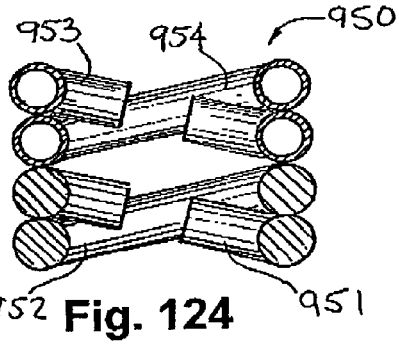
Fig. 124
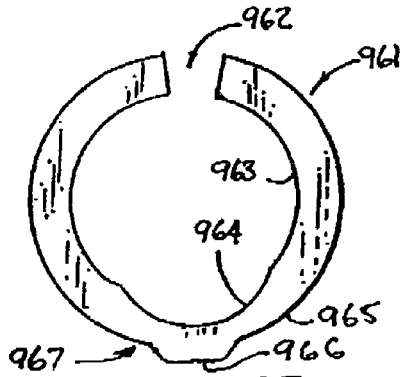
Fig. 125

JEWELRY ROPE CHAIN LINK ELEMENT AND METHODS OF MANUFACTURE

CROSS-REFERENCE TO RELATED APPLICATIONS

This is a continuation-in-part of application Ser. No. 09/337,455, filed Jun. 21, 1999 entitled "JEWELRY ROPE CHAIN LINK ELEMENT", now U.S. Pat. No. 6,560,955, which is a continuation-in-part of application Ser. No. 09/287,972, filed Apr. 7, 1999 entitled "DECORATIVE JEWELRY ROPE CHAIN", now U.S. Pat. No. 6,209,306. A related PCT application No. PCT/US00/09202 published Oct. 12, 2000, WO 00/59328. The entire contents of each such application is incorporated herein by reference.

REFERENCE TO DOCUMENT DISCLOSURE CERTIFICATES

Reference is made to U.S. Document Disclosure Certificate Nos. 449,115 recorded Dec. 22, 1998; 455008 recorded Apr. 19, 1999; 455009 recorded Apr. 19, 1999; 458876 recorded Jul. 5, 1999; 459911 recorded Jul. 30, 1999; 465262 recorded Nov. 24, 1999; 466129 recorded Dec. 6, 1999; and 468786 recorded Feb. 10, 2000. The entire contents of each such certificate is incorporated herein by reference.

BACKGROUND OF THE INVENTION

1 Field of the Invention

This invention relates to the field of decorative jewelry items, and more particularly to jewelry rope chains constructed of link elements exhibiting attractive, decorative, and ornamental visual properties.

2 Brief Description of the Prior Art

Rope chains are a popular type of jewelry made from linking a number of standard sized generally C-shaped annular link elements together in a repetitive manner and usually soldering, welding, or otherwise bonding every two link elements together. The result is a chain that is flexible and pleasing to the eye. The link elements are typically fabricated from gold, silver, or other precious metal and may be round in cross section or may be generally rectangular in cross section with rounded corners.

When made from a length of wire having a circular cross section, compression of the wire in the manufacturing process results in flat major side surfaces and outwardly bulged side surfaces on the interior and exterior edges. This is exemplified in the cross sectional views of prior art link elements shown in FIGS. 1A and 1B, the former being solid and the latter being hollow in cross section. In these figures, it can be observed that, as suggested above, the corners 1*a'* and 1*c'* are quite rounded, despite the flattening of the link element, and lateral edges 1*b'* and 1*d'* are bulged outwardly. The overall generally annular configuration of the link elements is not complete as there must be a gap provided to permit interlinking, i.e. interconnecting, of the link elements with each other, thereby defining the aforementioned generally C-shaped configuration.

The generally C-shaped link elements are fastened together in a particular way, such that tightly interlinking annular link elements give the appearance of a pair of intertwining helical rope strands. A number of annular link elements are connected and intertwined together in a systematic and repetitive pattern of orientation, resulting in an eye-pleasing, flexible, and delicate-appearing chain that looks and feels like a finely braided double helix.

In a conventional rope chain, the orientation pattern of individual link elements making up the rope chain is repeated every several link elements, for example every six link elements, and as such, the chain is referred to as a six-link rope chain. In an improvement to the conventional basic rope chain, it is taught in U.S. Pat. No. 4,651,517 that the link elements can be constructed in different dimensions so that the pattern is repeated every four link elements or even every eight or more link elements. While the '517 patent uses a six-link rope chain as a preferred embodiment, that patent teaches the formulas for creating rope chains consisting of a repeated series of six, eight, or more link elements.

The present invention may be implemented using any number of link elements in a repeated pattern along the finished rope chain. However, a six-link chain will be specifically described and shown in the accompanying drawing, and used as an exemplary embodiment.

When forming link elements from a continuous wire source, the interior and exterior side edges exhibit outwardly bulged side surfaces, as mentioned above. The above-noted U.S. '517 patent teaches the forming of link elements from a continuous length of wire having an initial circular cross section. When cut to length and configured into an annular C-shaped link element, the major surfaces are flattened, but the sided edges are rounded, having been forced to bulge outwardly under the compressive force of a press. This is evident from FIGS. 2, 3, and 7*a* of the '517 patent and the description of these figures in the text. Additionally, having started from wire of circular cross section, the corners of the LE, i.e. the transitions between a flat major surface to the bulging interior and exterior edges, are by the nature of the compression process, rounded.

After assembly of a series of link elements into a jewelry rope chain, because of the overlapping of each link element relative to the link elements on either side, much of each major surface of the link elements is covered by the adjacent link element. Accordingly, any light incident on the completed rope chain will reflect primarily off of the exterior side edges of the link elements. Because of the outwardly curved surfaces of such edges, and because of the rounded corners, reflection of incident light on an assembled rope chain is disbursed in all directions within a wide angle, resulting in the intensity of reflected light at any particular angle being substantially diminished relative to the intensity of the incident light. Due to the disbursement of incident light, the chain typically lacks the sparkle and glitter generally expected of jewelry articles.

Some manufacturers of jewelry use different colored gold and silver elements to enhance the beauty of the jewelry article. Examples are: rope chains in which sets of link elements of one color alternate with sets of link elements of another color; and bracelets or necklaces constructed of interconnected twisted loops exhibiting alternating sets of colored loops along their lengths. Gold, for example, is available in at least four colors; white, yellow, rose (pink), and green.

However, in typical prior art construction techniques for producing rope chain jewelry, each link element is of a single solid color, texture, shape, and pattern, e.g., each link element may be fabricated from a solid thin wire of precious metal, such as gold, in the form of an annular ring. While an all yellow gold rope chain or an all white gold rope chain is attractive, it is otherwise uninteresting due to the monotonic nature of its unvarying coloration, texture, and/or shape along the link elements of the chain. Those prior art rope chains that do exhibit variations of colors along their lengths nevertheless are constructed of individual link elements each of which is of a single solid color, texture, shape, and/or pattern.

Other chain-like jewelry articles exhibit variations of colors along their lengths using interconnected twisted loops, but they are not regarded as rope chains as defined herein.

Additionally, prior art link elements are generally C-shaped with a constant, typically rectangular cross section. As a result, a predictable visual effect is realized when the C-shaped link elements are assembled to simulate intertwined rope helixes, i.e., simulated rope strands. While some prior art rope chains are comprised of link elements of different overall configurations, whatever cross sectional geometry is chosen for a link element, that cross sectional geometry remains constant along the length of the link element, other than for small formed notches or small flattened segments. Again, this characteristic of prior art rope chain link elements results in a predictable visual appearance of the chain when viewed from any axial position along the length of the chain, and when viewed from any side of the chain when it is rotated about its longitudinal axis.

Furthermore, after all of the link elements have been assembled into a finished rope chain jewelry item, a large percentage of the total volume of precious metal in each link element is forever hidden from view. That is, for the structural integrity of the rope chain, certain dimensional parameters have to be maintained, and there have been few attempts in the prior art of manufacturing rope chains to reduce the amount of precious metals being used, for fear of lessening or destroying the structural integrity of the finished product.

SUMMARY OF THE INVENTION

The present invention provides the means and methods for constructing rope chain link elements in a way to produce a length of rope chain jewelry in which each link element, or selected link elements, and therefore the rope chain itself, exhibits unique visual properties.

By providing individual link elements with different visual properties, including different shapes, the ultimate appearance of the completed rope chain can be determined. For example, if each individual link exhibits two colors, the resulting rope chain will exhibit those two colors. Since the link elements overlap, and since they are placed in predetermined positions when they are interlinked, the location of the colors will have an influence on the appearance of the finished product.

Coloration is only one type of "visual property", and may vary according to the type or formulation of the material or materials from which a link element is made. Different surface textures, different reflectivities, different materials including different gold karat weights, different shapes, different pattern feature or characteristics, different sizes, and different surface designs are among other visual properties of a link element that can influence the appearance of a finished rope chain. Such unique visual property traits for the succession of link elements results in a more attractive, fanciful, more delicate and interesting fashion jewelry item.

In addition to exhibiting unique visual properties, employing the concepts of the present invention, lengths of rope chains can be fabricated in which one of the apparent strands of "rope" has a different visual appearance than the intertwining "rope" strand. That is, the appearance of a rope strand at any point along the length of rope chain may not only be visually different than another point along the length of rope chain, but may also be visually different than the adjacent strand. For example, one strand may have an apparent smaller diameter than that of the adjacent strand. Or, the texture, coloration, surface reflectivity, pattern, shape, or other physical attribute of one strand may be totally distinct relative to the adjacent strand.

In accordance with one aspect of the present invention, the annular, or generally C-shaped, link elements may be formed by a stamping process whereby the desired visual effects on the link elements are preliminarily provided on a sheet of material from which the link elements are later stamped, and/or are provided by the operation and nature of the stamping apparatus employed.

For example, the sheet of material may be fabricated from one or more species of the same substance (e.g., gold of different colors or karat weights) or from a combination of substances (e.g., gold and silver). A first portion of the sheet may have a first visual property, and a second portion of the sheet may have a second visual property. Again, the visual property may be the result of selecting different surface textures, different reflectivities, different materials, different gold karat weights, different shapes, different pattern feature or characteristics, different sizes, and different surface designs, or other visual property attribute that provides one portion of the resulting link with a different appearance than another portion.

As another example, especially when the visual property is surface reflectivity (particularly on the exterior edges) texture or shape, the desired visual effects on the link elements may be created during or after the stamping process.

Importantly, as will be described in detail hereinafter, in the stamping process, in addition to die-cutting the outline for the overall generally C-shaped configured link element from the sheet of material provided, the die tools or devices may be fabricated to impress, on one or more of the major or side edge surfaces of the link element being die-cut, a surface texture or shape. That is, any surface or surface portion of the stamped link element may exhibit a desired surface texture or shape produced by an impression on, in, or to that surface by the tooling or device employed by the stamping process, effectively imprinting a desired shape, form, or finish.

To produce enhanced surface reflectivity on the exterior edges of the stamped link elements, a number of factors involving the stamping apparatus come into play. For example, to enhance the reflectivity of the exterior edges the wedge-shaped cutting edges of the die can be non-symmetrical vertically, so as to have a vertical cutting side forming the exterior edge of the link element and an angular cutting side extending into the waste material; the temperature of the material being stamped can be controlled so as to produce a clean cut with minimum deformation of the material at the cut region; the cutting edges of the die can be of extraordinarily hard steel; the cutting edges of the die can be sharpened and honed more often; cutting lubricants can reduce edge distortion; all of which serve to produce flat, smooth, and enhanced highly reflective exterior link element edges with minimum rounding of top and bottom corners.

Portions of a link element may also be shaped by the die-cutting action of the stamping machine differently than other portions.

As indicated, surface texturing may precede or follow the process of stamping from a sheet of material. However, in the interest of cost saving, simultaneous die-cutting and surface texturing is more efficient and is preferred. On the other hand, subjecting an already formed link element (from a stamped sheet, bent wire, bent strip, or otherwise), to a texturing operation to create a surface texture on the link element, prior to assembly into a rope chain, can result in more controlled texturing and permits enhanced custom texturing which may exhibit greater detail than that created during a stamping operation. The invention is not limited to forming a textured surface on a link element only during the stamping operation. Rather, simultaneous stamping and texturing is to be understood as being only exemplary in the descriptions to follow. Accordingly, the present invention contemplates creating the textured surfaces of virtually all of the examples shown and described herein as being performed either during the stamping or slicing operation (of a C-shaped link element or a strip to be bent into a C-shape) or in a texturing operation after such stamping or slicing operation and prior to assembly into a rope chain.

After a link element is die-cut from the sheet of material, a subsequent pressure stamping process may be employed to impress designs or patterns on the major surfaces and/or side edges of the link element.

By interconnecting together a plurality of link elements made in accordance with the invention, a rope chain can be manufactured that exhibits visual properties in a distinctive and decorative pattern. Intermixing link elements exhibiting different visual properties in a particular sequence during assembly of the rope chain can likewise produce visually pleasing lengths of rope chain.

In the process of altering the physical shape of the individual link elements, simultaneously with the enhancement of the visual effect due to the texturing and/or shape altering techniques, small amounts of the precious metal making up the link elements are removed without reducing the effective dimensional characteristics of the elements and, therefore, without diminishing the structural integrity of the finished rope chain product.

Several examples of impressing lines (simulating scoring), serrations, depressions, and other patterns or designs are described in this specification. It should be appreciated that when impressions are made in a soft material, such as gold, during a pressure stamping process, there exists a physical displacement of the material previously occupying the depressed area. Thus, whatever material is pushed out of the depressed area moves to the adjacent regions, thereby making the thickness of the link element greater at such adjacent regions. This is significant, since a thinner sheet of material, at less cost, can be provided. For example, when creating a serrated major surface on a link element being pressure stamped, material pushed out of each groove of the serration necessarily moves into the space between the grooves, increasing the actual maximum thickness of the link element. Again, the combination of enhanced beauty and lower material cost is realized.

Although not intended to be limiting, variations of the present invention, shown and described herein, are distinguished by a changing or varying cross section for portions of the link elements while maintaining at least a portion of at least some of the link elements at a standard sized cross section. Thus, a distinct and decorative rope chain of a given length may have the identical effective rope chain diameter as one made with standard sized C-shaped link elements of constant cross sectional area, and yet result in substantial manufacturing cost savings due to less material being. used in the manufacture of each individual link element, aside from the savings realized by forming the link elements using inexpensive stamping techniques.

Alternatively, variations of the present invention, shown and described herein, are distinguished by a rope chain in which at least some of the link elements are formed with varying cross sections along the entire extent of such link elements, either continuously or in discrete steps.

For example, the cross section of a link element at a first location along the extent of the link element may be of a first geometric shape, and the cross section of the link element at a second location along the extent of the link element is of a second geometric shape, the cross section of the link changing continuously or in discrete steps along its extent from the first location to the second location. Stamping dies can be easily machined to produce a negative mold of the desired shape to produce such variable cross sectioned link elements from a flat sheet of material.

It can therefore be appreciated that fabricating link elements having variably changing visual properties and/or variably changing cross sections, to provide uniquely shaped building blocks for producing exciting and beautiful visual effects in the construction of rope chains, may simultaneously have the synergistic effect of making such physically altered link elements, and thus the rope chains from which they are made, less expensive.

In accordance with one aspect of the invention, there is provided a method for manufacturing a length of six-link rope chain, comprising: providing a material comprising a precious metal; forming generally C-shaped link elements from the material to define a gap between facing ends thereof, each link element having an axis, a first major surface perpendicular to said axis, an opposite second major surface perpendicular to said axis, an interior edge, and an exterior edge having at least a flat linear surface portion parallel to the axis, the parallel portion being smooth and highly light reflective; and assembling a plurality of such link elements to produce a length of six-link rope chain.

The method may include providing the material as a sheet of material having a plurality of regions, adjacent ones of which exhibit different visual properties, and forming the link elements by stamping the sheet of material with a stamping device.

In another aspect of the invention, there is provided a length of jewelry rope chain constructed of a plurality of link elements assembled to form a length of six-link rope chain, wherein each of the link elements has an axis and is generally C-shaped in configuration to define a gap between facing ends thereof, at least one of the link elements comprising: a first major surface perpendicular to the axis; an opposite second major surface perpendicular to the axis; an interior edge; and an exterior edge having at least a flat linear surface portion parallel to the axis, the parallel portion being smooth and highly light reflective.

The link elements of such a rope chain arrangement may comprise a plurality of regions, adjacent ones of which exhibit different visual properties.

In yet another aspect of the invention, there is provided a method for manufacturing a length of rope chain comprised of a plurality of link elements assembled to form a length of six-link rope chain, the method comprising: providing an elongated strip of material having a prescribed length, width, and thickness; forming the strip into a generally C-shaped rope chain link element to define a gap between facing ends thereof, the formed link element having an axis, a first major surface perpendicular to the axis, an opposite second major surface perpendicular to the axis, an interior edge, and an exterior edge having at least a flat linear surface portion parallel to the axis, the parallel portion being smooth and highly light reflective; and assembling a plurality of the link elements to form a length of six-link rope chain.

As a result of the various combinations possible in the manufacture of jewelry rope chains in accordance with the present invention, a virtually limitless number of different design possibilities exist, and preferred ones of such possibilities are shown and described herein. It is to be understood, however, that all combinations of: the number of interconnected link elements in the repeated pattern along the rope chain; solid or portioned coloring and/or texturing; variations in link widths and/or link thicknesses; different designs of the portioned regions of each major surface and/or side peripheral edges of the link elements; changing cross section geometries along the extent of a link element; and different physical shape and/or visual properties as identified in this description may be employed in the manufacture of jewelry rope chains and are contemplated variations of the preferred embodiments specifically shown and described.

BRIEF DESCRIPTION OF THE DRAWING

Further objects and advantages and a better understanding of the present invention may be had by reference to the following detailed description taken in conjunction with the accompanying drawings in which certain figures are lined to show different colors, textures, materials, and/or karat weights, and in which:

FIG. 69 is a fragment representation of the sheet of material shown in FIG. 66 or 67;

FIG. 70 is a is a front elevational view of the outward appearance of a length of jewelry rope chain showing the color, texture, material, or karat weight pattern resulting from assembling link elements including link elements stamped from the sheet of material shown in FIGS. 66 and 67;

FIG. 71 is a fragment representation of the, sheet of material shown in FIG. 68;

FIG. 72 is a is a front elevational view of the outward appearance of a length of jewelry rope chain showing the color, texture, material, or karat weight pattern resulting from assembling link elements stamped from the sheet of material shown in FIG. 68;

FIG. 73 is a plan view of a sheet of material having multiple colored or textured regions, thereby exhibiting five different visual properties, and from which some of the link elements shown in FIG. 74 are stamped;

FIG. 74 is a is a front elevational view of the outward appearance of a length of jewelry rope chain showing the color, texture, material, or karat weight pattern resulting from assembling link elements stamped from a sheet of material or from different sheets of material, similar to that shown in FIG. 73, but with offset color/texture/material/karat weight patterns on adjacent link elements;

FIG. 75 is a plan view of three different link elements, each stamped from a sheet of material or from different sheets of material, similar to that shown in FIG. 73, each link element exhibiting a different, i.e. off set, arrangement of color/texture/material/karat weight patterns from the adjacent link element;

FIG. 76 is a plan view of a sheet of material from which curved slices can be cut and eventually formed into a link element;

FIG. 77 is a plan view of a sheet of material from which link elements can be stamped, the link elements being interlinked in layout and alternating in their gap positions to minimize material waste;

FIG. 82J is a plan view of a prior art heart-shaped link element;

FIG. 82K is a plan view of a heart-shaped link element with one of the arms of the link element textured;

FIG. 83 is a plan view of an elongated strip of material, prior to being bent into a link element, having a plurality of regions, adjacent ones of which exhibit different visual properties;

FIG. 84 is a plan view of the other side of the strip of material shown in FIG. 83;

FIG. 85A is a plan view of a link element exhibiting different visual properties and having a link thickness one half that of a standard link element;

FIG. 85B is a right side elevational view of the link element shown in 85A;

FIG. 85C is a plan view of another link element exhibiting different visual properties than that of FIG. 85A and having a link thickness one-half that of a standard link element;

FIG. 85D is a right side elevational view of the link element shown in 85C;

FIG. 85E is a side elevational view of the two link haves shown in FIGS. 85B and 85D joined together to form a link element of standard thickness, exhibiting different visual properties on first and second major surfaces, and exhibiting a combination of visual properties along the exterior edge thereof;

FIG. 108 is a view similar to that shown in FIG. 106, but with both link elements being partly solid and partly hollow;

FIG. 109 is a view similar to that shown in FIG. 106, but with one of the link elements being hollow, and the other link element being solid;

FIG. 109A is a view similar to that shown in FIG. 106, but with one of the link elements being solid, and the other link element being partly hollow and partly solid;

FIG. 110 is a perspective view of a prior art D-shaped link element;

FIG. 111 is a view similar to that shown in. FIG. 110, but with the substantially straight portion of the D-shape being textured on both the major surface and the exterior edge of the link element;

FIG. 112 is a schematic representation of two isolated adjacent overlapping prior art link elements in and assembled rope chain, each link element having flats in the middle of each arm center;

FIG. 113 is a view similar to that shown in FIG. 112, but with one arm of each link element being textured on the same side of the assembled rope chain, but with their gaps opening in opposite directions;

FIG. 114 is a perspective view of a tubular link element having a substantially circular cross section, according to the prior art, and showing two spaced apart flats along the middle of the exterior surface of one of the arms of the link element;

FIG. 115 is a view similar to that shown in FIG. 114, but with one arm being textured on its exterior surface, and a series of flats formed superimposed over the textured surface at the middle of the exterior edge of the one arm;

FIG. 116 is a view similar to that shown in FIG. 114, but with one major surface of one of the arms being textured, and the exterior edge of the one arm having a series of connected flats along the extent of the one arm;

FIG. 117 is a plan view of a link element according to the prior art in which one arm has a flat surface formed on the exterior edge in the center of one of the arms;

FIG. 118 is a view similar to that shown in FIG. 117, but with the flat and the major surface region adjacent the flat being textured;

Figure 1:
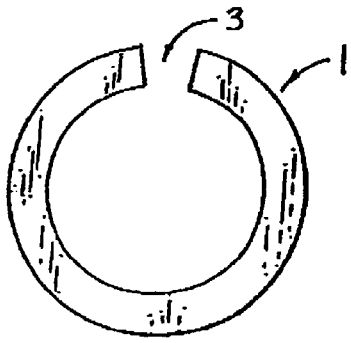
Fig. 1 (Prior Art)
FIG. 1 is a plan view of an annular link element which is the basic building element for the construction of jewelry rope chains as known in the prior art.

FIG. 119 is a perspective view of a thin strip of material exhibiting two different visual properties lengthwise of the strip;

FIG. 120 is a perspective view of a segment cut from the end of the strip of material shown in FIG. 119;

FIG. 121 is a perspective view of the segment shown in FIG. 120 after being rolled into a cylindrical shape about an axis parallel to the length of the segment, in a first bending operation;

FIG. 122 is an end view from the bottom of the rolled segment shown in FIG. 121;

FIG. 123 is a perspective view of the first-bent segment shown in FIG. 121 after being rolled into a C-shape, in a second bending operation;

FIG. 124 is a schematic representation of a cross sectional view taken across the arm centers of four adjacent link elements in an assembled rope chain in which two adjacent hollow link elements are followed by two adjacent solid link elements; and FIG. 125 is a plan view of a link element having a non-standard heel geometry.

DEFINITIONS

For the purposes of this description, the following definitions are provided.

"Rope chain" is a series of sets of interlinked, or interconnected, link elements which has the appearance of a plurality of braided, or helically intertwined, multi-fiber strands of hemp, flax, or the like.

"Standard" or "Ordinary" refers to the dimensional characteristics of annular link elements without major surface or edge variation and whose dimensions follow the recommendations according to the aforementioned U.S. Pat. No. 4,651,517, for example, i.e. whose dimensions result in a tightly fitting series of link elements having the appearance of intertwining helical strands of rope.

A "set" is the number of adjacent interlinked, or interconnected, link elements making up a structurally repeated pattern along the chain. In the accompanying drawings and associated text, a six-link set is used for purposes of ease of visual presentation and description. Thus, the accompanying drawing shows that the angular spacing of adjacent link elements along the chain axis is 15°, whereby it requires six adjacent link elements to make a 90° turn around the chain axis.

A "group" is a number of adjacent interlinked, or interconnected, link elements exhibiting identical visual properties. The number of link elements in a group may be the same or different than the number of link elements in a set. Groups may be uniformly or randomly distributed along the rope chain.

A "link" is the basic building element (also referred herein as a "link element"), a number of which are assembled in series to form a rope chain. Link elements of the prior art are typically annular and C-shaped with an open "gap" having a span slightly greater than the width of the annular link. The region of a link element diametrically across from the gap is referred to herein as the "heel" or "heel portion" of the link element. In accordance with the present invention, a link element may have a circular, baguette, oval, diamond, rectangular, square, polygonal, heart, or other geometrical shape. Each is provided with a gap at a selected position along the perimeter thereof thereby maintaining a generally C-shaped overall configuration. In such a generally C-shaped overall configuration, the inner periphery will be referred to herein as an interior edge, and the outer periphery will be referred to as an exterior edge. While the link elements of a rope chain are not necessarily annular, it is the preferred configuration for the basic building element of a rope chain, and for that reason an annular link element will be used in most of the examples shown and described herein.

A "channel" is the path which the eye follows in passing along the rope chain at the lowest point of the V-shaped helical groove formed between the apparent intertwined rope braids. Hence, in the preferred embodiments described herein, the rope chain has the appearance of a pair of intertwined braids of ropes, and thus there exists two such helical channels offset from one another by one-half of the pitch of either helix.

A "visual property", as used herein, is a characteristic of an object which presents a particular visual image to the eye. Such characteristics include, but are not limited to, color, texture, material, karat weight, pattern, size, reflectivity, design, and/or shape. Although shape is also a physical property of an object, in the art of jewelry making, it is often the physical shapes which impart beauty and delicateness to a fashion item.

"Texture", as used in this description, refers to the physical character of the surface of a link element, or portion thereof. It may also refer to the physical surface character of an assembled rope chain constructed using textured link elements. The term "texture" or "texturing" includes, but is not limited to, serrating (at any desired angle, including radial serrating), scoring, knurling, lining, patterning, pressure stamping, impressing, sandblasting, etching, shaping, polishing, matting, frosting, and diamond cutting.

"Color", as used herein, refers to the quality of the link element or portion thereof with respect to light reflected by it and visually perceived by the eye as a particular hue, saturation, and brightness of the reflected light. In most cases, the different colors exhibited by a link element or portion(s) thereof result from the use of different materials (white gold as differing from yellow gold as differing from rhodium as differing from enamel coatings of different hues, etc.).

The "major surface" of a link element refers to the substantially flat or planar upper and lower facial surfaces of a link element. Such surface, although being substantially planar, nevertheless may have raised or depressed patterns therein, or may be notched, gouged, textured, or otherwise physically altered by the stamping process to present a desired pleasing visual effect to the observer. Additionally, the upper and lower facial surfaces need not be flat. For example, the link elements may be circular in cross section, in whole or in part, and yet have the uppermost and lowermost surface portions lying in respective parallel planes.

The "interior" and "exterior" edges of a link element are, respectively, the inner and outer peripheral sides which span between the upper and lower major surfaces of a link element. Such interior and exterior edges, may have raised or depressed patterns therein, or may be notched, gouged, textured, or otherwise physically altered by the stamping process, or post stamping process, to present a desired pleasing visual effect to the observer. Preferably, a portion or all of the exterior edge of a link element is flat, smooth, and is highly light reflective.

"Link width" is defined as a distance, measured along either of the major surfaces, between a pair of parallel lines perpendicular to the major surfaces and tangent to, respectively, the interior and exterior edges;.

"Link thickness" is defined as a distance between and perpendicular to the planes of the upper and lower major surfaces.

The "extent of a link element" is defined as the length, along the body of a link element, beginning from one side of the gap and extending to the other side of the gap.

"Configuration" refers to the overall appearance of a link element. Typical link elements are annular with a gap in the annulus to permit interlinking with other link elements. As disclosed herein, link elements can have shapes other than annular. However, all link elements have an overall C-shaped configuration.

The term "flat" as it is used in the description of the exterior edge of a link element means not bulged. That is, a flat exterior edge has a linear component that is parallel to the "axis" of the link element, the axis being perpendicular, or nearly perpendicular, to a major surface of the link element. Such a flat exterior edge can therefore be, in part or in whole, cylindrical, conical, or planar depending upon the overall configuration of the link element.

"Die-cutting" as used herein refers to the process and tooling with which a die, constructed of hardened metal with sharp edges, is brought into contact with a sheet of material cutting portions out of the sheet of material according to a predetermined pattern of the sharp edges of the die.

"Stamping", can have the same meaning as "die-cutting" when meaning that a pattern is stamped (cut) out of a sheet of material. However, "stamping" is also defined as imprinting, striking, pounding, marking, or otherwise providing a distinctive character to a surface by the pressure of a die pattern against such surface. Thus, "stamping" can mean cutting of and/or impressing on a sheet of material. In particular, "pressure stamping" impresses a material under pressure, but does not cut through the material.

Rope chains may be constructed by interconnecting link elements employing traditional, or "conventional", manual assembly procedures. Alternatively, rope chains may be constructed automatically employing specially designed machines. If older conventional assembly steps are employed in the construction of a rope chain, every other link element is inverted, i.e. adjacent link elements have their respective gaps facing in opposite directions, and systematic soldering of adjacent link elements along the chain is necessary to maintain a "twisted rope" appearance. "Machine-made" rope chains are made with the gap of each link element facing in the same direction or in alternate directions.

When imparting different visual properties to a rope chain by assembling link elements having portions exhibiting different visual properties, the method of assembly must be considered. For example, with a length of rope chain assembled with all gaps facing the same direction, any visual property of one link element will always register with the adjacent one, since all gaps face in the same direction and all link elements are identical. Again, this assumes that both major surfaces of each link element have similar visual property patterns so as to exhibit symmetrical visual properties of the completed chain from any view angle.

However, employing assembly procedures in which adjacent link elements have their gaps facing in opposite directions, any visually non-symmetrical portion of a link element on opposite sides of a line perpendicular to a line passing through the center of the gap and center of the link element itself will not produce the desired effect of differently appearing rope strands in the completed rope chain. This is because portions on a first link element having a particular visual property will not register with the corresponding portions of an adjacent first link element which has its gap inverted from that of the first. To remedy this situation, second link elements, each with an inverse of the visual appearance of the first link element, must be provided and assembled alternately with first link elements. Thus, when assembled, with their gaps alternating in orientation, the visual property patterns on all adjacent link elements will be in registration.

DETAILED DESCRIPTION OF THE PREFERRED EMBODIMENTS

Figure 2A:
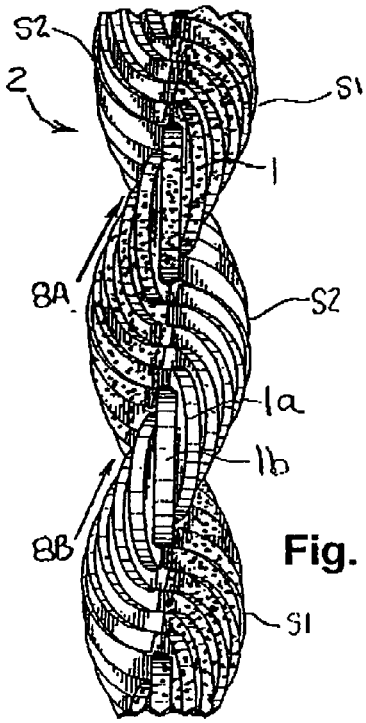
FIG. 2A is a front elevational view of the outward appearance of a jewelry rope chain made in accordance with the present invention and depicting a different visual property for the two intertwining rope chain strands.
Figure 2B:
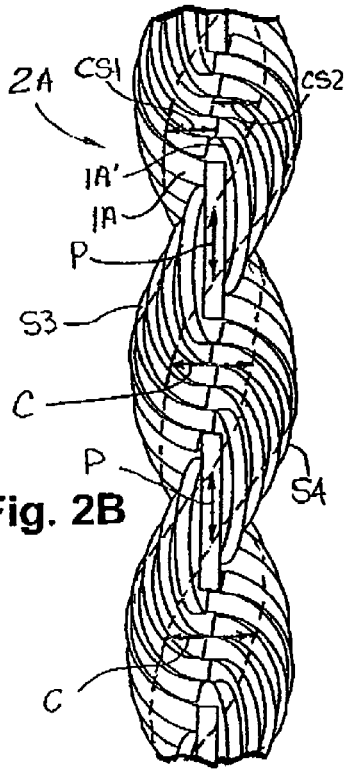
FIG. 2B shows a length of six-link rope chain defining certain attributes of a rope chain, which attributes will be referred to in this description.

With reference to FIGS. 1, 2A and 2B, and ignoring for purposes of this introduction all texturing or segmenting of portions of the rope chains depicted in FIGS. 2A and 2B, conventional rope chains are made with a systematic and repetitive interlinking of basic annular link elements 1 such as that shown in FIG. 1.

Figure 1A:
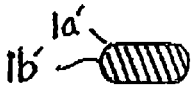
Fig. 1A (Prior Art)
FIGS. 1A–1F depict different cross sectional views of differently constructed solid and hollow link elements, each cross section taken across an arm of the respective link element.
Figure 1B:
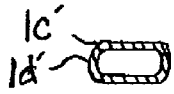
Fig. 1B (Prior Art)
Figure 1C:
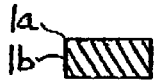
Figure 1D:
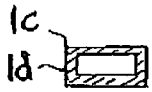
Figure 1E:
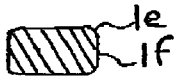
Figure 1F:
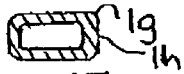

Employing the methodology disclosed herein will result in link elements 1 having flat edge surfaces 1*b*, 1*d*, or at least a flat linear surface portion 1*f*, 1*h*, as shown in FIGS. 1C–1F. Such flat surface or surface portions may extend along the entire extent of a link element, or extend only partially along the extent of a link element. Unlike prior art procedures which produce link elements with severely rounded corners and bulging lateral side edges, shown in cross section in FIGS. 1A and 1B, the methods and structural concepts according to the present invention result in solid or hollow link elements having cross sectional shapes characterized by sharp corners 1*a* and 1*c* or slightly rounded corners 1*e* and 1*g*, and flat (in cross section) lateral side edges 1*b* and 1*d* or partially flat (in cross section) lateral side edges 1*f* and 1*h*. Sharp corners, like 1*a* and 1*c* result in more reflectivity from light incident on the entire flat side edges 1*b* and 1*d*, but may scratch or catch on external objects. By forming flat sided link elements with slightly rounded corners 1*e* and 1*g*, this concern is minimized while maintaining a significant amount of reflected incident light due to the partially flat side portions 1*f* and 1*h*. Thus, according to a preferred embodiment of the invention, a more attractive rope chain may be fabricated employing link elements with exterior edges having at least a flat linear surface portion 1*f*, 1*h* parallel to the axis of the link element, the parallel surface portion being smooth and highly light reflective.

The annular link element 1 must meet certain dimensional requirements for the interlinking to result in a well-fitting rope chain. Such dimensions are known in the art and will vary from a four-link variety to a six-link variety to an eight-link variety, and so on. Determining the proper dimensions for the annular link element 1 and the gap 3 therein, depending upon the number of desired link elements to form a set of interlinked link elements, can be readily understood by reference to the aforementioned U.S. patents, especially U.S. Pat. No. 4,651,517. As can be viewed in FIG. 2A, and again ignoring for the moment the visual differences depicted, the intertwined link elements 1 of a segment of a conventional rope chain 2 are shown in FIG. 2A in the form of a six-link variety. In their assembled form, the series of link elements 1 produce the appearance of a pair of strands S1, S2 of braided rope, the combination of which results in a double intertwined helical appearance.

FIG. 2B is a schematic representation showing a length of six-link rope chain defining certain attributes of a rope chain, which attributes will be referred to in this description. Specifically, the labels in FIG. 2B identify: the two rope "strands" S3 and S4; the two intertwining helical "channels" C; one "channel side" CS1; the complementary other "channel side" CS2 (CS1 and CS2 making up a full "channel" S3 or S4); link element portions 1A and 1A' (adjacent a gap or heel) defining the respective "channel sides," CS1 and CS2; and the most outwardly portion P of the two rope "strands" S3 and S4, referred to herein as the "outer periphery" regions.

As seen in FIGS. 2A and 2B, the apparent intertwining of a pair of rope strands S1, S2 or S3, S4 results in a V-shaped groove between the braids at any position along the rope chain. As noted above, the path along such V-shaped groove is referred to herein as a "channel", and since there are two apparent rope strands, there are, likewise, two defined channels indicated in FIG. 2A by the directional arrows 8A and 8B and in FIG. 2B by the letter "C". Channels 8A, 8B, and C along the length of the rope chain, define the transition points between adjacent helical strands S1–S4. However, the two channels of a rope chain never intersect one another, and are parallel to one another along the length of the rope chain separated axially by one half of the pitch of either of the two channels. In FIG. 2A, there is a striking visual difference in following along the two helical channels 8A and 8B. Along channel 8A, the left side is plain, and the right side is colored or textured. Along channel 8B, the opposite visual property is observable. This is due to the fact that the rope chain is comprised of a repetitive series of sets of link elements 1, and all link elements have one arm colored or textured, and the other arm plain, and they are interconnected such that like arms lay against like arms along the chain.

Figure 3:
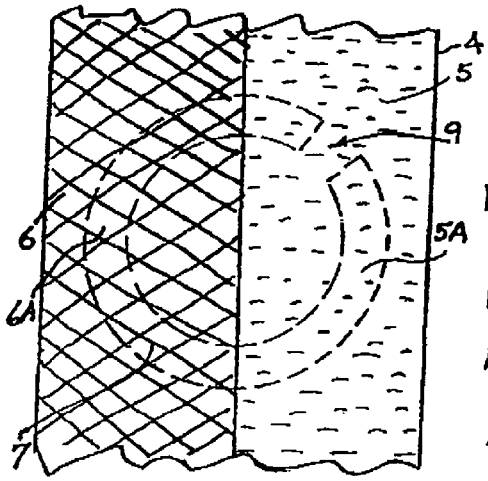
FIG. 3 is a plan view of a sheet of material showing multicolored edge-joined flat strips or regions and, in dashed lines, the location and orientation of a link element to be stamped from such sheet of material.
Figure 118:
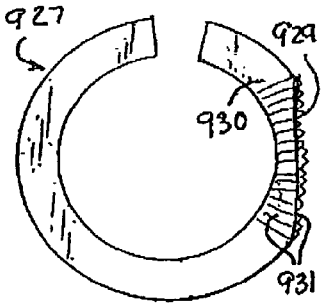

The remaining figures to be described, FIGS. 3–118, illustrate examples of a virtually limitless number of variations of the design and construction features of link elements that may be assembled into distinctively beautiful and unique rope chains having appealing visual properties.

It will be appreciated that a link element may exhibit multiple colors due to a variety of possible physical constructions. For example, as in the aforementioned prior application Ser. No. 09/287,972, entitled "DECORATIVE JEWELRY ROPE CHAIN", a link element may be of laminated construction, such that one major surface is of one material or color and the opposite major surface is of a different material or color. Additionally, or alternatively, each or both major surfaces may be divided into portions, each portion exhibiting a color, texture, or shape different from its adjacent portion.

In describing FIGS. 3–118, it should be understood that the link elements so shown may all be manufactured by employing a stamping and/or die-cutting operation. In some embodiments, the link elements are stamped, or die-cut, in their final shape, which may not only stamp the link element from a sheet of material, but may simultaneously mold the link element into a shape having a desired cross sectional shape, either fixed or variable along the extent of the link element. In other embodiments, coloring and/or texturing is pre-applied prior to stamping or die-cutting. In yet other embodiments, the link elements are formed by bending strips of material which themselves were stamped, or die-cut, from a sheet of material. In still other embodiments, the link elements, or strips of material to be bent into the shape of link elements, are textured in an operation after stamping or slicing and prior to assembly into a rope chain. Where this specification describes forming a textured surface during a stamping operation, it will be understood that a textured surface may, instead or additionally, be formed in a separate texturing operation after the link element, or strip to be bent into the shape of a link element, is provided and before assembly into a rope chain.

In FIG. 3, the plan view of a sheet of material 4 has regions 5 and 6 exhibiting different visual properties, represented in FIG. 3 as different colors. When stamped from the sheet of material 4, the annular link element 7, the position and orientation of which is shown in dashed lines, will have, on at least one planar major facial surface thereof, a first segment 5A of a first visual property, e.g. color, and a second segment 6A of a second visual property, e.g. color. The link element 7 may be formed, for example, by stamping a flat sheet constructed of two edge-joined strips of different flat materials, or of two edge-joined strips of materials of different colors and/or textures and/or coatings (such as by the application of an enamel).

It will be noted in FIG. 3 that the link element 7 to be stamped from the sheet of material 4 has its gap 9 oriented at approximately a two o'clock position, such that a short portion on the left side, or arm, of the link element 7 near the gap 9 will be of white gold color, while the remainder of the left side will be of a yellow gold color. The opposite is true of the right side, or arm, of link element 7, i.e. a large segment of the right side adjacent the gap 9 is of a white gold color, while a shorter segment of the right side is of a yellow gold color. When a number of such link elements 7 are assembled into a rope chain, an interesting color pattern will be observed in the double helical length of rope chain. That is, one of the helixes will have a predominant white color with a small portion of the helix being of a yellow color adjacent one of the rope chain channels, while the other, helix will be primarily of a yellow color with a small portion of the helix being of a white color adjacent one of the rope chain channels.

In changing the angular position of the die relative to the sheet of material being cut, either the material or the stamping die can be angularly repositioned.

In this connection, most of the remaining figures are not lined for color. However, it will be understood that all, or portions, of each of the link elements to be described hereinafter may be of a color selected from a variety of different colors, and/or may be made of a material selected from a variety of different materials. For example, any of the link elements described herein may have the entire surface, or portions thereof, of yellow gold, white gold, rose (pink) gold, green gold, silver, nickel, or rhodium, either solid, plated, or laminated; or such surfaces, or portions thereof, may be enameled.

In some cases, the gapped link elements may be stamped from a multicolored flat sheet comprising a number of edge-joined strips of alternately colored gold materials, or alternately of different materials such as gold and silver. Such a multicolored flat sheet may be stamped to form gapped link elements in different orientations relative to the strip pattern and relative to the gap position, resulting in a variety of interesting colored patterns in the finished rope chain, yet all such link elements can be stamped from the same multicolored stripped sheet.

Figure 4:
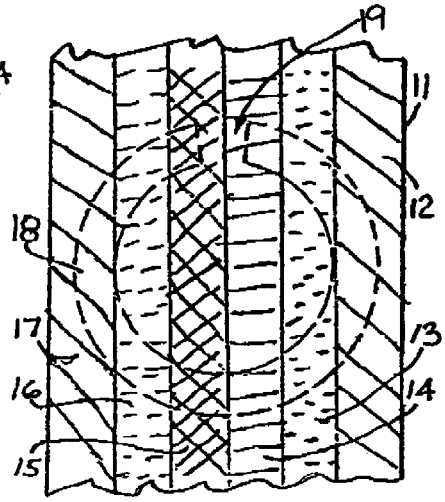
FIG. 4 is a view similar to that of FIG. 3, but with more colored adjoined strips and a different orientation of the link element to be stamped from such sheet of material.

FIG. 4 is a view similar to that of FIG. 3, except that the sheet of material 11 comprises a larger number of colored strips 12–17, and the link element 18 to be stamped from the sheet of material 11 has a different orientation relative to the longitudinal extent of the edge-joined strips 12–17. With the gap 19 oriented at the twelve o'clock position, a length of rope chain constructed by assembling a number of link elements 18 will produce a length of rope chain of two intertwined helixes, but with the outermost surface of each helix being of the same color, since strips 12 and 17 are lined for the same color of material. On either side of the outermost peripheral surface of each helix, a short length of a different color will be observed from one helix to the other, since strips 13 and 16 are lined to indicate two different colors, although they could be the same if desired. Then, the extreme visible inner portion of each helix, along the rope chain channels, will have yet a third and fourth color visible to the observer, due to the different colored strips 14 and 15 lined in FIG. 4 to indicate different coloration between the two strips.

In the remaining figures to be described, the relative position of the gap in the link chain to be produced and the number of strips, width of each strip, and color of each strip will obviously produce different visual effects, and the description of FIGS. 3 and 4 above will serve as a basis for understanding the resulting color/texture/material/karat weight/shape or pattern that will be visible in the intertwining helixes. Moreover, by reference to the aforementioned patent application Ser. No. 09/337,455 entitled "Jewelry Rope Chain Link Element", U.S. Pat. No. 4,651,517, and U.S. Pat. No. 5,301,498, an appreciation of the display of visual properties of a length of rope chain will be fully understood by a person of ordinary skill in the art of making rope chains. Accordingly, minute details of the visual effects resulting from manufacturing and assembling the link elements yet to be described, and resulting from assembling combinations of link elements described in this specification, are unnecessary.

Figure 5:
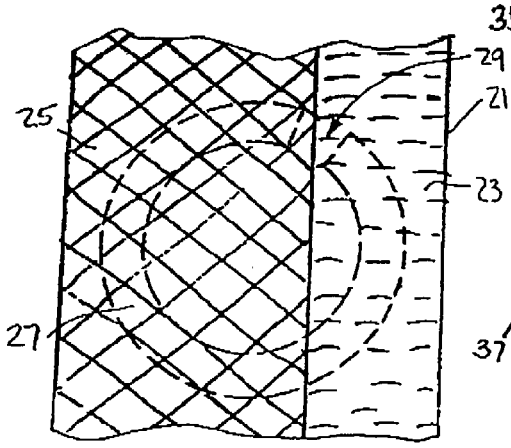
FIG. 5 is a view similar to that of FIG. 3, but with different widths of the colored strips making up the sheet of material.
Figure 7:
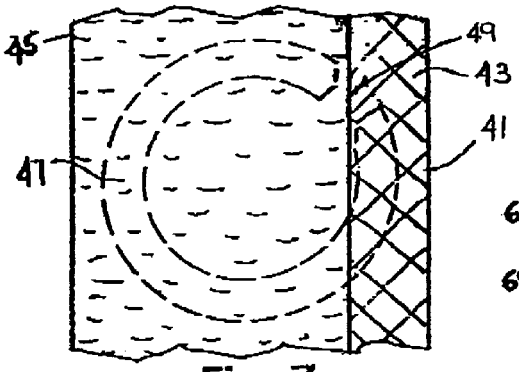
FIG. 7 is a view similar to that of FIG. 5, but with different widths of the colored strips making up the sheet of material and a reversal of the colored strips.

FIGS. 5 and 7 illustrate how the visual properties of the link elements 27 and 47, respectively can be varied by varying the widths and arrangement of the visual properties of the sheet of material 21, 41.

FIG. 5 is a view similar to that of FIG. 3, except that the sheet of material 21 is comprised of two edge-joined strips 23, 25 which are not only of different colors but are of different widths. With the gap 29 oriented at about a one o'clock position, one of the helixes of the finished rope chain will be of an all yellow gold color, while the other helix will be both yellow and white gold in color.

Figure 6:
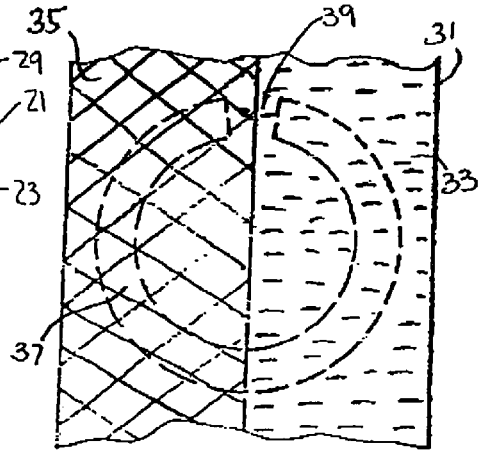
FIG. 6 is a view similar to that of FIG. 3, but showing a different orientation of the link element to be stamped from such sheet of material.

FIG. 6 is also a view similar to that of FIG. 3, but showing a different orientation of the link element 37 to be stamped from the sheet of material 31 comprised of edge-joined colored strips 33 and 35. With the gap 39 oriented at the twelve o'clock position, the two helixes will both be of a single color, but one helix will be of white gold and the other will be of yellow gold in color. The lined colors shown in FIG. 6, and in all of the accompanying figures, are intended to be representative of any two, or multiple, colors, and thus the two strips 33 and 35 in FIG. 6 may be both of yellow gold, but with one strip being of a relatively low gold karat weight and the other of a relatively higher gold karat weight.

FIG. 7 is a view similar to that of FIG. 5, but with the sheet of material 41 comprised of two differently colored edge-joined strips 43 and 45 having different widths than those shown in FIG. 5 and a color reversal of the stripped regions 43 and 45. The gap 49, however, is oriented similar to that shown in FIG. 5.

Figure 7A:
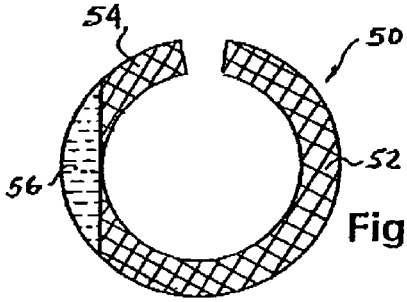
FIG. 7A is an example of a link element stamped from a multicolored sheet of material.

FIG. 7A is an example of a link element 50 stamped from a multicolored sheet (not shown) of material, resulting in a major yellow gold portion 52, a minor gold portion 54, and a central segment 56 of white gold on one of the halves of the link element 50. A rope chain constructed from link elements 50, if central segments 56 are all aligned link-to-link, would have the appearance of a primarily yellow gold rope chain with the outermost peripheral edge of one of the helical rope strands displaying a central helical path of white gold.

Figure 8:
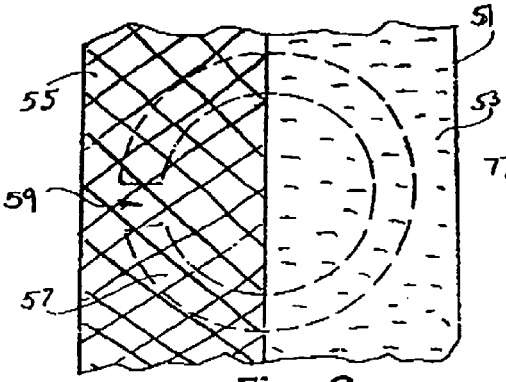
FIG. 8 is a view similar to that of FIG. 3 or 6, but showing a different orientation of the link element to be stamped from such sheet of material.

FIG. 8 is a view similar to that of FIGS. 3 or 6, but showing a different orientation of the gap 59 for the link element 57 to be stamped from the sheet of material 51 comprising colored elongated regions 53 and 55. A length of rope chain constructed of link elements 57, alternating with link elements of similar construction but with the colors in regions 53 and 55 reversed, would thus display one-half of each of the two helixes as white gold and the other half as yellow gold, with one side of each channel (8A and 8B, FIG. 2) of white gold, and the other side of yellow gold.

FIGS. 6 and 8 show how the visual properties of the link elements 37, 57 can be varied by stamping, from sheets with substantially the same visual properties, link elements with their respective gaps 39, 59 in different angular orientations. For example, in FIG. 6, the stamping produces a link element 37 with a gap 39 oriented such that the link element is bifurcated in half through the gap 39, and each half of the link element 37 is of a different visual property. By simply setting the stamping of the link element to be in a different angular position (as in FIG. 8), where the gap 59 is rotated 90 degrees, the orientation of the visual properties on the link element 57 is also offset by 90 degrees. This has significance, because certain parts of a link element relative to its gap have more visibility in the finished rope chain than other parts. The foregoing is just one example of how the position of visual properties on the individual link elements may be changed by varying the angular position of stamping without changing the arrangement of visual properties of the sheet on which the stamping is applied.

By the combination of varying: 1) the visual properties of a sheet on which stamping is applied; and 2) the angular position of stamping, a myriad of link elements with different visual properties may be produced that will, in turn, result in a great number of rope chains of varying visual properties.

Figure 9:
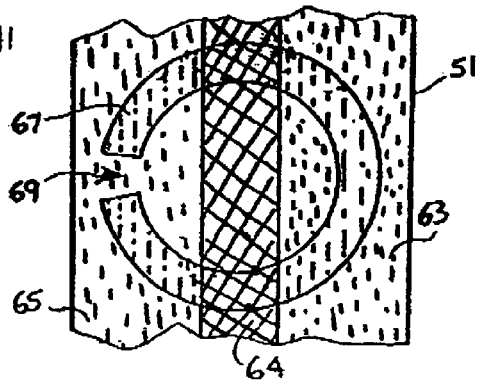
FIG. 9 is a view similar to that of FIG. 8, but with a different number and arrangement of colored strips making up the sheet of material.

In FIG. 9, the sheet of material 51 has wide white gold edge-joined strips 63 and 65 with a central yellow gold strip 64 of smaller width. With the gap 69 in the nine o'clock position, as shown, a link element 67 stamped from the sheet of material 51 would display both helixes as white gold in color with a yellow gold helical band directly in the center of each helix.

Figure 10:
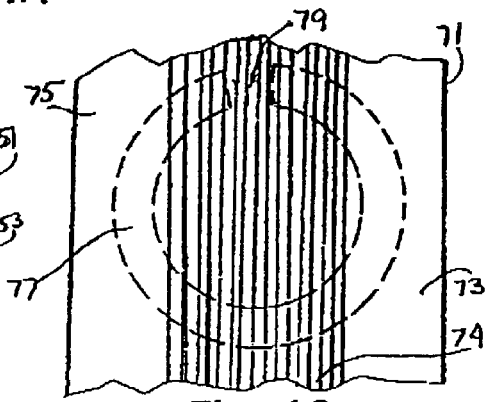
FIG. 10 is a plan view of a sheet of material having an intermediate textured region and, in dashed lines, the location and orientation of a link element to be stamped from such sheet of material.

FIG. 10 illustrates that, instead of, or in addition to, color elongated edge-joined strips, a sheet of material 71 may have a preformed length of textured surface 74 leaving the surface areas 73 and 75 on each side of the textured surface 74 non-textured. With the gap 79 at the twelve o'clock position, as shown, a link element 77 will present a non-textured outer surface of each of the two helixes, while the inner sides of the helixes, i.e. on a major facial surface along the channels of the rope chain (see reference numerals 8A and 8B in FIG. 2) will be textured.

In FIG. 10 and other figures showing preformed regions of textured surfaces, parallel lines are typically depicted, suggesting a scored or serrated textured appearance. It is to be understood that this showing of pre-textured surfaces are examples only, and that any other known pre-texturing process can be used. Other examples include forming at least one of the regions of different surface textures employing at least one process selected from the group consisting of serrating (at any desired angle, including radial serrating), scoring, knurling, lining, patterning, pressure stamping, impressing, sandblasting, etching, shaping, polishing, matting, frosting, and diamond cutting.

Figure 11:
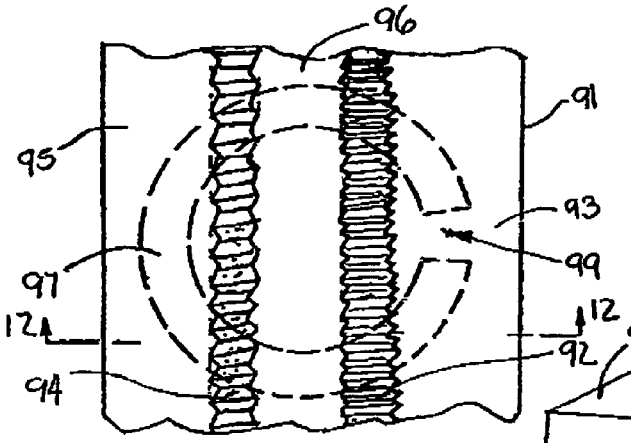
FIG. 11 is a plan view of a sheet of material having multiple textured regions, thereby exhibiting three different visual properties, and, in dashed lines, the location and orientation of a link element to be stamped from such sheet of material.

FIG. 11 illustrates the possibility of providing a sheet of material 91 with two different regions of surface texturing shown at 92 and 94 in FIG. 11, leaving the regions 93, 95, and 96 non-textured. With the gap 99 at the three o'clock position, as shown, each of the two helixes of an assembled rope chain will show a pair of spaced textured helical stripes equally spaced from the outermost surface of the helixes.

Figure 12A:
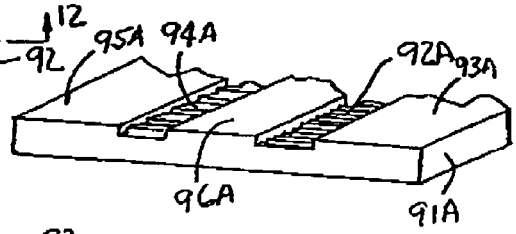
FIGS. 12 and 12A are perspective views of the segment of sheet material shown in FIG. 11 taken along the line 12—12 in FIG. 11, for the respective embodiments in which textured regions are present in the top only, or in both the top and bottom major surfaces of the sheet of material.
Figure 12:
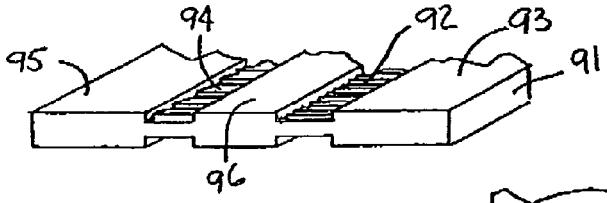

FIGS. 12 and 12A illustrates one possible physical structure for the double textured sheet of material 91 shown in FIG. 11. In FIG. 12, it will be observed that the two textured surfaces 92 and 94 on the upper side of the sheet of material 91 have different geometrical properties, and that similar textured regions (not numbered) can optionally be formed on the lower surface of the sheet of material 91 and may have the same or different textured patterns.

Figure 13:
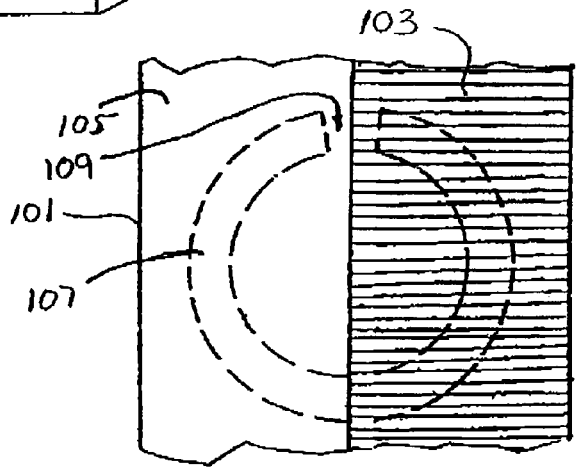
FIG. 13 is a view similar to that of FIG. 10, but with the position of the textured region in a different location and having lines representing the texturing perpendicular to the length of the sheet of material.

In FIG. 13, the sheet of material 101 has two regions 103, 105 which are differently configured. A link element 107 may be stamped out of the sheet 101 such that, with the gap region 109 being at the 12 o'clock position, the right side of link element 107 exhibits a textured surface, while the left side is either textured differently or non-textured. Region 103 is shown as being textured, but it may be non-textured. Region 105 is shown as being non-textured, but it may be textured if region 103 is non-textured or differently textured.

Figure 13A:
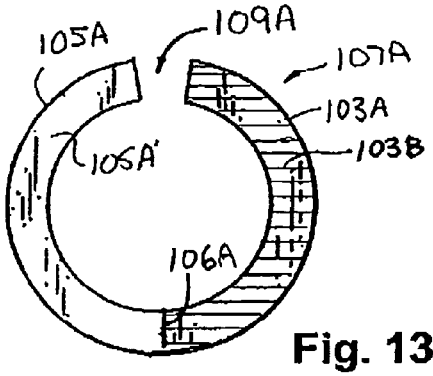
FIG. 13A is a plan view of a link element stamped from the sheet of material shown in FIG. 13.
Figure 13B:
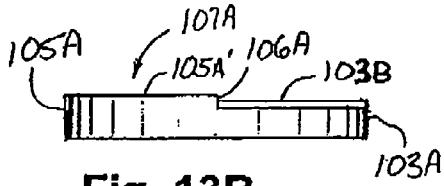
FIG. 13B is a side elevation of the link element shown in FIG. 13A, as viewed from the heel of the link element.

FIG. 13A is a plan view of a link element 107A stamped from the sheet of material 101 shown in FIG. 13, FIG. 13B being a side elevational view from the heel of the link element 107A.

By altering the design and construction of the sheet of material 101 shown in FIG. 13, e.g. changing types and styles of surface texturing, colors, material types, or other physical characteristics such as material thickness, a variety of link elements can be produced exhibiting unique and attractive effects when assembled into a rope chain. The embodiments of FIGS. 13A–13G are exemplary.

For the embodiment shown in FIGS. 13A and 13B, link element 107A can be produced, shown in FIG. 13A as having a non-textured arm 105A and a textured arm 103A. The end view in FIG. 13B shows the textured (in the example, serrated) surface 103B slightly lower than the top major surface 105A' of link arm 105A, the transition to the recessed serrated arm 103A indicated by step 106A. In this way, precious metal can be saved without significant loss of attractiveness for the finished rope chain, since the luster of the serrated arm 103A will make imperceptible the fact that the serrations are made on a thinner portion of each link element.

Figure 13D:
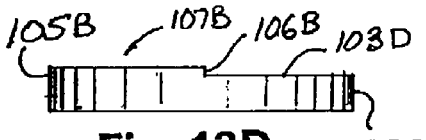
FIG. 13D is a side elevation of the link element shown in FIG. 13C, as viewed from the heel of the link element.
Figure 13C:
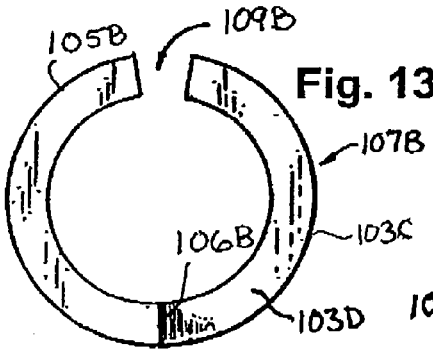
FIG. 13C is a plan view of a link element stamped from a sheet of material similar to that shown in FIG. 13, but with a non-textured elongated recessed portion of the sheet of material in place of the serrated portion shown in FIG. 13.

FIG. 13C is a plan view of a link element 107B stamped from a sheet of material similar to that shown in FIG. 13, but with the elongated textured portion 103 of the sheet of material 101 shown in FIG. 13C being replaced by a non-textured elongated recessed portion, resulting in arm 103C having a major surface 103D recessed relative to that of arm 105B, the transition to the recessed surface 103D indicated by step 106A. FIG. 13D is a side elevational view of the link element 107B shown in FIG. 13C, as viewed from the heel of the link element.

For the embodiment shown in FIGS. 13C and 1.3D, in which region 103D is not textured, a link element 107B can be produced, shown in FIG. 13C as having a standard thickness non-textured arm 105B and a thinner non-textured arm 103C. The end view of FIG. 13D shows a smooth or non-textured, channeled, or recessed, surface 103D which gives arm 103C a smaller link thickness than arm 105B.

Figure 13E:
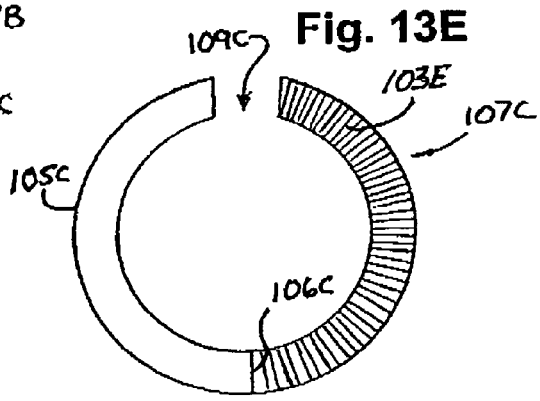
FIG. 13E is a plan view of one configuration for a link element die-cut and stamped, showing radially directed texturing formed during the stamping process.

Rather than forming linear parallel texture lines as shown in textured region 103, the texture lines may radiate from the center of the link element and be created by pressing during stamping, as shown at 103E in FIG. 13E. In FIG. 13E, link element 107C has two differently textured regions 103E and 105C. Again, any portion of link element 107C may be textured, and different link portions may have differing link thicknesses, as noted above.

Figure 13F:
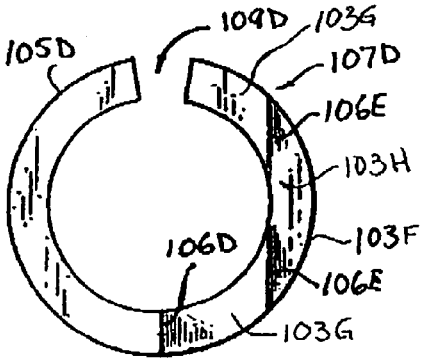
FIG. 13F is a plan view of a link element stamped from a sheet of material similar to that shown in FIG. 13, but with a non-textured elongated dual-recessed portion of the sheet of material in place of the serrated portion shown in FIG. 13.
Figure 13G:
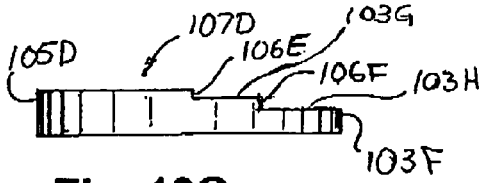
FIG. 13G is a side elevation of the link element shown in FIG. 13F, as viewed from the heel of the link element.

FIG. 13F is a plan view of a link element 107D stamped from a sheet of material similar to that shown in FIG. 13, but with the elongated textured portion 103 of the sheet of material 101 shown in FIG. 13C being replaced by a non-textured elongated dual-recessed portion, resulting in arm 103F having an upper major surface portion 103G recessed relative to that of arm 105B, and a lower major surface portion 106H, the transition to the recessed surface 103G indicated by step 106D, and the transition to the recessed surface 103H indicated by step 106E. FIG. 13G is a side elevational view of the link element 107D shown in FIG. 13F, as viewed from the heel of the link element.

For the embodiment shown in FIGS. 13F and 13G, in which regions 103G and 103H are not textured, a link element 107D can be produced, shown in FIG. 13F as having a standard thickness non-textured arm 105D and a thinner, non-textured, two-level arm 103F. The end view of FIG. 13G shows smooth (e.g., non-textured) channeled (e.g., recessed) surfaces 103G and 103H which give arm 103F an even smaller average link thickness than arm 103C of FIG. 13D, thereby saving even more precious metal (e.g., gold).

In analyzing FIGS. 13–13G, it will be understood that any portion of the resultant link element that is textured may be virtually of any size and location on the link element, depending upon where the dividing line is located (in FIG. 13, between textured and non-textured regions 103,105), in addition to the relative rotational angle of the die (not shown) to the sheet of material 101 being processed (cf. FIGS. 3 and 5). Moreover, even for partially textured link element regions, the textured region may have a larger, or smaller, link width than the non-textured region. For example, providing a sheet of material similar to sheet 101, but with the region 103 being of a smaller link thickness than region 105, when serrated (or otherwise textured), the textured thinner region gives the visual illusion of being thicker. Thus, a rope chain can be produced in which a significant savings in precious metal can be realized while enhancing the aesthetic qualities and apparent value of the chain.

With the gaps 109 and 109A–D at the twelve o'clock position, as shown, a length of rope chain constructed of link elements 107 or 107A–D would display one helix with a textured major surface and the other helix with no texturing; or one helix with a textured major surface different than the textured major surface of the other helix; or one helix with thicker link arms than the other helix.

Figure 14:
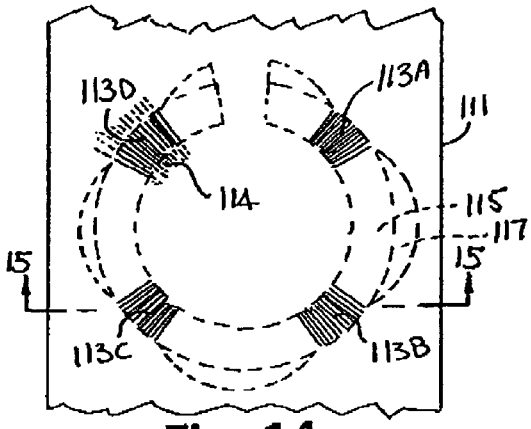
FIG. 14 is a plan view of a sheet of material in which a preparatory step of imprinting surface texturing has taken place, prior to die-cutting out a link element from the material.

FIG. 14 is a plan view of a sheet of material 111 in which a link element 115 or 117 can be die-cut from the sheet of material 111 and display radially directed texture patterns 113A–113D as shown. FIG. 14 also shows that the pattern of the cutting edges in the die-cutting process can produce an annular shaped link element 115 or a link element 117 having features departing from the standard annular configuration. In a preferred embodiment of the invention, either link element 115 or 117 may be die-cut simultaneously with the stamping of the upper planar surface of the sheet of material 111 forming the radially directed impressed lined patterns 113A–113D. Alternatively, a lined pattern such as that shown in dashed lines as numeral 114 may be formed on the sheet of material in a preparatory step of imprinting the surface texturing at specific locations, after which the die-cutting process will cut the link element 115 or 117 from the sheet 111. The textured pattern 114 intentionally extends a length greater than the annular radius of the link elements 115, 117 to allow for tolerance in the registration of the pressure stamping process which impresses the texture pattern and the die-cutting process which severs the link element 115, 117 from the sheet of material 111.

Although FIG. 14 shows a particular pattern for a number of radially directed stamped, or impressed, lines, the illustration in FIG. 14 is exemplary only, and any pattern of surface texturing can be applied along a portion or the entire extent of the link element 115, 117 to be die-cut from the sheet 111, depending upon the choice of the designer.

Figure 15:
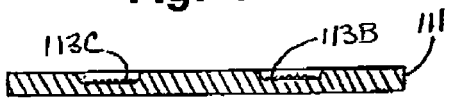
FIG. 15 is a cross sectional view of the sheet of material taken along the line 15—15 in FIG. 14, and showing two possible die-cut patterns for stamping out a link element.

FIG. 15 is a cross sectional view of the sheet of material 111 taken along the lines 15—15 in FIG. 14. This figure shows the character of the impressed textured areas 113A–113D relative to the thickness of the sheet of material of 111.

Figure 16:
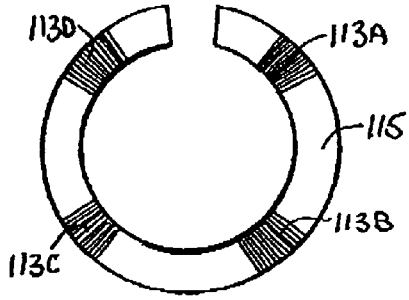
FIG. 16 is a plan view of one configuration for a link element die-cut, or stamped, from the material shown in FIG. 14.

FIG. 16 illustrates the plan view of a link element 115 die-cut from a sheet 111 shown in FIG. 14 for an annular configuration of the link element.

Figure 17:
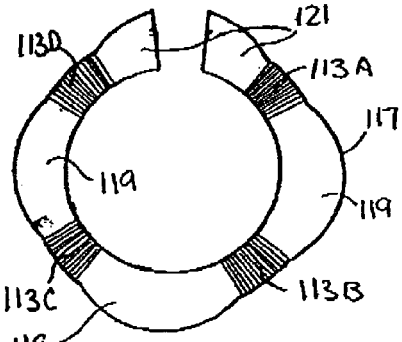
FIG. 17 is a plan view of another configuration for a link element die-cut, or stamped, from the material shown in FIG. 14, exhibiting a bulging effect to the segments of the link element that extend between the imprinted surface texturing.

FIG. 17 illustrates the plan view of a link element 117 die-cut from a sheet 111 shown in FIG. 14 for an alternate configuration of the link element, with bulging portions 119 of the link element 117 extending between the imprinted surface textured areas 113A–113D, for decorative purposes.

Figure 18:
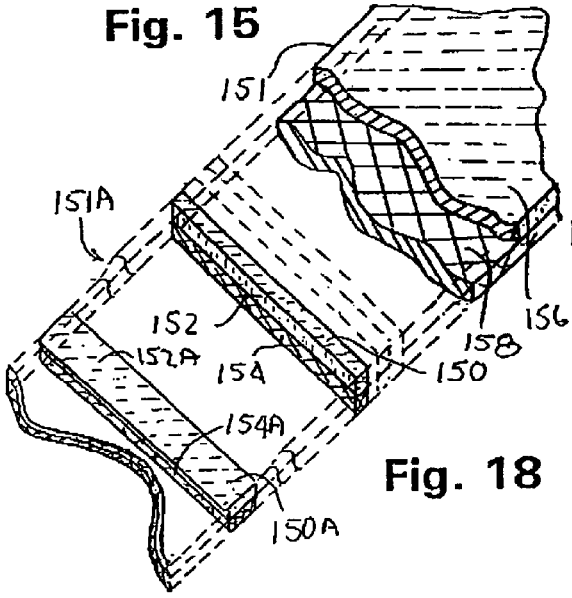
FIG. 18 is a perspective view of a laminated sheet of material from which slices can be cut and eventually formed into a link element similar to that shown in FIG. 49 or 49A.

FIG. 18 is a perspective view of a laminated sheet of material 151 comprised of, for example, a layer of white gold 156 and a layer of yellow gold 158 (or both layers 156,158 can be of. yellow gold of different gold karat weights). In a stamping, or die-cutting, process, slices 150 can be cut from the sheet of layered material 151 and eventually formed into a link element by a bending or rolling process to be described hereinafter with reference to the forming method depicted in the action perspective view of FIG. 30, and with reference to the layered link element shown in FIGS. 49 and 49A. A length of rope chain constructed from a group of assembled link elements as shown in FIG. 49, would thus have the general appearance of a rope chain having essentially the color of the outer layer on the link element so formed.

Figure 49:
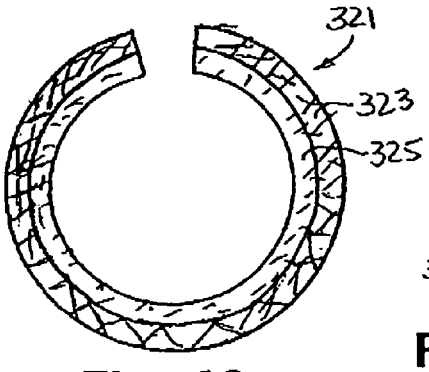
FIG. 49 is a plan view of a link element formed by bending a layered slice from a sheet of layered material, such that the major surfaces exhibit multiple colors, textures, materials, or karat weights, and the inner and outer edges exhibit a single color, texture, material, or karat weight.
Figure 49A:
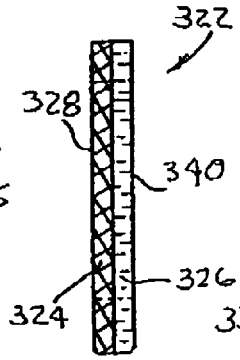
FIG. 49A is an edge side view of a link element formed by bending a layered slice from a sheet of layered material such that each major surface exhibits a single color, texture, material, or karat weight, and the inner and outer edges exhibit multiple colors, textures, materials, or karat weights.

While FIGS. 18, 49, and 49A depict one color representing yellow gold and the other color representing white gold or silver, it may be desirable to laminate together two yellow gold layers of different gold karat weight. If the two layers 156, 158 are both yellow gold of different karat weights, 7K and 14K for example, and the link element is formed with a 14K outer layer, the visual impression of a finished rope chain will be essentially that of a 14K gold rope chain, giving a purchaser the desired visual quality at lower cost.

In this connection, FIGS. 18–31 are all concerned with the forming or shaping of a strip of material into the configuration of a link element after the strip has been sliced, e.g. die-cut, from a sheet of material. FIG. 18, as noted above, may be sliced and bent into annular shape to produce the layered link element shown in FIG. 49. In FIG. 49, the major surfaces exhibit multiple colors, textures, materials, or karat weights 323, 325, and the inner and outer edges each exhibit a single color, texture, material, or karat weight 323, 325, while in FIG. 49A each major surface 328, 340 exhibits a single color, texture, material, or karat weight, and the inner and outer edges (inner edge not visible in FIG. 49A) exhibit multiple colors, textures, materials, or karat weights.

It should be noted that, depending upon the choice of material thicknesses and width of the slices 150 and 150A, the slices 150 and 150A can be bent in any of four different directions to produce a major surface with either material 152A or 154A and the other major surface with the other material (or both yellow of different gold karat weights, cf. FIG. 6 of the aforementioned U.S. application Ser. No. 09/287,972), or to produce a major surface having the interior edge of one material 152 and the exterior edge of the other material 154, or vice versa (cf. FIG. 49). FIG. 18 is illustrative of two thicknesses of laminated materials 156 and 158 on either side of a transition region 151A permitting construction of link elements of the types just described.

FIGS. 19–31 are specifically directed to the formation of textured surfaces on the major surfaces of the ultimate link element and/or on the peripheral edges of the ultimate link element. Both major surface texturing and edge surface texturing will be dealt with in the ensuing paragraphs.

Figures 19, 20, 21, 22, 23, 24, 25, 26, 27:
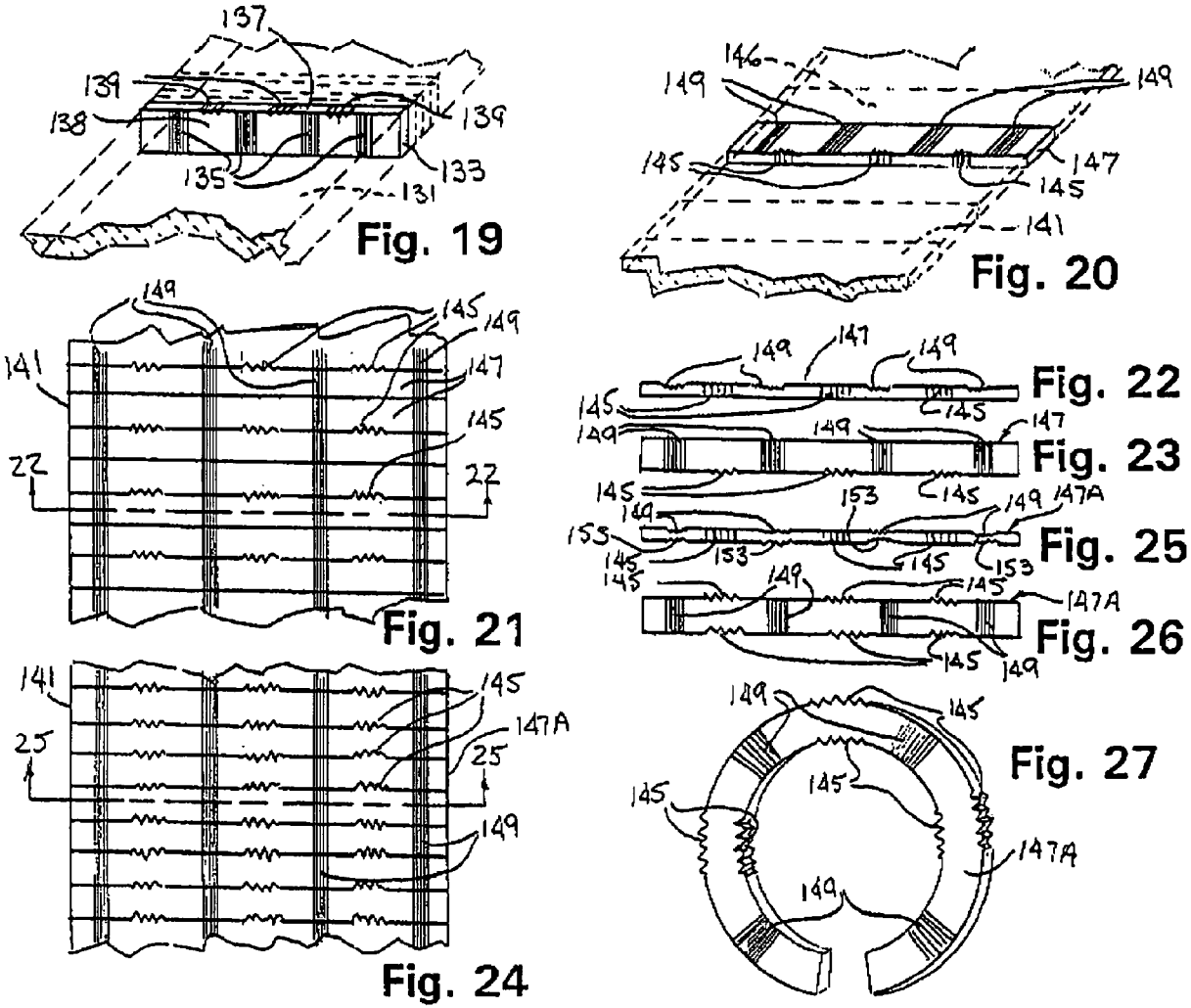
FIG. 19 is a perspective view of a slice from a relatively thick sheet of material that can be bent, or rolled, to form a link element which has texturing on its major and/or edge surfaces.
FIG. 20 is a perspective view of a slice from a relatively thin sheet of material that can be bent, or rolled, to form a link element which has texturing on its major and/or edge surfaces.
FIG. 21 is a plan view of a length of sheet material from which slices can be taken and formed into a link element having surface texturing on one major surface and one peripheral edge thereof.
FIG. 22 is a side elevational view of the slice of material shown in FIG. 20 and taken along the line 22—22 in FIG. 21.
FIG. 23 is a top plan view of the slice of material shown in FIG. 22.
FIG. 24 is a plan view of a length of sheet material from which slices can be taken and formed into a link element with surface texturing on both major surfaces and both interior and exterior edge surfaces thereof.
FIG. 25 is a side elevational view of a slice of material similar to that shown in FIG. 20, but taken along the line 25—25 in FIG. 24.
FIG. 26 is a top plan view of a link element shown in FIG. 25.
FIG. 27 is a perspective view of a link element formed from the slice of material shown in FIGS. 25 and 26.

FIG. 19, like FIG. 18, shows a sheet of material 131 from which strips 133 may be sliced, the strips 133 having the precise dimensions of width, thickness, and length so as to meet the specifications and requirements for interlinking link elements formed therefrom with other similar link elements to form a rope chain. In FIG. 19, the sheet of material 131 is not shown to be layered, but it may be layered, if desired. However, whether layered or not, the strips 133 are stamped and/or die-cut from the sheet of material 131 with the die-cutting device having spaced apart zig-zag cutting edge portions to form the vertical textured surfaces 135 shown in FIG. 19. Additionally, as the die-cutting tool (not shown) slices through the sheet of material 131, the tooling simultaneously impresses a secondary series of textured surfaces 139 on the top surface of the sheet of material 131. If the strip 133 shown in FIG. 19 has its ends bent downwardly about a mandrel, a link element similar to that shown in FIG. 27, except for the textured interior edge, would result. Specifically, the link element shown in FIG. 27 results from a slightly different process as will now be described.

From the description of FIG. 19, it will be appreciated that the sheet of material 131 has a thickness greater than the width of the slice 133, so that the link element formed by bringing the ends of the strip 133 downwardly around a mandrel will produce a link element of the proper physical dimensions for the construction of a rope chain.

Employing the method suggested by FIG. 19, if desired, the top surface of the sheet of material 131 may be preconditioned to have a smooth, highly polished, light reflective surface. This could be effected by a lapping process End/or by coating the top surface of material 131 with a highly reflective substance such as rhodium. When the strip 133 has its ends bent downwardly about a mandrel, the highly reflective surface will be at the exterior edge of the formed link element. It will be noted that such highly reflective exterior edge may also include the textured segments 139, i.e., in accordance with one aspect of the invention, the smooth, highly light reflective exterior side surface need not be continuous, but may have alternating smooth and textured surface segments.

An alternate, and preferred, method is to provide a thinner sheet of material 141 such as that shown in FIG. 20 and die-cutting strips 147 of wider dimension, as shown. This method has two advantages. First, it is easier to die-cut a strip from a thin material than it is from a thicker material. Secondly, since a link element formed by bending the strip 147 requires the ends of the strip 147 as shown in FIG. 20 to be bent toward the observer about a mandrel, this permits the stamping/die-cutting procedure to form zig-zag edge patterns 145 on both the front and rear edges of the strip 147. This process will be described in connection with FIGS. 24–27.

FIG. 21 is a top plan view of the sheet of material 141 showing four groups of lined patterns 149 representing any desired texturing design formed on a sheet of material 141 prior to the slicing of the sheet of material 141 into strips to be formed into link elements. The die-cutting tool, in order to produce the strip 147 necessarily has three spaced zig-zag patterns on its front edge to form the zig-zag textured surface 145 on the strip 147 so produced. With every other slice line formed by the die-cutting tool being non zig-zagged, the textured pattern 145 is formed on only one peripheral edge of two adjacent strips 147 simultaneously.

FIG. 22 is a side elevational view of the slice of material 147 shown in FIGS. 20 and 21, better illustrating the positioning of the major surface texturing 149 and the peripheral edge texturing 145 prior to the strip 147 being formed into a link element.

FIG. 23 is a top plan view of the slice of material 147 shown in FIG. 22.

FIG. 24 is a view similar to that of FIG. 21 except that both peripheral edges of all strips 147A have the peripheral edge texturing pattern 145. Moreover, it is to be understood that the bottom surface of the sheet of material 141 in FIG. 24 has the identical texturing pattern 149 as shown on the top surface of the sheet. Accordingly, FIG. 25 shows surface texturing 149 on the top major surface of the strip 147A, while the numeral 153 represents the spaced texturing design patterns on the bottom surface of the strip 147A.

As best seen in FIG. 26, as described in connection with FIG. 24, the zig-zag textured portions 145 on the peripheral edges of the strip 147A are on both peripheral edges.

FIG. 27 thus is a perspective view of a link element formed from the slice of material 147A shown in FIGS. 25 and 26.

Figure 28:
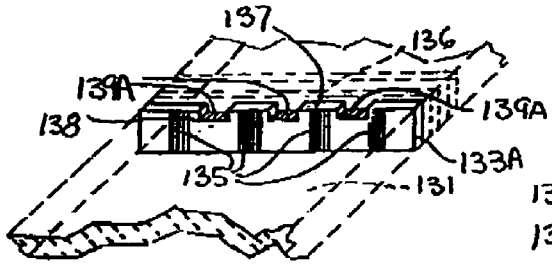
FIG. 28 is a perspective view similar to that of FIG. 19, but with deep cut and textured, elongated, and linear recesses formed in the sheet of material from which a slice is to be taken.

FIG. 28 is a perspective view similar to that shown in FIG. 19, but with deep cut notches forming textured recesses 139A formed in the sheet of material prior to slicing the sheet 131 to form strips 133A.

Figure 29:
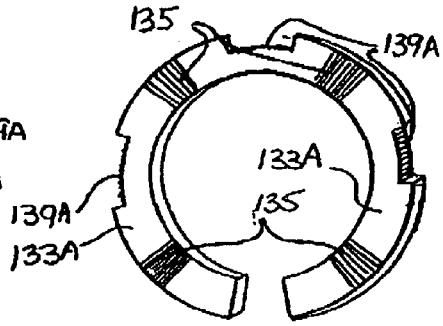
FIG. 29 is a perspective view of a link element made from the slice of material shown in FIG. 28.

Employing the process of forming a strip 133A suggested by FIG. 28, a link element having the characteristics shown in FIG. 29 results.

It will be understood that, for ease of drawing and description, the textured patterns shown in FIGS. 10–17 and 19–29 are shown as a group of parallel lines for ease of presentation only. The stamping and/or die-cutting tool may just as easily be manufactured to have any desired surface texturing or pattern at the whim of the designer. Each of the areas shown to be lined patterns may simply be regions of simulated sand blasting, matting, serration, knurling, or may be some design having geometrical figures as its content, or other design patterns, such as happy faces, heart shapes, flower petals, leaf patterns, and the like.

Figure 30:
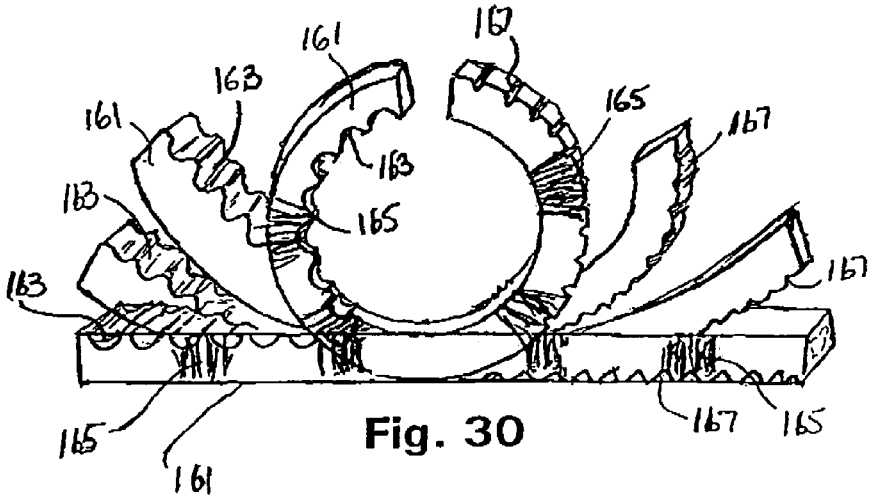
FIG. 30 is an action perspective view showing four time positions of a slice of material, illustrating the bending positions of a straight textured and shaped slice into the configuration of a link element.

FIG. 30 is an action perspective view showing four time positions of a slice of material 161 or a prepared strip, illustrating the bending of a straight textured and shaped slice into the configuration of a link element.

As can be seen in FIG. 30, a rather scalloped design of impressions 163 may be formed on any portion of a strip of material 161 which, after forming of the link element, produces a notched interior edge 163. Similarly, the right bottom side of the strip 161 may have V-grooves 167 formed therein so that the formed link will have the V-grooves 167 on its outer peripheral edge. Using any of the process steps mentioned above, the sides of the strip 161 may be provided with a pattern of textured regions 165 which then show as textured regions on the major surface or surfaces of the ultimately produced link element.

Although it has been adequately described earlier in this specification, the notches 163, V-grooves 167, and side serrations or textured patterns 165 of the link element shown in FIG. 30 all contribute to removing precious metal from the otherwise solid annular ring-shaped link element. As a result, not only is precious metal conserved without diminishing the structural integrity of the link element, but interesting patterns of the rope chain from which the link elements are made can be produced as described herein. The link element produced by the process described in connection with FIGS. 28 and 29, for example, result in a significant savings in precious metal content.

Figure 31:
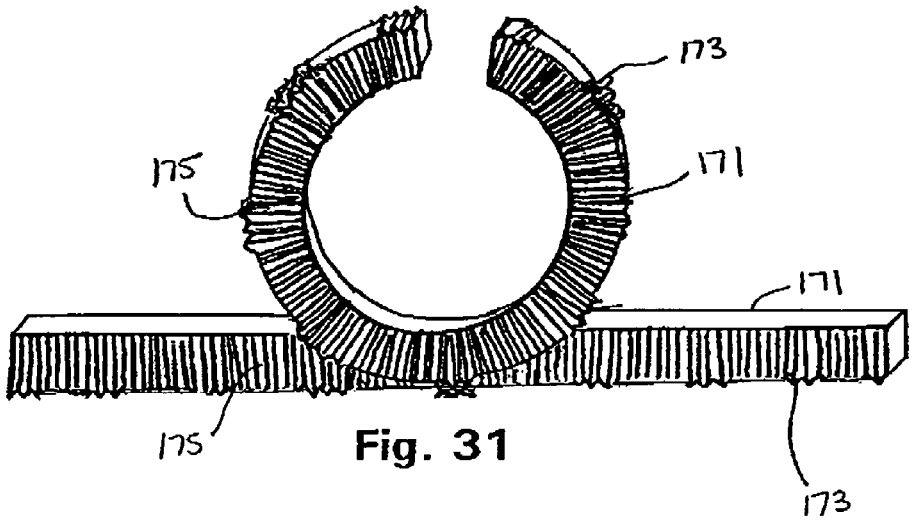
FIG. 31 is a view similar to that shown in FIG. 36, but without showing intermediated bending positions, and with a different pattern of surface texturing.

FIG. 31 is a view similar to that shown in FIG. 30, but without showing intermediate bending positions, and with a different pattern of surface texturing, i.e. serrations 175 formed on the major surface of the strip of material/link element 171, and additional serrations 173 alternately formed on the exterior peripheral edge between segments of smooth, flat, highly light reflective segments. FIG. 31 thus shows the manufacture on an annular link 171 exhibiting serration-like characteristics from a strip 171 first formed with such serration-like characteristics.

Figure 32:
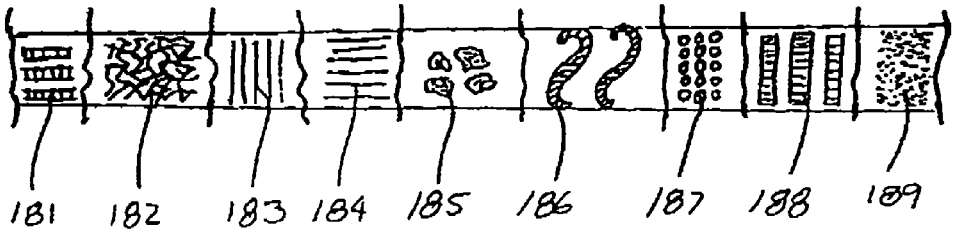
FIG. 32 shows examples of different surface texturing that may be selected to cover portions or the entire major or edge surfaces of a link element made in accordance with the present invention.

FIGS. 30 and 31 are exemplary only. The strip may be formed with a variety of different visual properties as illustrated in FIG. 32 which schematically shows examples of different surface texturing or patterning 181–189 that may be selected to cover portions or the entire major or edge surfaces of a link element made in accordance with the present invention. FIG. 32 illustrates that the surface texturing or patterning may include parallel serrated strips 181, random raised lineation 182, cross-serrations 183, lineal serrations 184, raised portions 185, filigreed elements 186, either raised beads or depressed beads 187, parallel serrated strips 188 in a direction different that of 181, and sandblasted texturing 189. Such texturing or patterning may alternate with smooth, flat, highly light reflective segments, or may be superimposed on a normally smooth, flat, highly light reflective exterior edge. Again, these features are presented for the purpose of illustration only, as there are an endless number of visual properties that can be imparted to the major or edge surfaces of a strip prior to fabricating the link element.

Furthermore, the strip of material 161, although shown to be solid in FIG. 30, may be a length of hollow tubular material subjected to the same processing and having all of the features and properties as described above in respect of FIGS. 30–32.

FIGS. 33–59 illustrate examples of link elements that can be formed to exhibit different visual properties. Some of these are for decorative purposes only while others provide for savings in the amount of materials used to make rope chains. Some provide both benefits.

Figure 33:
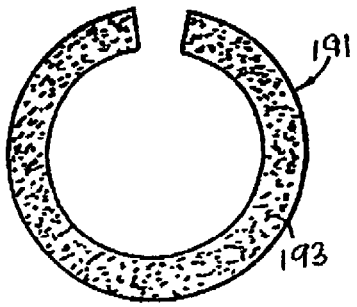
FIG. 33 is a plan view of a link element of standard annular configuration and displaying examples of major surface texturing.

FIG. 33 shows an annular link element 191 having the entirety of one of its major surfaces 193 textured, simulating a sandblasted surface. This is made possible by fabricating the stamper tooling device with a sandblasted inner surface. When the link element is die cut from a sheet of material, the pressure of the stamper simultaneously creates the simulated sandblasted effect on the major surface which the stamper contacts.

Figure 34:
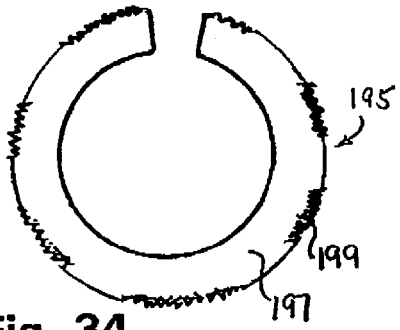
FIG. 34 is a plan view of a link element in which the exterior edge is serrated.

FIG. 34 shows an annular link element 195 having a smooth major surface 197, and with the exterior edge 199 alternately serrated and left smooth and flat. This is made possible by providing the stamper tooling device with a patterned serrated cutting edge.

Figure 35:
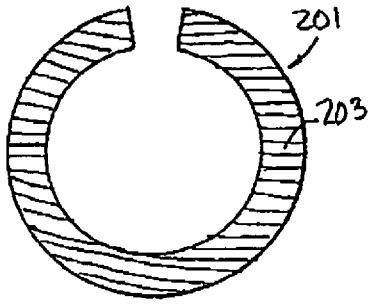
FIGS. 35–37, 38, 38A–38C, and 39 are plan views of link elements each of a standard annular size and configuration and displaying different preferred color and/or texture patterns on a major surface thereof.

FIG. 35 shows an annular link element 201 having the entirety of one of its major surfaces 203 serrated. This is made possible by fabricating the stamper tooling device with a serrated inner surface, or, preferably, creating serrations along the entire length and width of the sheet of material from which the link element 201 will be cut.

Figure 36:
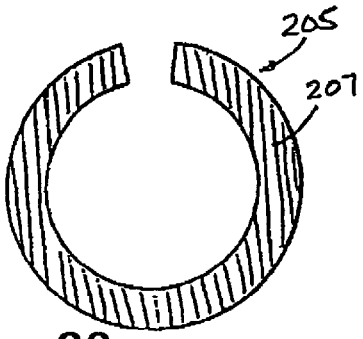

FIG. 36 is similar to that of FIG. 35 but with the stamper rotated 90 degrees with respect to the sheet of material.

Figure 37:
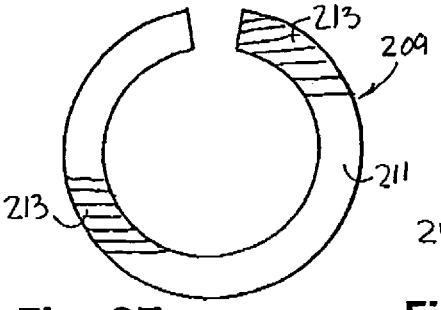

FIG. 37 shows an annular link element 209 having segments 213 of the major surface 211 serrated. This is made possible by fabricating the stamper tooling device with a serrated inner surface having the same pattern in reverse. If a pre-textured sheet of material is to be provided, it could not have continuous serrations, similar to the situation described in connection with FIG. 14.

Figure 38:
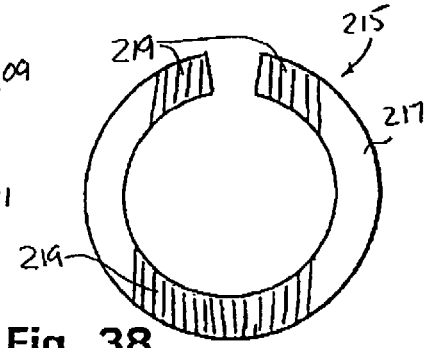

FIG. 38 shows an annular link element 215 having segments 219 of the major surface 217 serrated. This also is made possible by fabricating the stamper tooling device with a serrated inner surface having the same pattern in reverse. Preferably, however, a pre-textured sheet of material will be provided having an elongated center region of continuous serrations, and the stamper is simply oriented with the gap position aligned with the extent of the serrations.

Alternatively, radially directed texturing, e.g. radial serrations, may be formed in the major surfaces of a link element, created by pressing during the stamping operation. To enhance the beauty of such a link element, the pressed serrations may be formed on a region of the sheet of material, from which the link element is stamped, which is of a different material or color than the non-serrated region.

Figure 38A:
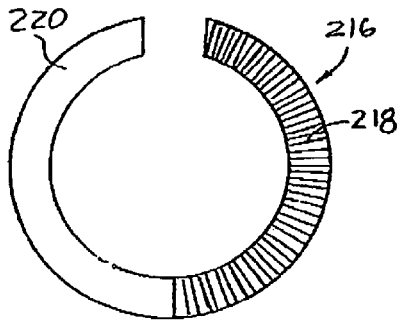
Figure 38B:
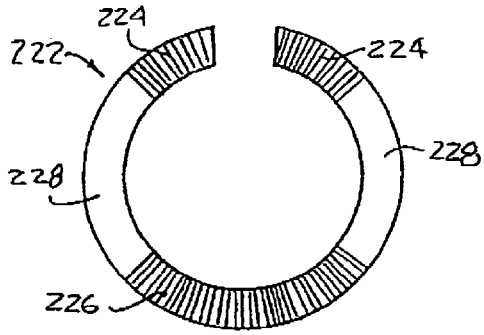
Figure 38C:
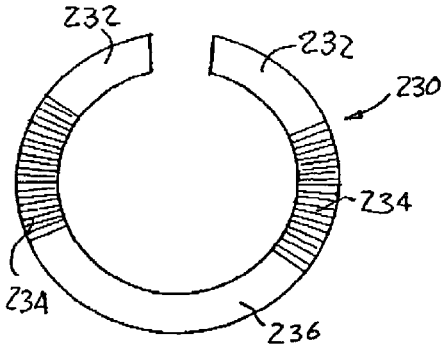

FIGS. 38A–C show variations on the location of the serrated portions of the stamped link elements 216,222,230. The textured regions 218,224,226,234, for example may exhibit radially directed serrations in link element portions of white gold, while the non-serrated portions 220,228,232, 236 may be non-textured or differently textured and of yellow gold.

Figure 39:
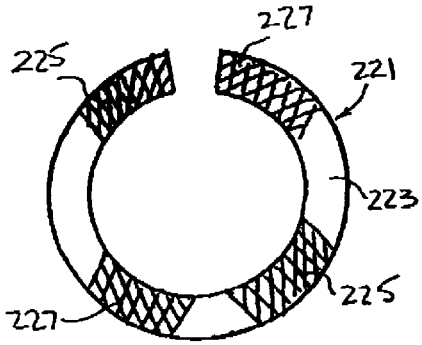

FIG. 39 shows an annular link element 221 having segments 225,227 of the major surface 223 provided with a knurled effect. This is made possible by fabricating the stamper tooling device with a knurled inner surface having the same pattern in reverse. If a pre-textured sheet of material is to be provided, it could not have a continuous knurled pattern, similar to the situation described in connection with FIG. 14.

Figure 40:
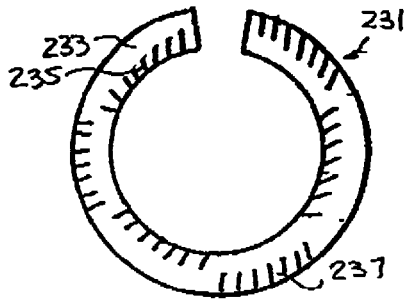
FIG. 40 is a plan view of a link element showing a major surface with alternating and spaced lines adjacent the interior and exterior edges, the lines being in the form of short linear depressions formed during the stamping process.

FIG. 40 shows an annular link element 231 having segments 235,237 of the major surface 233 lined, simulating scoring of the major surface 233. This is made possible by fabricating the stamper tooling device with a lined pattern on its inner surface of similar, but reversed, design.

Figure 41:
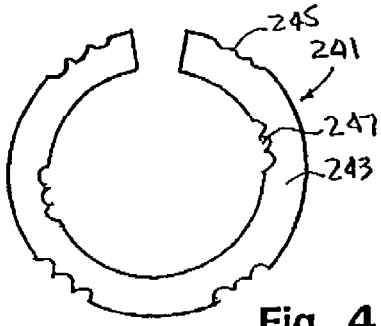
FIG. 41 is a plan view of a link element showing cutout patterns along the interior and exterior peripheral edges, formed during the stamping process.

FIG. 41 shows an annular link element 241 having segments 245,247 of the major surface 243 notched. This is made possible by fabricating the stamper tooling device with a complementary notched cutting edge.

Figure 42:
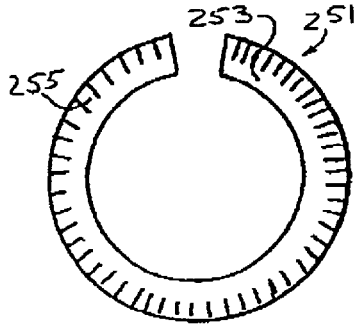
FIG. 42 is a plan view of a link element showing a major facial surface with evenly distributed lines adjacent the exterior edge, formed during the stamping process.

FIG. 42 shows an annular link element 251 having the outer extent of the major surface 253 provided with lining 255 simulating scoring of the major surface 253. This is made possible by fabricating the stamper tooling device with a lined inner surface having the same pattern in reverse.

Figure 43:
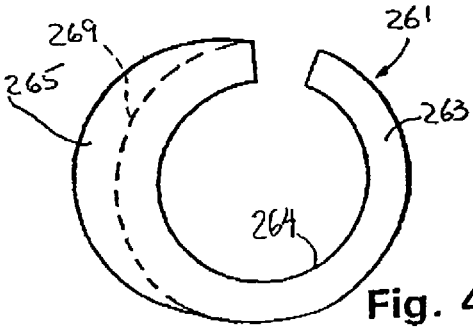
FIG. 43 is a plan view of a link element showing a configuration departing from the standard annular configuration depicting one arm of the link element increasing in link width at its center and formed by stamping.

FIG. 43 shows a stamped link element 261 with a lobbed side 265. The dotted line 269 is the outline of a side that the link element would take if it were annular, like the other side 263, and is provided for comparison purposes only. Employing a number of link elements 261 in a rope chain, and with proper arrangement, produces one of the helixes having a larger effective diameter than the other helix.

Figure 44:
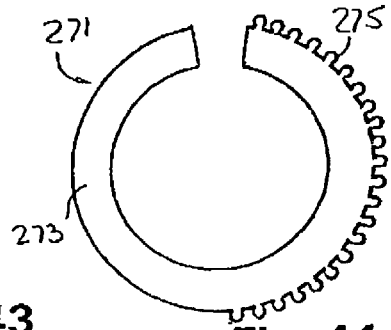
FIG. 44 is a plan view of a link element showing a configuration departing from the standard annular configuration, one arm with beads formed along the exterior edge thereof, all formed during the stamping process.

FIG. 44 shows an annular link element 271 having a smooth major surface 273, and with one half the exterior edge 275 beaded. This is made possible by providing the stamper tooling device with a beaded pattern along one half of its cutting edge.

Figure 45:
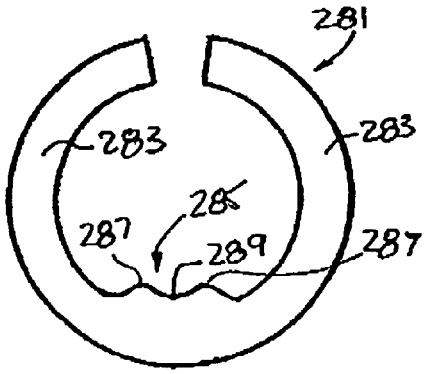
FIGS. 45–48 are a plan views of link elements each having a configuration departing from the standard annular configuration and formed by stamping.

FIG. 45 is a plan view of a link element 281 similar to that shown in FIG. 1, but with a double bumped protruding projection 285 on the interior edge thereof opposite the position of the gap in the link element 281 between the two halves 283. The two projecting bumps 287 define a depression 289. The link width of the arms of the two halves 283 is preferably narrower than standard. If the entire annular link element 281 had a less-than-standard width, the finished rope chain would be very loosely interconnected and unattractive. The purpose of the double bumped projection 285 is to simulate, during the assembly process, a link element of appropriate, i.e. standard, annular width at depression 285. Since the looseness or tightness of the finished rope chain product is dependent, among other factors, upon the width of the link at the location opposite the gap, employing the reduced material design for the link element 281 as shown will result in a perfectly formed rope chain with tightly interconnected link elements having the same flexibility as if the link elements were each made with a standard annular width in its entirety. This arrangement thus reduces material by a reduced annular width and by using fewer link elements per unit length of rope chain, making the chain to appear longer than the standard rope chain.

The purpose for the two spaced bumps 287 is to affect the appearance of the channels between rope strands of a finished rope chain. Due to the spaced bumps, the rope chain will display more precious metal (e.g., gold) in the channels between strands of the finished rope chain. As to construction concerns, the interior edge of a like adjacent link element 281 will fit perfectly within the depression 289, and the rope chain will have high structural integrity due to the width of the link element 281 between the exterior edge and the depression 289 being of standard dimension.

If desired, the arms 283 of link element 281 may be of standard width, and the edge projection 285 will then be of greater than standard width. In such a case, the gap will necessarily have to be widened to accommodate the projection 285 of an interconnected link since such projection passes through the open gap at an angle so as to have the major surfaces of adjacent link elements in surface contact. One advantage of this variation is that fewer link elements are necessary per unit length of rope chain.

Figure 46:
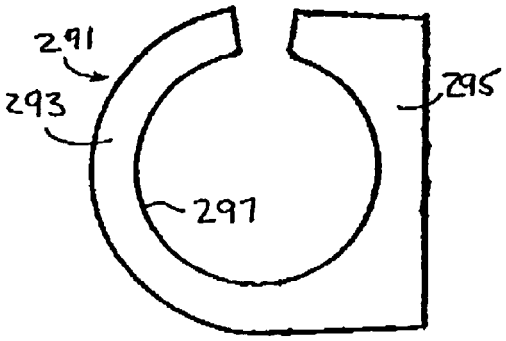

FIG. 46 shows a stamped annular link element 291 having a standard width annular shaped side arm 293 and a rectangular side arm 295. The overall configuration is D-shaped with a circular interior edge 297.

Figure 47:
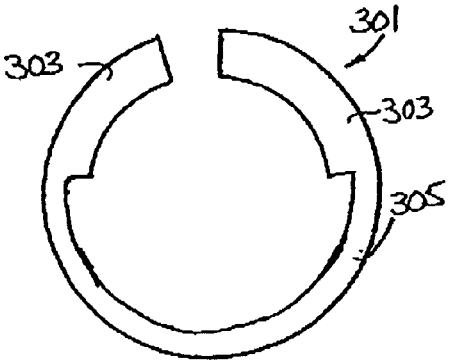

FIG. 47 shows a stamped annular link element 301 having a standard width annular shaped top half 303 and a less than standard annular width lower half 305.

Figure 48:
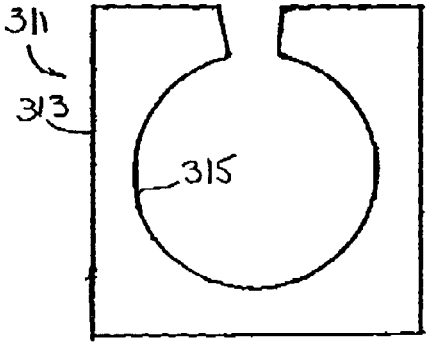

FIG. 48 shows a stamped annular link element 311 having a rectangular exterior edge 313 and a circular interior edge 315.

FIG. 49 shows a layered link element 321 having a yellow gold outer layer 323 and a white gold inner layer 325, the link element 321 being fabricated employing the method described in connection with FIG. 18 and 30.

As with the embodiment of the multilayered sheet of material shown in FIG. 18, if desired, rather than two different materials or distinctly differently colored materials being laminated together, the inner layer 325 of link element 321 may be made of a yellow gold of relatively low gold karat weight, e.g. 7 karat gold, while the outer layer 323 may be made of a relatively high gold karat weight, e.g. 14 karat gold. In this manner, the visual impression of a finished rope chain will be essentially that of a 14K gold rope chain, giving a purchaser the desired visual quality at lower cost.

Figure 50:
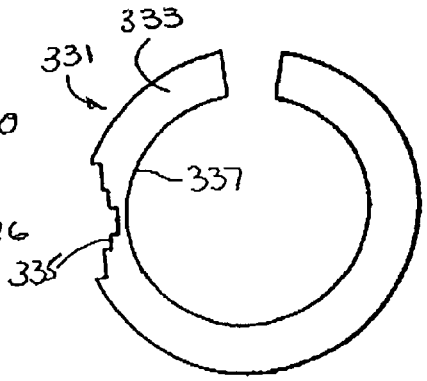
FIG. 50 is a plan view of a link element having a smooth interior edge and a stepped cutout on the exterior edge of one arm.

FIG. 49A shows a layered link element 322 formed of two layers 324 and 326 and having a yellow gold major surface 328 and a white gold major surface 340, the link element 322 being fabricated employing the method described in connection with FIG. 18 and 30. In FIG. 49A, each major surface 328, 340 exhibits a single color, texture, material, or karat weight, and the inner and outer edges (inner edge not visible in FIG. 49A) exhibit multiple colors, textures, materials, or karat weights;

FIG. 50 is a plan view of a link element 331 having an arcuate, but stepped, concave cutout 335 on one of its arms. This may create an interesting multi-faceted helix along one of the intertwining rope strands, which is especially attractive, especially when the flat stepped surfaces are rhodium coated. A multi-faceted helix on one of the intertwining rope strands is made possible by reversing every other link element in the assembly procedure. However if both sides of link element 331 are symmetrically concave and stepped as shown, a helical groove can be seen on top of each simulated helical rope strand without having to reverse every other link element.

Figure 51:
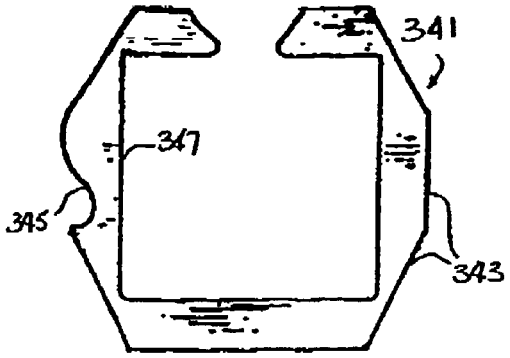
FIGS. 51–59 are plan views of link elements each having a shaped configuration departing from the standard annular configuration and formed by stamping, FIGS. 53, 55, and 56 showing all or a portion of the link element as a series of adjacently connected geometric or fanciful design shapes.

FIG. 51 shows a stamped annular link element 341 having a polygonal exterior edge 343, a square interior edge 347, and a fanciful cutout design 345 on one side arm.

Figure 52:
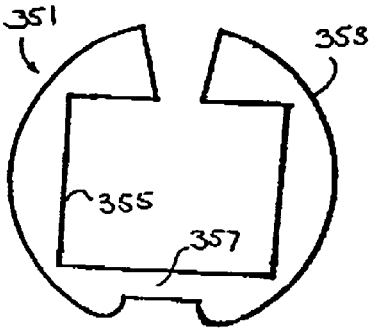

FIG. 52 shows a stamped annular link element 351 having a circular exterior edge 353, a square interior edge 355, and a cutout region 357 opposite the location of the gap in the link element 351.

Figure 53:
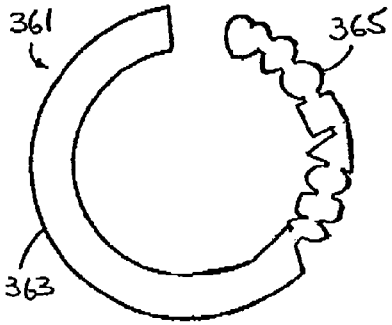

FIG. 53 shows a stamped annular link element 361 having a standard width annular side arm 363 and a series of symbols cut out on the other side arm 365. The symbols may be of any desired design and need be connected only with enough precious metal for strength and durability, so as not to obscure the nature of the design of the symbols. This is another example of significant savings in precious metal with the synergistic effect of enhancing the decorative value of the piece of jewelry so designed and constructed.

Figure 54:
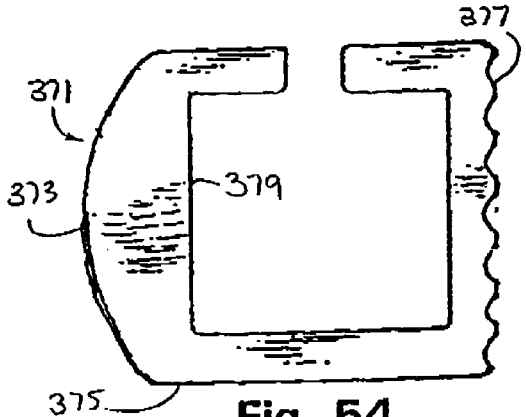

FIG. 54 shows a stamped annular link element 371 having a generally D-shaped exterior edge 373, a square interior edge 379, and an undulated exterior edge 377 on one of its side arms.

Figure 55:
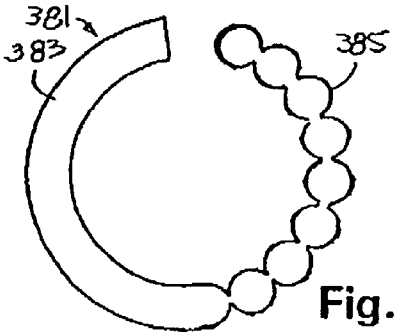

FIG. 55 shows a stamped annular link element 381 having a standard width annular side arm 383 and a series of circular symbols cut out on the other side arm 385.

Figure 56:
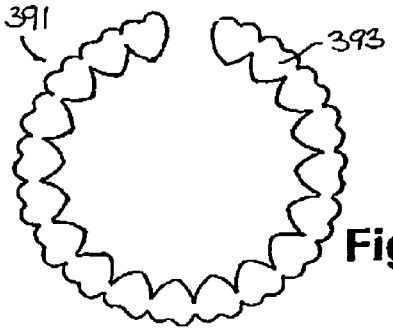

FIG. 56 shows a stamped annular link element 391 having an average standard annular width but with the entire extent of the link element 391 formed with an interconnected series of heart symbols 393.

Figure 57:
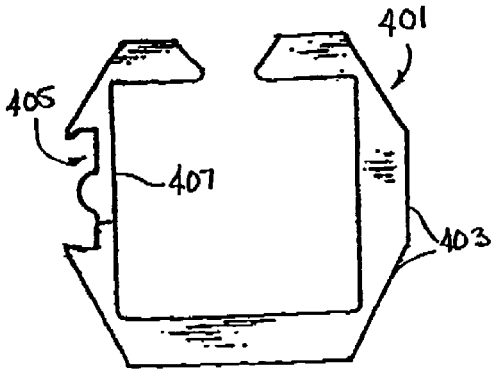

FIG. 57 shows a stamped annular link element 401 having a polygonal exterior edge 403, a square interior edge 407, and a fanciful cutout design 405 on one side arm.

Figure 58:
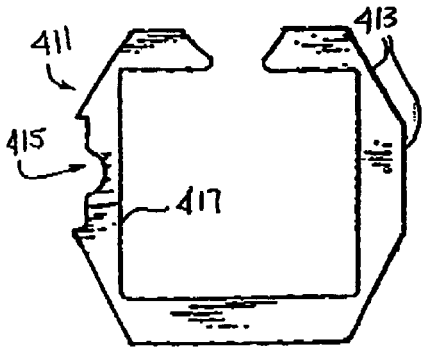

FIG. 58 shows a stamped annular link element 411 having a polygonal exterior edge 413, a square interior edge 417, and a fanciful cutout design 415 on one side arm.

Figure 59:
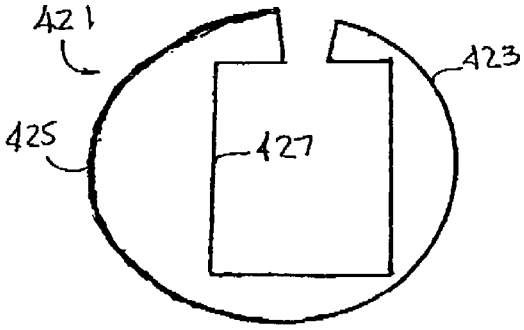

FIG. 59 shows a stamped annular link element 421 having an egg shaped exterior edge with a circular portion 423 and an oval portion 425, and a square interior edge 427.

Figure 60:
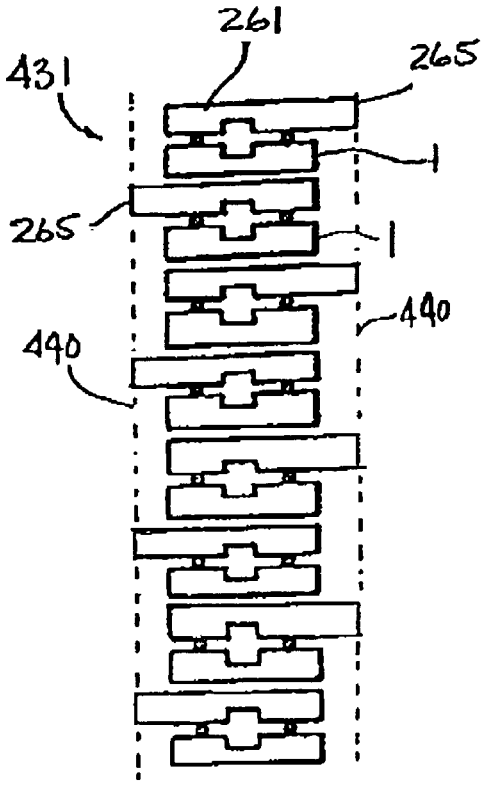
FIG. 60 is a schematic representation showing the assembly sequence of link elements forming a length of rope chain, employing link elements of standard, or substandard, annular widths alternating with link elements having a portion relatively enlarged in annular width such as that shown in FIG. 43.

FIG. 60 represents, schematically, an example of assembling a rope chain 431 by alternating link elements 261 (FIG. 43) having lobed sides 265 with conventionally shaped annular link elements 1 (FIG. 1). The lobed side 265 of the sequence of link elements 261 are placed alternately opposite one another, thereby producing a length of rope chain having the appearance of a larger overall diameter as indicated by dashed lines 440, while using a significantly smaller amount of material and thus being less costly to manufacture than a rope chain constructed of link elements of a constant large diameter.

Figure 61:
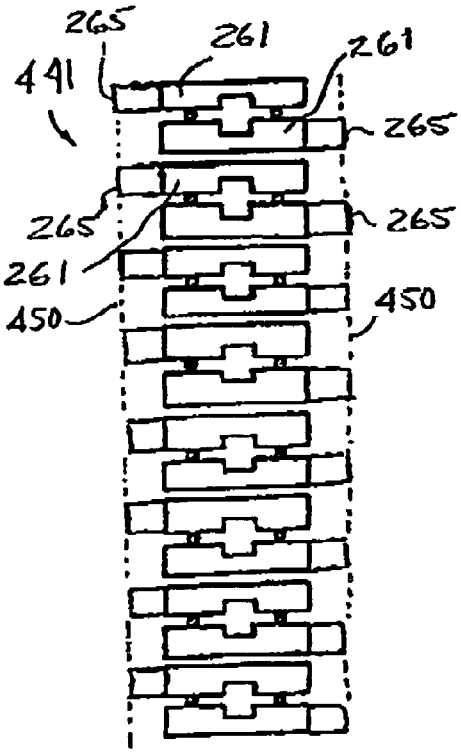
FIG. 61 is a schematic representation showing the assembly sequence of link elements forming a length of rope chain, employing link elements each having a portion relatively enlarged in annular width such as that shown in FIG. 43.

FIG. 61 is a schematic representation of an arrangement for a rope chain 441, whereby only link elements 261 with lobed sides 265 are used with consecutive link elements 261 placed such that the lobed sides 265 alternate in opposite orientation, thereby producing a length of rope chain having the appearance of a larger overall diameter as indicated by dashed lines 450, again resulting in a savings of material.

Figure 62:
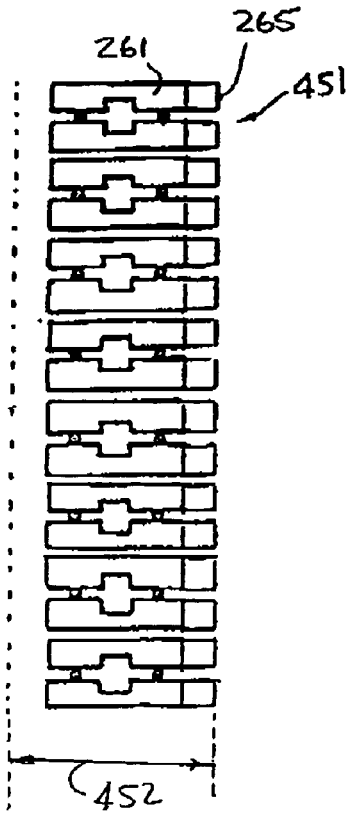
FIG. 62 is a schematic representation showing the assembly sequence of link elements forming a length of rope chain, employing aligned link elements each having a portion relatively enlarged in annular width such as that shown in FIG. 43.

FIG. 62 is a schematic representation of an arrangement for a rope chain 451, whereby only link elements 261 with lobed sides 265 are used but with consecutive link elements 261 placed such that the lobed sides 265 are in the same general orientation. Since the finished rope chain 451 will have a helical character, visually the rope chain 451 has an apparent larger diameter as indicated at 452, and again resulting in a savings of material.

Figure 63:
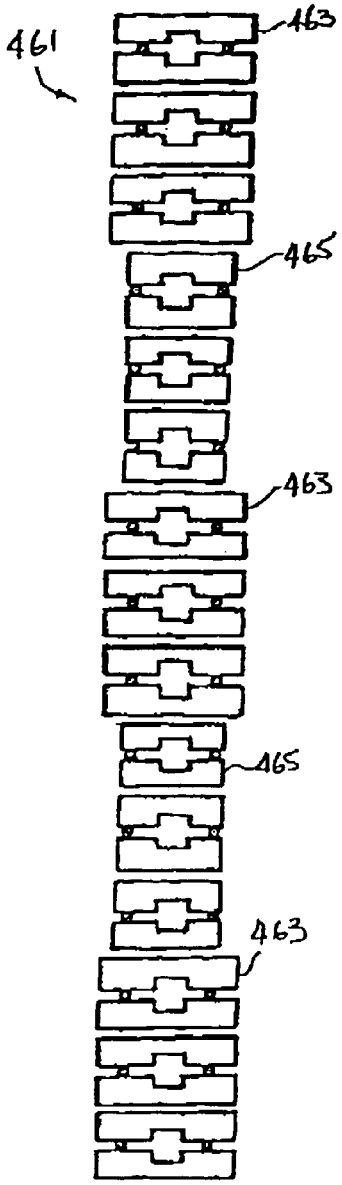
FIG. 63 is a schematic representation showing the assembly sequence of link elements forming a length of rope chain, employing link elements, whether annularly shaped or otherwise, of different dimensions alternating every six link elements.
Figure 64:
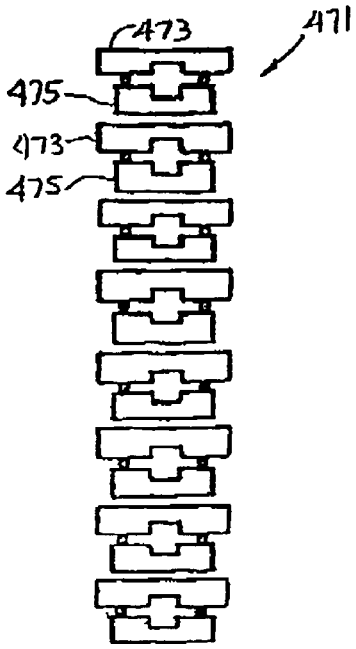
FIG. 64 is a schematic representation showing the assembly sequence of link elements forming a length of rope chain, employing link elements of standard, or substandard, annular widths alternating with link elements having relatively enlarged annular widths.
Figure 65:
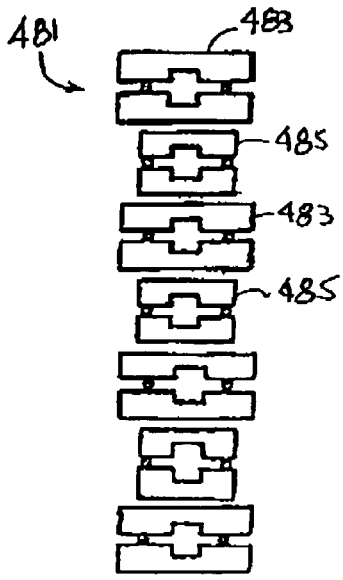
FIG. 65 is a schematic representation showing the assembly sequence of link elements forming a length of rope chain, employing pairs of link elements of standard, or substandard, annular widths alternating with pairs of link elements having relatively enlarged annular widths.

FIGS. 63–65 schematically illustrate how link elements, whether annularly shaped or otherwise, of different dimensions can be interconnected together to form a rope chain resulting in a chain of different diameters along the length of the chain. This type of arrangement, in addition to its resulting distinctive appearance, can also contribute to savings in material costs, and yet visually, the overall effect renders an effective diameter equal to that of the larger diameter link elements.

FIG. 63 shows a chain 461 comprised of link elements 463, 465 of different dimensions every six link elements.

FIG. 64 shows a chain 471 in which every other link element 473 is of the same dimension and is interspersed with every other link element 475 of a different dimension. The overall outline of this chain would give the general appearance of a chain made only from the link elements of larger dimension.

Figure 64A:
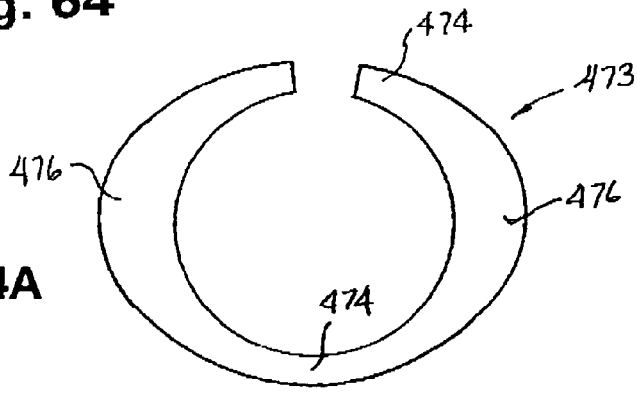
FIG. 64A is a plan view of a link element showing a configuration departing from the standard annular configuration, the link element having wide dual side lobes.

To achieve even greater savings of material, the apparently larger diameter link elements 473 in FIG. 64 may not be circular, but may have an overall oval configuration having double side lobes 476, as shown in FIG. 64A. In this variation, the link width at the narrower regions 474 are mostly hidden from view in the assembled chain, and visually, the assembled rope chain has the appearance of a rope chain having a diameter equal to the distance between bulge extremes of lobes 476. As with other chain configurations shown and described herein, a substantial savings of material is realized, and in this particular variation, this is accomplished without significant visual indication of a departure from a rope chain constructed solely of link elements having constant large diameters.

FIG. 65 illustrates a chain 481 in which every two consecutive link elements 483 and 485 are of a different diameter.

The illustrations in FIGS. 60–65 are presented for exemplary purposes only. The visual properties and the arrangements can be varied depending on the desired effect.

Figure 66:
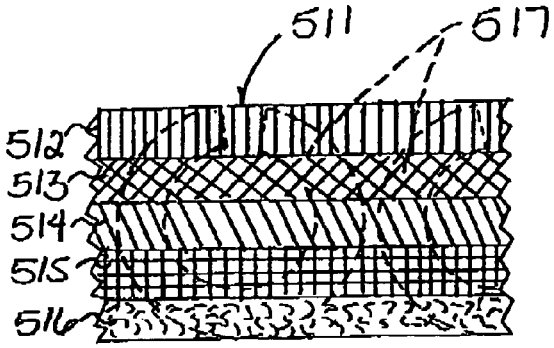
FIG. 66 is a plan view of a sheet of material having multiple colored or textured regions, thereby exhibiting five different visual properties, and, in dashed lines, the location and orientation of link elements to be stamped from such sheet of material.

FIG. 66 is a plan view of a sheet of material 511 having a plurality of regions 512–516 which may be multiple colored or textured regions, or regions of different materials, or regions of similar materials (e.g. gold) but of different karat weights, thereby exhibiting five different visual properties, and, in dashed lines, the location and orientation of link elements 517 to be stamped from such sheet of material 511.

Figure 67:
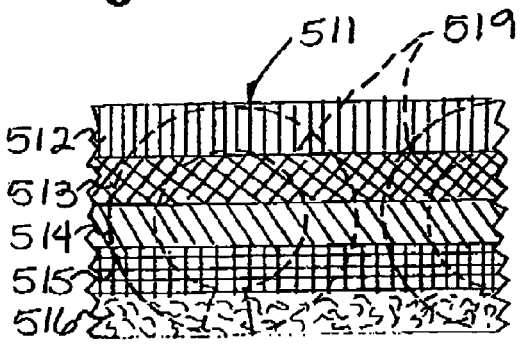
FIG. 67 is a plan view similar to that of FIG. 66, but with the orientation of link elements rotated 180°.

FIG. 67 is a plan view similar to that of FIG. 66, but with the orientation of link elements 519 rotated 180°.

Figure 68:
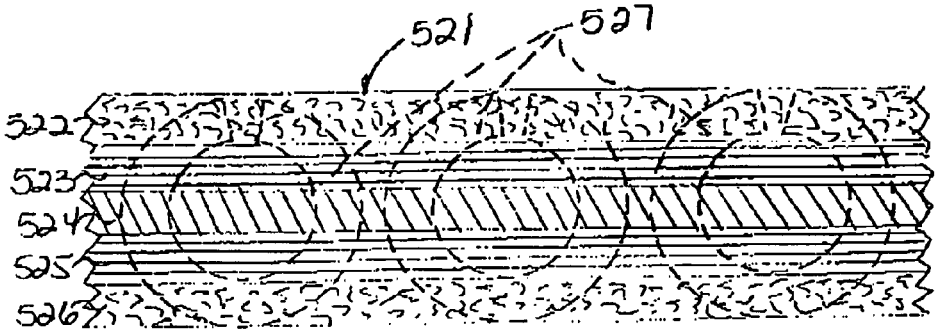
FIG. 68 is a plan view of a sheet of material having multiple colored or textured regions, thereby exhibiting five different visual properties, and, in dashed lines, the location and orientation of link elements to be stamped from such sheet of material.
Figure 78:
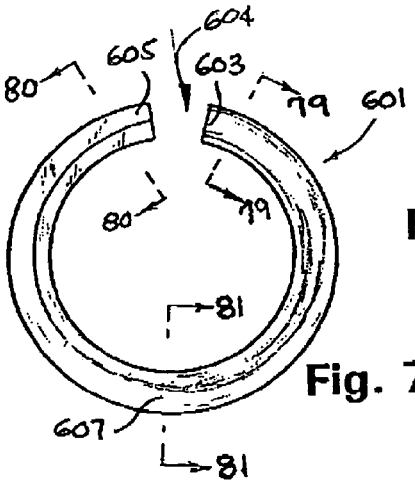
FIG. 78 is a plan view of a link element which has a variable cross section along its extent.
Figure 79:
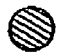
FIG. 79 is a cross sectional view of the link element shown in FIG. 78 taken along the lines 79—79.
Figure 80:
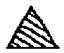
FIG. 80 is a cross sectional view of the link element shown in FIG. 78 taken along the lines 80—80.
Figure 81:
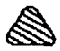
FIG. 81 is a cross sectional view of the link element shown in FIG. 78 taken along the lines 81—81.

FIG. 68 is a plan view of a sheet of material 521 having a plurality of regions 522–526 which may be multiple colored or textured regions, or regions of different materials, or regions of similar materials (e.g. gold) but of different karat weights, thereby exhibiting five different visual properties, and, in dashed lines, the location and orientation of link elements 527 to be stamped from such sheet of material 521.

FIG. 69 is a fragment representation of the sheet of material 511 shown in FIG. 66 or 67. The sheet of material 511 has five different strips of material 512–516, and the figure lining is not intended to represent any particular color, texture, material, or karat weight which may be selected from any of the colors, textures, materials, or karat weights described in this specification. It is to be noted that every other link element of a rope chain is inverted, i.e., if the gap of a particular link element. is oriented upwardly, the gap of each adjacent link element will be oriented downwardly. For this reason, a rope chain constructed of elements 517 would be uninteresting because there would be no color/texture/material/karat weight pattern correlation link-to-link. That is, on one link element the visual properties top-to-bottom would be in the order 512–516, while on each adjacent link element the visual properties top to-bottom would be in reverse order of 516–512.

However, if the sheet of material 511, or the stamping machine (not shown), were reversed in orientation, as shown in FIG. 67, with the link element 519 possessing the same coloring/texturing but in reverse order relative to the gap position, then an assembled rope chain will have color/texture/material/karat weight pattern correlation link-to-link, and will display a plurality of helical color/texture/material/karat weight patterns along the rope chain 531. This is shown in FIG. 70 in the lower segment "B". Segment "B" is comprised of alternate link elements 517 and 519, with the fragment of FIG. 6 aligned with link element 520 as a reference.

In addition to multiple colored helixes, as described above, it will be noted that in segment "B", one side of each channel 535 has the color/texture/material/karat weight of strip 512 (FIGS. 66, 67), while the other side of each channel 535 has the color/texture/material/karat weight of strip 516. Color/texture/material/karat weight 514 creates a thin helical stripe along the extreme periphery of each strand the rope chain 531.

Instead of manufacturing two different, oppositely patterned, multicolored link elements 517 and 519, a length of rope chain can be made with link elements alternating with either link elements 517 or 519 and a standard single color link element, e.g., one of solid yellow gold. When assembled, the length of rope chain will have the appearance as shown in segment "A" of FIG. 70. With this arrangement, it is not necessary to have two different multi-colored or multi-textured link elements, and yet a plurality of helical color/texture,/material/karat weight patterns will be seen along the rope chain 531, the helical patterns interrupted by alternate solid yellow gold link elements. To some tastes, this more subtle helical patterning may be more appealing than the somewhat "busy" appearance of the helical patterning shown in segment "B".

FIG. 71 is a fragment representation of the sheet of material shown in FIG. 68. The sheet of material 511 has five different strips of material 522–526, and the lining is not intended to represent any particular color, texture, material, or karat weight which may be selected from any of the colors, textures, materials, or karat weights described in this specification. It is to be noted that the color/texture/material/karat weight pattern on sheet 521 is symmetrical, with strips 522 and 526 having the same color, texture, material, or karat weight, and strips 523 and 525 having the same color, texture, material, or karat weight but different than strips 522 and 526. Strip 524 is likewise of a different color, texture, material, or karat weight than any other strip.

Because of the symmetry of color/texture/material/karat weight strips in sheet 521, there is no need to stamp out differently oriented link elements, since each link element 527 has the same color/texture/material/karat weight pattern in both orientations of the gap. Thus, an assembled rope chain 536, shown in FIG. 72, will have color/texture/material/karat weight pattern correlation link-to-link, and will display a plurality of helical color/texture/material/karat weight patterns along the rope chain 536.

In addition to helixes of multiple visual properties, as described above, it will be noted that in FIG. 72, both sides of each channel 537 has the color/texture/material/karat weight of strips 522 and 526 (FIG. 68). Color/texture/material/karat weight 524 creates a thin helical stripe along the extreme periphery of each strand the rope chain 536.

In the embodiments shown in FIGS. 66–72, five strips of materials, or materials of different karat weights, colors, and/or textures are shown, but any other number of strips can make up the multiple strip sheets 511 and 521. Further, while it has been suggested that any of the strips 512–516 and 522–526 can be different materials, or materials of different karat weights, colors, and/or textures, when different textures are selected for certain strips, the textured strips should alternate with non-textured strips. If all strips, or adjacent strips, were textured, even with different types of textures, the distinction between different textures will be difficult to see and appreciate. Additionally, while the orientations of the stamped link elements shown in FIGS. 66–68 are such that the gaps are at 12:00 o'clock and 6:00 o'clock positions, any angular orientation is easily achieved by rotating the stamping die or the sheet of material being stamped, therefore producing link elements exhibiting an unlimited number of different patterns. Following the above methods of assembling multiple patterned link elements, the visual appearance of rope chains manufactured using such multiple patterned link elements will be self evident to a person of ordinary skill in the art.

FIG. 73 is a plan view of a segment of a sheet of material having multiple regions 542–546 of different material, color, karat weight, or texture similar to that of FIGS. 66, 67, and 69. However, only every fifth link element 549 in the rope chain shown in FIG. 74 is stamped from sheet 541. A second sheet (not shown) having the same color/texture/material/karat weight patterns as sheet 541 but shifted laterally by one color/texture/material/karat weight strip width is stamped to produce link elements 551, also spaced every fifth link element position, and placed adjacent link elements 549 made from sheet 541. Similarly, a third sheet (not shown) having the same patterns but shifted another color/texture/material/karat weight strip width is stamped to produce link elements 553, also spaced every fifth link element position, and placed adjacent link elements 551. Link elements 549, 551, and 553 are shown in FIG. 75 oriented with their gaps alternating from 12:00 o'clock to 6:00 o'clock as they would be in the assembly process. Another two sets of link elements (not shown) are stamped from another two separate sheets each having the color/texture/material/karat weight pattern 542–546 shifted an additional strip width. These additional two sets of link elements complete the five sets of distinctively color/texture/material/karat weight striped link elements need to produce the rope chain shown in FIG. 74. It is not necessary to show the color/texture/material/karat weight patterns of the latter two link element sets in FIG. 74, since their color/texture/material/karat weight patterns and orientation are self-evident from the description of the first three link elements 549, 551, and 553.

The net result of assembling five different sets of link elements just described is a rope chain 547 which exhibits a pleasing and surprisingly unique repeated pattern of laterally striped color/texture/material/karat weight segments, as illustrated in FIG. 74.

As will be understood by reference to FIG. 75, rather than manufacturing five different multi-striped sheets of material from which to stamp out the five differently striped link elements 549, 551, 553, etc. (only three are shown), a single sheet of material (not shown) having nine strips in the order 1-2-3-4-5-1-2-3-4, representing the five different colors/textures/materials/karat weights, can be manufactured and stamped to produce all five different link elements from the same sheet to construct rope chain 547. However, considerable waste of precious metal would be involved, and the decision as to how many sheets of how many color/texture/material/karat weight strips is left to the discretion of the manufacturer.

FIG. 76 is a plan view of a sheet of material 561 from which curved slices 563 can be cut and eventually formed into link elements. The purpose for this methodology is to minimize or completely eliminate cracking and stress blemishes that may result in curling a straight piece of precious metal into a "C" shaped link element (cf. FIG. 30). By starting with a partially curved stamped slice of material, less bending is needed. Of course, some small amount of waste in the regions 567, due to forming flat ends 565 on the link element slices 563, will be realized, but this may be more than offset by the savings in damaged link elements made from straight slices.

FIG. 77 is a plan view of a sheet of material 571 from which link elements 573 and 575 can be stamped, the link elements being interlinked in layout and alternating in their respective gap positions 577,579. Shapes other than square are obviously possible using this stamping technique, and the sheet of material 571 optionally can be multi-colored or multi-textured similar to those shown in FIGS. 66–68, 69, 71, and 73. Depending upon the shape of the link elements desired, and the gap width needed, layouts different than that shown in FIG. 77 will be self-evident to a person of ordinary skill in the art. Interlinking in the manner shown and described serves to minimize material waste.

While link elements with flat major surfaces and generally rectangular cross sections have been used as exemplary in the drawing and in the preceding text, it is within the scope of the invention to form a stamping die, or complementary pair of stamping dies, for a stamping machine, and form link elements having a variable cross section along its extent. An example is depicted in FIGS. 78–81 which show, respectively, a plan view of a link element 601 having a variable cross section, a cross sectional view taken along line 79—79 adjacent one side 603 of the gap 604, a cross sectional view taken along line 80—80 adjacent the opposite side of the gap 604, and a cross sectional view taken along line 81—81 directly across from the gap 604.

In this embodiment, the cross section of link portion 603 is circular, the cross section of link portion 605 is triangular, and the cross section of link portion 607 is generally triangular with rounded corners.

Preferably, the cross section of link element 601 is continuously variable along the extent of the link element 601, and in this specific example the circular cross section on one side 603 of the gap 604 is morphed into a triangle at the other side 605 of the gap 604. Alternatively, for an interesting visual effect, the change in cross section may be incremental, not continuous, staying the same for a short distance and changing in discrete steps along the extent of the link element 601.

It is to be understood that the cross sectional variation may be a morphing or a stepped change from any geometrical shape to any other geometrical shape, such as square, diamond shaped, D-shaped, oval, polygonal, or even a non-geometrical or random shape. Likewise, a link element with a variable cross section is not limited to annularly configured link elements, and can be of any configuration including those described herein.

Figure 82A:
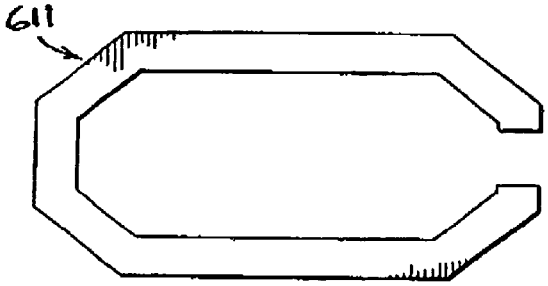
Fig. 82A (Prior Art)
FIG. 82A is a plan view of a prior art baguette-shaped link element.
Figure 82B:
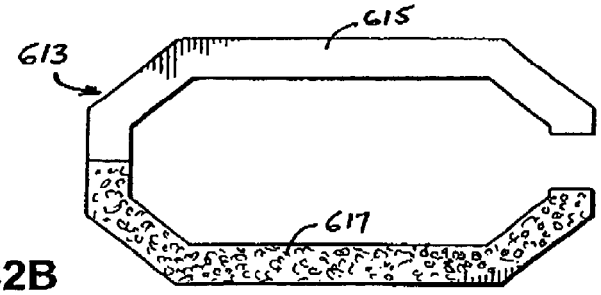
FIG. 82B is a plan view of a baguette-shaped link element with one of the arms of the link element textured.

All of the link elements shown in FIGS. 82B, D, G, I, and K have one link arm shown without texture or color, and the other link arm textured and/or colored. A rope chain constructed with such link elements will exhibit one strand having a visual property different than that of the other strand.

FIG. 82A is a plan view of a prior art baguette-shaped link element 611. Such elongated link elements may be interconnected with similar link elements to form a length of rope chain, and the length of the rope chain so constructed may be joined to other lengths of rope chains constructed of link elements of other configurations, e.g., annular, resulting in a pleasing rope chain appearance.

FIG. 82B is a plan view of a baguette-shaped link element 613, similar to that shown in FIG. 82A, but with one of the arms 615 of the link element 613 shown as being without texture or color, and the other arm 617 textured and/or colored.

Figure 82C:
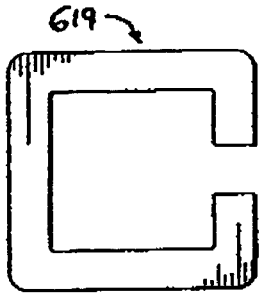
Fig. 82C (Prior Art)
FIG. 82C is a plan view of a prior art square-shaped link element.

FIG. 82C is a plan view of a prior art square-shaped link element 619.

Figure 82D:
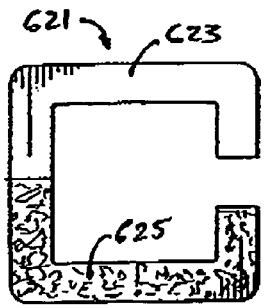
FIG. 82D is a plan view of a square-shaped link element with one of the arms of the link element textured.

FIG. 82D is a plan view of a square-shaped link element 621 with one of the arms 623 of the link element 621 shown as being without texture or color, and the other arm 625 textured and/or colored.

Figure 82E:
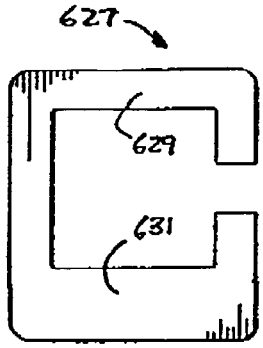
FIG. 82E is a plan view of a substantially square-shaped link element with one of the arms of the link element having a link width greater than that of the other arm.

FIG. 82E is a plan view of a substantially square-shaped link element 627 with one of the arms 629 of the link element 627 being of standard, or less than standard, link width, and with the other arm 631 having a link width greater than that of arm 629. A rope chain constructed with such link elements will exhibit one strand larger than the other strand.

Figure 82F:
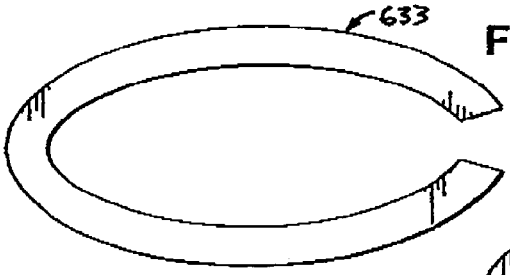
Fig. 82F (Prior Art)
FIG. 82F is a plan view of a prior art oval-shaped link element.

FIG. 82F is a plan view of a prior art ova-shaped link element 633.

Figure 82G:
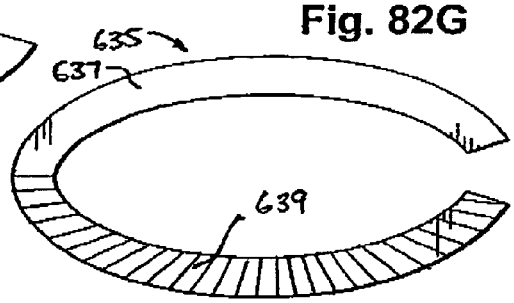
FIG. 82G is a plan view of an oval-shaped link element with one of the arms of the link element textured.

FIG. 82G is a plan view of an oval-shaped link element 635 with one of the arms 637 of the link element 635 shown as being without texture or color, and the other arm 639 textured and/or colored.

Figure 82H:
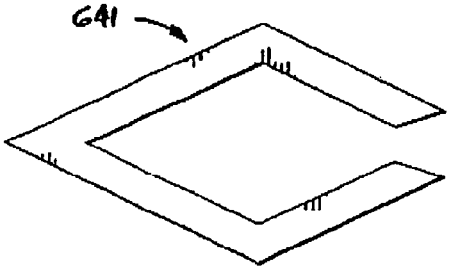
Fig. 82H (Prior Art)
FIG. 82H is a plan view of a prior art diamond-shaped link element.

FIG. 82H is a plan view of a prior art diamond-shaped link element 641.

Figure 82I:
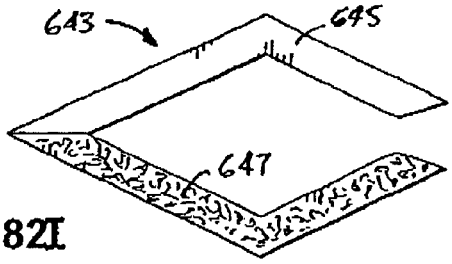
FIG. 82I is a plan view of a diamond-shaped link element with one of the arms of the link element textured.

FIG. 82I is a plan view of a diamond-shaped link element 643 with one of the arms 645 of the link element 643 shown as being without texture or color, and the other arm 647 textured and/or colored.

FIG. 82J is a plan view of a prior art heart-shaped link element 649.

FIG. 82K is a plan view of a heart-shaped link element 651 with one of the arms 653 of the link element 651 shown as being without texture or color, and the other arm 635 textured and/or colored.

FIG. 83 is a plan view of an elongated strip of material 657, prior to being bent into a link element, having a plurality of regions, adjacent ones of which exhibit different visual properties. The basic elongated strip 657 may be fabricated by any of a number of different processes. For example, the strip 657 may be cut to length from a roll of flat wire, or may be sliced from a sheet of material having a prescribed width and thickness. In any event, the elongated strip 657 is characterized by a non-textured segment 673 on the left side of the strip as shown in FIG. 83, followed by a criss-cross pattern of lines 671 in the adjacent segment with one side of the strip adjacent segment 671 having a textured edge 659. Two short segments 675 on the strip of material 657 act as separators for the different segments of the strip exhibiting different visual properties, the short segments 675 comprising a small number of impressions in the form of parallel lines perpendicular to the axis of the strip 657 and being formed with enough pressure to cause the strip of material to slightly bulge laterally. The next adjacent segment 677 is another segment that is non-textured, followed by a segment 679 in which a side edge 680 of the strip of material 657 is serrated. The next adjacent segment 681, after the separator segment 675, is another non-textured segment, followed by a textured end segment 683 shown in FIG. 83 as representing a sandblasted or matt finish.

FIG. 84 is a plan view of the other side of the strip of material 657 shown in FIG. 83. On the back side of the strip 657, the wavy edge pattern 659 is observable, as is a textured segment 685 adjacent the edge serrations 680.

The strip of material 657, after forming of the textured regions just described, is bent into a C-shaped configuration to form a link element possessing the visual properties of the strip of material 657 as described.

FIG. 85A is a plan view of a link element 687 exhibiting different visual properties along its extent and having a link thickness one-half that of a standard link element.

FIG. 85B is a right side elevational view of the link element shown in 85A.

FIG. 85C is a plan view of another link element 692 exhibiting visual properties along its extent, different than that of FIG. 85A, and having a link thickness one-half that of a standard link element.

FIG. 85D is a right side elevational view of the link element shown in 85C.

FIG. 85E is a side elevational view of the two link halves 687,692 shown in FIGS. 85B and 85D joined together to form a link element of standard thickness, and exhibiting different visual properties on first and second major surfaces 694,698, and exhibiting a combination of visual properties along the exterior edge thereof. Due to the coloring and/or texturing that are different on each link element layer 687 and 692, a more intricate and delicate appearance of an assembled rope chain will result. For example, a 4-link rope chain will have the appearance of an 8-link rope chain, and a 6-link rope chain will have the appearance of a 12-link rope chain, etc.

Figure 86:
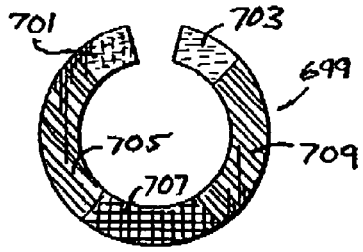
FIG. 86 is a plan view of a link element, illustrating the possibility of manufacturing a link element having a plurality of adjacent segments exhibiting different visual properties.

FIG. 86 is a plan view of a link element 699, illustrating the possibility of manufacturing a link element having a plurality of adjacent segments 701,703,705,707,709 exhibiting different visual properties, the segments being arcuate segments of the link element 699. In the figure, there are five different arcuate segments of link element 699 which are either textured, colored, or both, in the segments 701,703, 705,707,709. No specific color or texture is intended by the lining of the different segments, as shown, and any combination of colors and textures may be employed to produce, in an assembled rope chain comprising a plurality of such link elements as 699, an interesting and beautiful pattern of colors and/or textures along the length of the assembled rope chain. For example, when assembled in a particular manner, the outer periphery of one of the rope strands may possess the visual property of segment 705, and the outer periphery of the other rope strand will possess the visual property of segment 709. If these two segments, 705 and 709, are identical in texture and/or color, the interesting aspects of the assembled rope chain will be in the vicinity of the two helical channels between the two intertwining rope strands as dictated by the color and/or texture of segments 701, 703, and 707.

Figure 87:
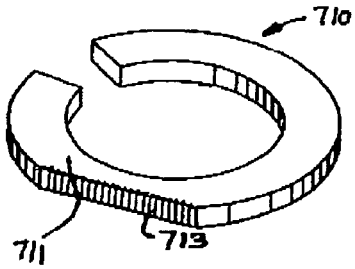
FIG. 87 is a perspective view of an annular-shaped link element with one arm having a flat surface formed thereon and textured on the formed flat surface.

FIG. 87 is a perspective view of an annular-shaped link element 710 with one arm 711 having a flat surface 713 formed thereon and textured on the formed flat surface. In an assembled rope chain, employing a number of link elements 710, one helical rope strand will have a standard, plain appearance, while the other rope strand will exhibit a helical serrated path along its outer periphery. An interesting variation of the rope chain constructed from link elements 710 will result if the flat surface 713 is serrated and coated with rhodium.

Figure 88:
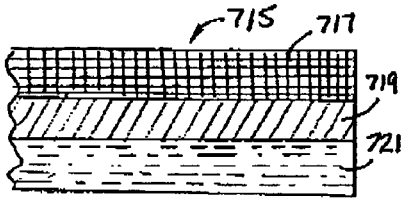
FIG. 88 is a plan view of a strip of material exhibiting three different visual properties lengthwise of the strip.

FIG. 88 is a plan view of a strip of material 715 having three elongated regions 717,719,721 exhibiting three different visual properties lengthwise of the strip 715.

Figure 89:
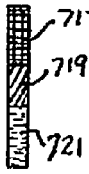
FIG. 89 is a right side elevational view of the strip of material shown in FIG. 88.

FIG. 89 is a right side elevational view of the strip of material 715 shown in FIG. 88.

Figure 90:
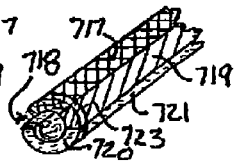
FIG. 90 shows the strip of material depicted in FIGS. 88 and 89 rolled into a cylindrical shape with an elongated gap along one side.

FIG. 90 is a perspective view showing the strip of material 715 depicted in FIGS. 88 and 89 rolled into a cylindrical shape with an elongated gap 718 left along one side.

Figure 91:
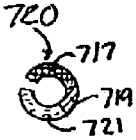
FIG. 91 is a plan view of a link element sliced from the rolled strip of material as depicted in FIG. 90.

FIG. 91 is a plan view of a link element 720 sliced, along the cut line 723, from the rolled strip of material 715 as depicted in FIG. 90. The method suggested by FIGS. 88–91 may be employed to produce the link element 701 shown in FIG. 86, which likewise has arcuate segments exhibiting different visual properties.

Figure 92:
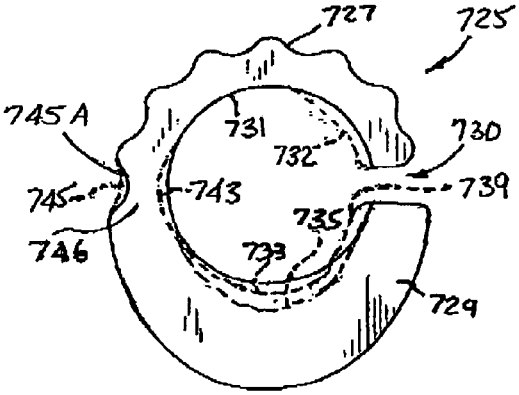
FIG. 92 is a plan view of a link element having one of its arms of a larger link width than that of the other arm, and further illustrating, in dashed lines, optional variations of link width at different points along the extent of the link element.

FIG. 92 is a plan view of a link element 725 having one of its arms 729 of a larger link width than that of the other arm 727, and further illustrating, in dashed lines, optional variations of link width at different points along the extent of the link element.

In one configuration, the interior edge 731 is circular, as shown by the solid line representation. All of the structural variations shown in dashed lines in FIG. 92 serve the purpose of identifying dimensional variations of the different segments of the link element 725 required to permit reducing the amount of precious metal used in the manufacture of the link element, yet maintaining the visual appearance of a standard size rope chain.

For example, the link element 725 in FIG. 92 has an upper arm 727 that is undulated, and a lower arm 729 which is enlarged at its center. When assembled into a rope chain, as previously described, the finished chain has the general appearance of a standard size rope chain, due to the enlarged link width of the lower arm 729 and the glitter of the undulations formed on the upper arm 727.

It should be noted that, in the construction of a rope chain, the dimensions of each link element are quite critical insofar as how flexible the assembled chain is, and how loose the chain might "feel". A quality rope chain will not be loose and yet will have sufficient flexibility without feeling stiff. To prevent the rope chain from being too loose, the thinner upper arm 727 may be enlarged as it approaches the gap 730 as shown by dashed line 732.

Alternatively, or in addition, the last indentation 745A, where the undulated arm 727 transitions to the lower arm 729, may be made less deep, as shown by the dashed line 745. If the last indentation 745A at the aforementioned transition point is made even more shallow at 745, the interior edge of the link element 725 may have a wide but slight indentation shown by dashed line 743, again for the purpose of reducing the amount of precious metal needed to construct a quality rope chain without adversely affecting the outer appearance of the rope chain, since the indentation 743 will not be visible in the finished chain. Stating this another way, regardless of the shape of a link element, if the interior edge is provided with a void at the heel portion to conserve precious material, the exterior edge may be slightly extended outwardly at the heel portion opposite the void to maintain a prescribed minimum link width at the heel portion. By making the interior void at the heel longer along the length of the link element than the length of the outwardly extended heel portion, there will still be a net precious material savings.

In a further effort to reduce precious metal and yet not result in a "loose" chain, the interior edge 731 may be slightly turned inwardly on arm 729 at the gap 730, as shown by the dashed line 739, while permitting removal of precious metal from the interior edge 731 as shown by the dashed line 733.

Due to the large increase in link width of the lower arm 729 of link element 725, it will be appreciated that, when assembled into a rope chain, the wide arms 729 of adjacent link elements 725 will tend to overlap a large portion of the interior edge 731, permitting a correspondingly large removal of precious metal from the interior edge of the wider link arm, as shown in FIG. 92 by the dashed line 735.

The amount of precious metal permitted to be removed from the interior edge 731 without being noticeable can be calculated from the dimensions of the link element 725 in the vicinity of the gap 730 and heel portion 746 of the link element 725. Alternatively, the amount of precious metal that may be removed without being noticed may best be determined by empirical analysis. That is, once a particular link element design is fabricated and assembled into a short length of rope chain, a visual analysis of the overlapping nature of the link elements can be observed and marked on the link elements for purposes of revising the shape and configuration to produce an optimum link element geometry which will have all of the interior edges where precious metal has been removed be hidden from view.

All of the link elements shown in FIGS. 94–100, 102–105, 111, 113, and 115–117 have one link arm shown without texture or color, and the other link arm textured and/or colored, or have different textures, colors, or shapes different as between the two arms. A rope chain constructed with such link elements will exhibit one strand having a visual property different than that of the other strand.

Figure 93:
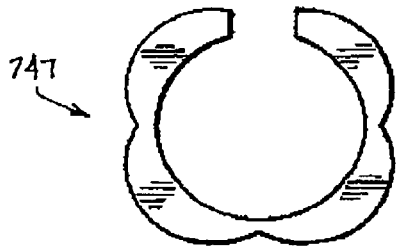
Fig. 93 (Prior Art)
FIG. 93 is a plan view of a prior art link element in which the exterior surface is scalloped.

FIG. 93 is a plan view of a prior art link element 747 in which the exterior surface is scalloped.

Figure 94:
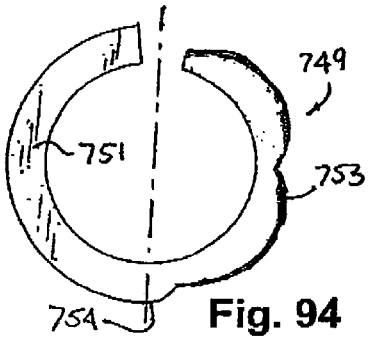
FIG. 94 is a plan view of a link element made in accordance with the present invention, in which the exterior edge of one of the arms of the link element is scalloped, and the exterior edge of the other arm is smooth and not scalloped.

FIG. 94 is a plan view of a link element 749 made in accordance with the present invention, in which the exterior edge of one of the arms 753 of the link element 749 is scalloped, and the exterior edge of the other arm 751 is smooth and not scalloped.

Figure 95:
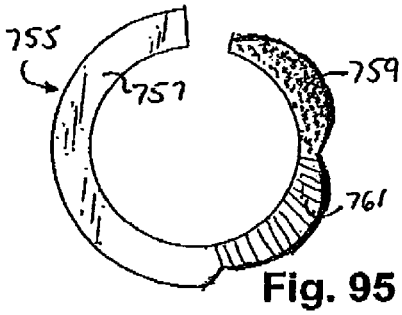
FIG. 95 is a view of a link element similar to that shown in FIG. 94, except that one of the scalloped segments exhibits a visual property different than that of the other scalloped segment on a major surface of the link element.

FIG. 95 is a view of a link element 755 with a non-textured arm 757, similar to that shown in FIG. 94, except that one of the scalloped segments 759 exhibits a visual property different than that of the other scalloped segment 761 on a major surface of the link element 755.

Figure 96:
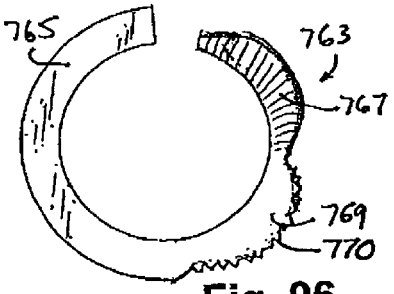
FIG. 96 is a view similar to that shown in FIG. 95, except that the exterior edge of one of the scalloped segments exhibits a visual property different than that of the other scalloped segment.

FIG. 96 is a view of a link element 763 with a non-textured arm 765, similar to that shown in FIG. 94, except that the exterior edge 770 of one of the scalloped segments 769 exhibits a visual property different than that of the other scalloped segment 767 which is textured on its major surface.

Figure 97:
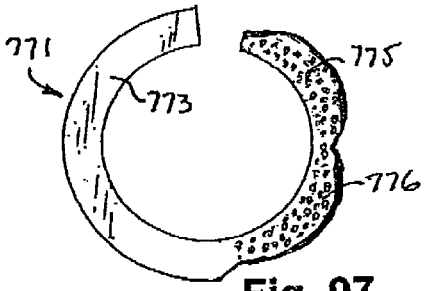
FIG. 97 is a view similar to that of FIG. 94, with both scalloped segments exhibiting the same visual property on one major surface of the link element.

FIG. 97 is a view of a link element 771 with a non-textured arm 773, similar to that shown in FIG. 94, except that both scalloped segments 775,776 exhibit the same visual property on one major surface of the link element 771.

Figure 98:
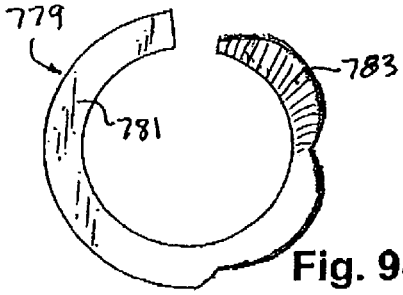
FIG. 98 is a view similar to that shown in FIG. 94, with only one of the scalloped segments exhibiting a visual property different from that of the remainder of the link element.

FIG. 98 is a view of a link element 779 with a non-textured arm 781, similar to that shown in FIG. 94, except that only one of the scalloped segments 783 exhibits a visual property different from that of the remainder of the link element 779.

Figure 99:
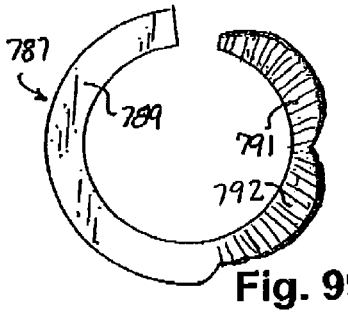
FIG. 99 is a view similar to that of FIG. 94, with both scalloped segments exhibiting the same visual property on one major surface of the link element, in this example the scalloped segments being serrated.

FIG. 99 is a view of a link element 787 with a non-textured arm 789, similar to that shown in FIG. 94, except that both scalloped segments 791,792 exhibit the same visual property on one major surface of the link element 787. In the example shown, the scalloped segments 791,792 are serrated.

Figure 100:
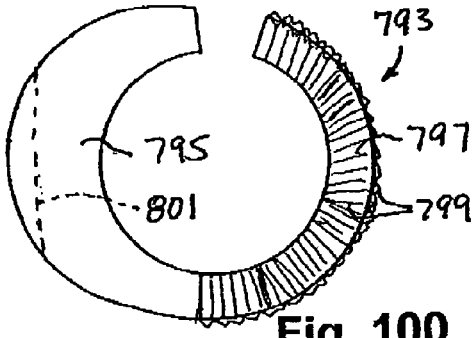
FIG. 100 is a plan view of a link element, with one arm textured on both the major surface and the exterior surface, and with the other arm bulging to a maximum link width at its center, a cutoff portion being shown in dashed lines as an optional configuration.

FIG. 100 is a plan view of a link element 793, with one arm 797 textured on both the major and exterior surfaces 799, and with the other arm 795 bulging to a maximum link width at its center, a cutoff portion 801 being shown in dashed lining as an optional configuration.

An interesting and uniquely configured rope chain will result in the assembly of a number of link elements 793 as shown in FIG. 100. One of the rope strands will exhibit a textured surface, e.g. serrations, on both the major surface, or surfaces, and the exterior edge 799 of each link element 793. The serrated arm 797 of link element 793 may be made smaller than standard size, since the other arm 795 has a greatly enlarged link width, especially in the arm center, where the arm 795 reaches a maximum link width. In order to maintain the appearance of a larger diameter rope chain in the final assembly, and yet reduce the amount of precious metal used in the manufacture of the link element 793, a flat surface 801 may be formed on the center of arm 795.

The combination of forming a flat surface 801 on the large width arm 795 and the removal of precious material in the creation of serrations 799 on the other arm 797 will significantly reduce the manufacturing cost for such link elements, and yet the assembled rope chain will have the appearance of a reasonably large diameter chain and exhibit many light reflecting surfaces to an impinging light beam, giving the finished rope chain much glitter and light reflectivity, especially during movement of the chain.

Figure 101:
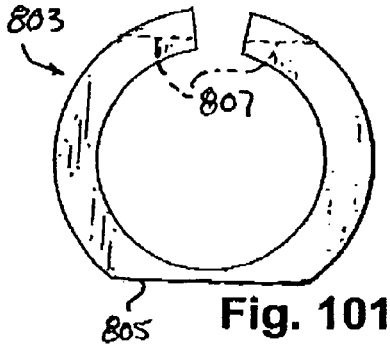
FIG. 101 is a plan view of a link element in which the heel portion is flat, and dashed lines indicating an optional alternate, or second, flat exterior surface possibility at the gap region.

FIG. 101 is a plan view of a link element 803 in which the heel portion 805 is flat, and dashed line 807 indicates an optional alternate, or second, flat exterior surface possibility at the gap region.

Figure 102:
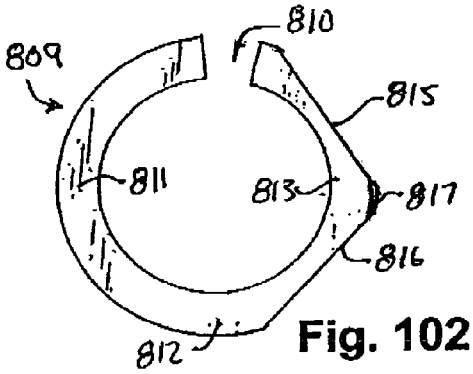
FIG. 102 is a plan view of a link element in which flats are formed at two locations on one arm, one flat formed between the gap and the arm center, and the other flat being formed between the heel and the gap center.

FIG. 102 is a plan view of a link element 809 in which flats are formed at two locations 815,816 on one arm 813, one flat 815 formed between the gap 810 and the arm center 817, and the other flat being formed between the heel 812 and the arm center 817. The short arm center portion 817 may be serrated and/or rhodium coated for enhancing the glitter of a finished rope chain.

Figure 103:
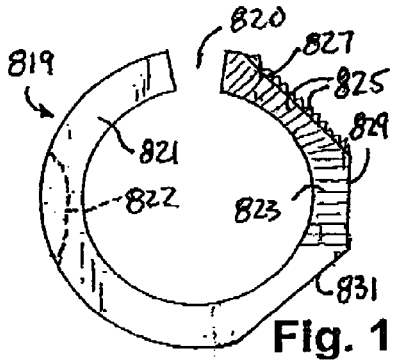
FIG. 103 is a plan view of a link element in which one arm is shown to have three connected flat sides, one flat side nearest the gap being textured on both its major surface and exterior edge, the middle segment being textured only on the major surface, and the third segment void of any texturing, an optional cutout region being shown in the middle of the other arm in dashed lines.

FIG. 103 is a plan view of a link element 819 in which one arm 823 is shown to have three connected flat sides 827, 829,831, one flat side 827 nearest the gap 820 being textured on both its major and exterior edge surfaces 825, the middle segment 829 being textured only on its major surface, and the third segment 831 void of any texturing, an optional cutout region 822 being shown in the middle of the other arm 821 with dashed lining.

Figure 104:
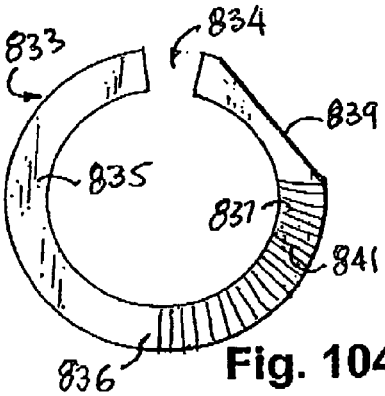
FIG. 104 is a plan view of a link element in which a flat is formed on one arm between the gap and the middle of the arm, and the major surface of the region between the heel and the arm center is shown to have texturing on its major surface.

FIG. 104 is a plan view of a link element 333 on which a flat 839 is formed on one arm 837 between the gap 834 and the middle of arm 837, and the major surface 841 of the region between the heel 836 and the arm center is shown to be textured.

Figure 105:
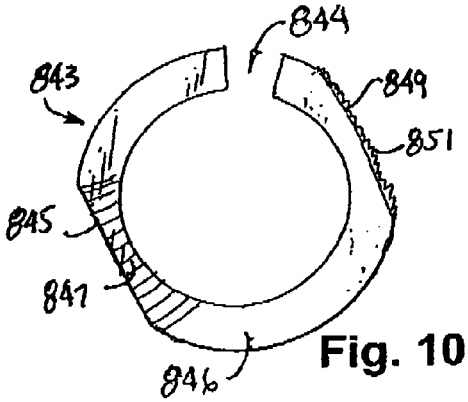
FIG. 105 is a plan view of a link element having textured flats formed at an angle with respect to a line passing through the gap and heel of the link element, one flat being textured on its major surface and the other being textured on its exterior surface.

FIG. 105 is a plan view of a link element 843 having parallel textured flats 845,849 formed at an angle with respect to a line passing through the gap 844 and heel 846 of the link element 843, one flat 845 being textured on its major surface 847 and the other flat 849 being textured on its exterior surface 851.

Figure 106:
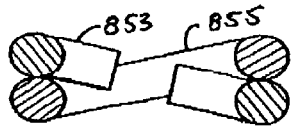
Fig. 106 (Prior Art)
FIG. 106 is a schematic representation of a cross sectional view taken across the arm centers of two adjacent solid link elements in an assembled rope chain according to the prior art.

FIG. 106 is a schematic representation of a cross sectional view taken across the arm centers of two adjacent solid link elements 853, 855 in an assembled rope chain according to the prior art.

Rope chain construction as suggested by FIGS. 107–109A have the same appearance as a chain made with solid or solid core link elements and have a reasonably heavy "feel" due to solid or solid core link element portions in the chain. Yet, such chains can be manufactured at significantly lower costs than chains employing all solid link elements due to at least portions of the link elements being hollow.

Figure 107:
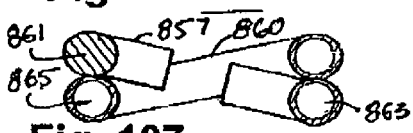
FIG. 107 is a view similar to that shown in FIG. 106, but with one of the link elements being hollow, and the other link element being partly hollow and partly solid.

FIG. 107 is a view similar to that shown in. FIG. 106, but with one of the link elements 860 having a hollow center 865, and the other link element 857 being partly hollow at 863 and partly solid at 861.

Figure 108:
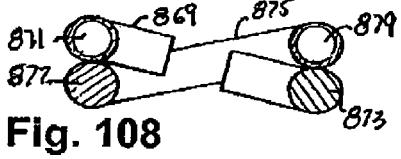

FIG. 108 is a view similar to that shown in FIG. 106, but with both link elements 869,875 being partly solid at 873 and 877 and partly hollow at 871 and 879.

Figure 109:
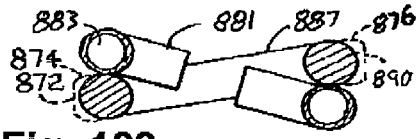

FIG. 109 is a view similar to that shown in FIG. 106, but with one of the link elements 881 having a hollow center 883, and the other link element 887 being wholly solid.

Figure 109A:
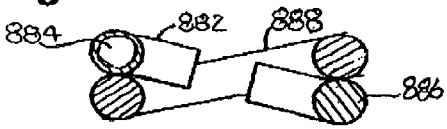

FIG. 109A is a view similar to that shown in FIG. 106, but with one of the link elements 888 being wholly solid, and the other link element 882 being partly hollow at 884 and partly solid at 886.

An interesting and creative variation of the embodiments shown in FIGS. 107–109A involve the manufacturing of the solid link elements, or solid link portions of partly solid and partly hollow link elements, to have a larger outer diameter, or larger dimension from the center of the link element to the exterior edge across the generally C-shaped link element. In such an embodiment, the most outwardly portion of the assembled rope chain will be the larger diameter solid link elements or solid link element portions. This will permit the assembled rope chain to be wound around a drum and subjected to a diamond cutting procedure which will cut. through flat surfaces along the rope chain only on the solid link elements or solid link element portions. This is a great advantage over constructing a rope chain solely from hollow tubular link elements, since any significant diamond cutting of the outer periphery of the rope chain will puncture through the thin walls of the hollow link element.

An example of a rope chain so constructed can be appreciated by reference to FIG. 109 in which it will be understood that the diameter of the link element 887, from exterior edge-to-exterior edge is greater than that of the hollow tubular link element 881. Dashed lines 874 and 876 indicate the enlarged diameter, or extended outer edge, of link element 887, and flats 882 and 890, respectively, represent the optional diamond cuts which can be enhanced in reflectivity by coating with rhodium.

Of course, even for those link element constructions in which half of the link element is solid and half is hollow, the same principle may be applied, i.e. the solid half of the link element may be made to have a larger link width, or to simply be formed such that the exterior edge of the solid arm portion is further away from the center point of the link element than the hollow arm portion of the link element. In the example described in connection with FIG. 109, the diamond cut path will be a helical path along the outer periphery of the rope chain on either one or both rope strands. For the embodiments in which part solid and part hollow link elements are employed, only the solid arms of the link elements will be diamond cut, and, assuming a rope chain employing the arrangement shown in FIG. 107, the diamond cut path will be produced on only one of the helical strands of the assembled rope chain.

Figure 110:
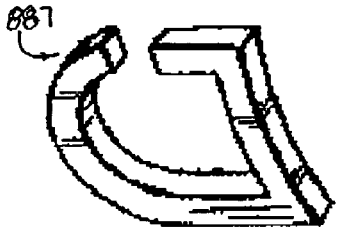
Fig. 110 (Prior Art)

FIG. 110 is a perspective view of a prior art D-shaped link element 887.

Figure 111:
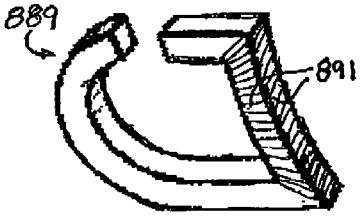

FIG. 111 is a view similar to that shown in FIG. 110, but with the substantially straight portion of the D-shape being textured on both the major and exterior edge surfaces 891 of the link element 889.

Figure 112:
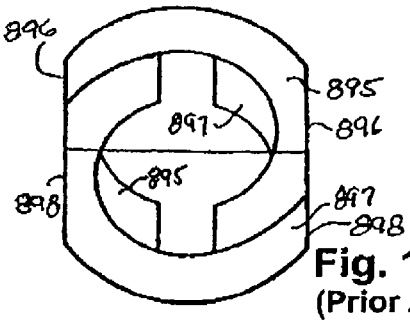
Fig. 112 (Prior Art)

FIG. 112 is a schematic representation of two adjacent overlapping prior art link elements 895,897 in an assembled rope chain, each link element having respective flats 896, 898 in the middle of each arm center.

Figure 113:
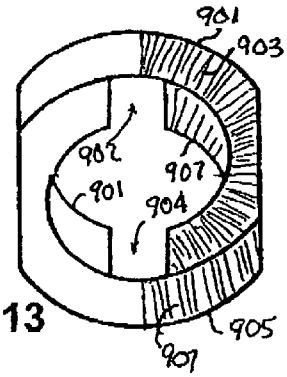

FIG. 113 is a view similar to that shown in FIG. 112, but with one arm 903,907 of each link element 901,905, respectively, being textured on the same side when viewed along the length of an assembled rope chain, i.e., the link elements 901,905 are assembled with their respective gaps 902,904 opening in opposite directions.

Figure 114:
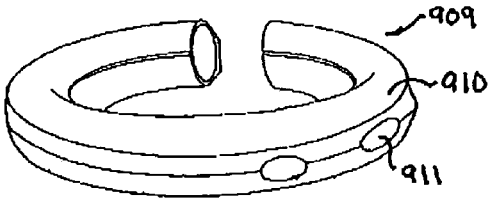
Fig. 114 (Prior Art)

FIG. 114 is a perspective view of a tubular link element 909 having a substantially circular cross section, according to the prior art, and showing two spaced apart flats 911 along the middle of the exterior surface of one of the arms 910 of the link element 909.

Figure 115:
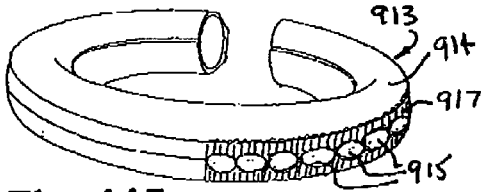

FIG. 115 is a perspective view of a tubular link element 913, similar to that shown in FIG. 114, but with one arm 914 being textured on its exterior surface 917, and with a series of flats 915 formed superimposed over the textured surface 917 at the middle of the exterior edge of arm 914.

Figure 116:
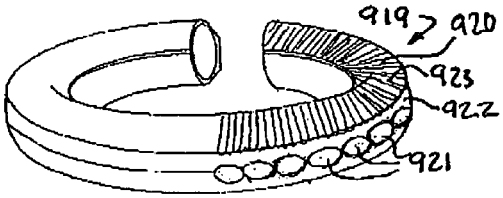

FIG. 116 is a perspective view of a tubular link element 919, similar to that shown in FIG. 114, but with one major surface 923 of one of the arms 920 being textured, and the exterior edge 922 of arm 920 having a series of connected flats 921 along the extent of arm 920.

Figure 117:
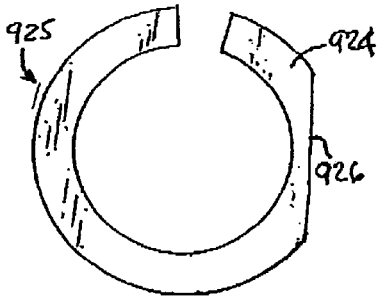
Fig. 117 (Prior Art)

FIG. 117 is a plan view of a link element 925 according to the prior art in which one arm 924 has a flat surface 926 formed on the exterior edge in the center of arm 924.

FIG. 118 is a plan view of a link element 927, similar to that shown in FIG. 117, but with the flat 929 and a region of the major surface 930 adjacent the flat 929 shown as being textured, in this example as serrations 931.

FIGS. 119–123 assist in illustrating a method for producing a hollow link element having a plurality of segments exhibiting different visual properties. In this example, two different visual properties are shown, although any number can be chosen at the discretion of the jewelry manufacturer.

FIG. 119 is a perspective view of a thin sheet of material 933 comprised of two elongated regions 934 and 935 extending lengthwise of the sheet, the two regions 934,935 exhibiting two different visual properties.

FIG. 120 is a perspective view of a strip segment 937 cut or sliced from the end of the sheet of material 933 shown in FIG. 119 at a location indicated by the dashed line 936. As with the sheet of material 933, strip segment 937 has two portions 938 and 939 exhibiting different visual properties, such as color, texture, material, or material karat weight.

FIG. 121 is a perspective view of the strip segment 937 shown in FIG. 120 after being rolled into a cylindrical shape about an axis parallel to the length of the strip segment 937, in a first bending operation. That is, the strip segment 937 is bent into cylindrical form to bring the long sides facing one another, and preferably in contact with one another, resulting in a long tubular member 337-1 having an longitudinal slit 940 where the two strip segment sides meet.

FIG. 122 is an end view looking from the bottom of the rolled segment 937-1 shown in FIG. 121, showing the hollow nature of the tubular member 937-1.

FIG. 123 is a perspective view of the first-bent strip segment 937-1 shown in FIG. 121 being rolled into a C-shaped link element 937-2, in a second bending operation. In the second bending operation, the tubular member 937-1 is bent in the plane of its axis to form the C-shaped link element 937-2, preferably in a manner to locate the slit 940 on its innermost boundary as seen in FIG. 123.

There are many advantages of manufacturing a link element by the forgoing method. One advantage is that the sheet of material 933 can be constructed and pre-processed to exhibit any practical number of different elongated regions, like regions 934 and 935, and each region may be made to exhibit any visual property as defined herein. The resulting link element 937-2 exhibits the same visual properties as the original source sheet of material 933. Unlike other processes of making hollow link elements, for a link element 937-1, made in accordance with the present invention, each visual property portion is visible around the entire circumference of the link element 937-2 along the extent thereof. For example, if the sheet 933 is textured by creating serrations in the region 934, as shown, one arm (at 938 in FIG. 123) of the resulting link element 937-2 will be serrated on its entire surface. Such serration markings would not be possible using a stamping process, and it would be labor prohibitive if such markings were to be applied by hand in a manual operation.

Moreover, employing a mandrel (not shown) of different cross sectional shapes, either consistent along the length of such mandrel or changing in shape along its length, tubular members similar to 937-1, and the ultimate link element similar to 937-2, can be produced having virtually any desired cross sectional geometrical configuration. Using a mandrel with changing shape along its length will result in a changing cross section of the formed link element along its extent.

FIG. 124 is a schematic representation, similar to that of FIGS. 106–109A, of a cross sectional view taken across the arm centers of four adjacent link elements 951–954 in an assembled rope chain in which two adjacent hollow link elements 953, 954 are followed by two adjacent solid link elements 951, 952 along the length of chain. When made with precious metals, such as gold, the completed rope chain will have a "feel" similar to one made with solid core gold link elements, and yet significant gold savings is realized due to the hollow link elements.

FIG. 125 is a plan view of a link element 961 having a non-standard (non-annular) heel portion 967, opposite the gap 962. The interior edge 963 is formed with a void 964 at the heel portion 967, and the exterior edge 965 is formed with an outwardly directed extended portion 966 at the heel portion 967 at a location opposite the void 964 to maintain a prescribed minimum link width at the heel portion 967. This embodiment is exemplary only, and a link element of any preferred and practical geometry may be configured to reduce precious metal from the hidden interior edge while making up for link width with a smaller amount of precious metal formed at the heel portion on the exterior edge. This will keep the rope chain made from such link elements from becoming too loose, as previously described. The same principle was described in connection with the link element shown in FIG. 92, where the exterior edge was shown to be slightly extended outwardly at 745, even though at that location, the exterior edge is undulated and generally inwardly directed at the heel location as indicated by numeral 745A.

It will be understood that, when link elements have specific edge designs or patterns, such as those shown in FIGS. 53–56, it may be preferable to not place them against one another. Otherwise, the designs or patterns will be covered up by adjacent link elements. A number of link elements having a link thickness thinner than standard (not shown) are perfectly suited for spacing out the aforementioned link elements having edge designs or patterns.

Additionally, it is known to diamond cut the edges of a completed rope chain and coat, with rhodium or other material, the flattened surfaces created by the diamond cutting process, thus maintaining the flat, smooth, highly light reflective characteristic of the uncut portion of the exterior edge. By constructing a rope chain using, in part or in whole, serrated, scored, or knurled, link elements, and subsequently rhodium coating diamond cut surfaces, a dramatic increase in contrast is seen due to the softer yellow gold color of the serrated, scored, or knurled portions and the mirror-like finish of the coated diamond cut portions of the chain. Diamond cutting techniques can be easily adapted to the methods of the present invention, especially for those embodiments in which a sheet of material is pre-textured prior to stamping out link elements therefrom.

As has been suggested by the various embodiments and variations of the invention presented herein, the flexibility of design, appearance, and feel of a rope chain manufactured using the link elements shown and described can stimulate a myriad of possibilities. These attributes of a completed rope chain can be unique with the present invention. Creating similar attributes using prior art techniques would not be considered by the person of ordinary skill in the art, since all attempts to similarly shape, color, texture, or pattern a rope chain after it is completed would not be practical. The uniqueness of a rope chain employing the link elements of the present invention is made possible by the provision of forming, shaping, or otherwise processing individual link elements prior to assembly. Exclusive finished rope chain attributes made possible with the present invention cannot be duplicated by applying post-assembled processing steps, whether a single type link element is used throughout the length of the rope chain, or multiple types of link elements are assembled in a particular or random order.

As suggested herein, any visual property, as (defined herein, may be combined with any one or more other visual properties in the manufacture of the various link elements making up the completed rope chain. Visual properties of any one portion of a link element, or the rope chain or a helical strand thereof, may include at least one of the group consisting of color, material, different gold karat weights, texture, shape, reflectivity, pattern, size, and design.

As previously mentioned, one object of the invention is to reduce the amount of material making up the individual link elements to reduce manufacturing costs, while not detracting from the beauty and effective size (diameter) of the finished rope chain. Reducing material can be accomplished in many ways: by removing material from or forming edge depressions in the entire or portions of the exterior edge; by removing material from or forming edge depressions in the entire or portions of the interior edge; by removing material from or forming surface depressions in one or both major link surfaces; by forming openings in or through the major link surfaces; or otherwise narrowing the width of the entire or portions of the link elements. In some embodiments of the invention, part or all of a link element may have a link width larger than standard but with openings provided therein to result in a net reduction of material making up the link element.

Link thickness, as used herein, is defined as a distance between and perpendicular to the plane of the first and second major surfaces, and at least some of the link elements in a rope chain may have an irregular link thickness along the extent of the link element. Link elements have been described herein that possess irregular link thicknesses along the extent of the link elements due to impressions or the formation of surface texturing. Such link elements that bear surface ornamentation on each link element will cause a rope chain to have a more decorative design than the conventional rope chain and yet use less precious metal than a standard link element without such irregular link thickness.

The embodiments of the invention shown in the figures provide a basis for appreciating the virtually limitless number of configurations and shape and design patterns that can be produced in a rope chain structure by employing and creatively arranging the differently colored, patterned, textured, and/or shaped link elements such as those depicted in the accompanying drawings. Further variations and combinations of color patterns, textures, shapes, and configurations are possible and presumed to be within the teaching of the present invention.

Obviously, color, shape, texture, and overall configurations other than those shown in the accompanying figures are possible for the manufacture of the link elements, and these are merely examples of preferred visual property combinations which can produce striking results in a finished rope chain construction. For example, an interesting variation of an undulated shaped edge would be a scalloped edge. Accordingly, it is to be understood that the shape and design patterns shown in the accompanying figures, the types of materials used, the coloring, surface texture, surface patterns, arrangement of groups and sets of link elements along the rope chain, reversed or not, randomly assembled or in strict accordance with a repeated pattern, and the like are all contemplated possibilities and are to be considered within the scope of the present invention.

While only certain embodiments have been set forth, alternative embodiments and various modifications will be apparent from the above description to those skilled in the art. For example, while the colors and precious metals used in the descriptions herein are preferred to be yellow, white, rose, and green gold, other colors and metals, or even non-metals, can be employed in the construction of the disclosed rope chain configurations. Notable alternate materials, for example, are rhodium (in various colors), silver, and nickel, either solid or plated. Colored coatings may also be applied, such as enamel or powder coating.

Several references to rhodium coating have been made in this description. It is to be understood that virtually any part of a finished rope chain, constructed from any of the link elements shown in the accompanying figures can be rhodium or gold plated, or coated with any other preferred material or substance. Alternatively, if a rope chain is made without the application of heat to weld, or otherwise attach, adjacent link elements together, rhodium (or other material or substance) coating can be applied to the individual link elements prior to assembly, saving much labor expense which would otherwise be required with post assembly coating processes.

Rhodium, gold, or other precious metal plating may be applied by a variety of commonly known plating equipment and processes. For methods and equipment to plate assembled rope chains, reference is made to Pro-Craft® Pen Platers, No. 45.400 and No. 45.403 available from Gorbet USA® Tools, Supplies and Equipment for Technicians and Craftsmen, through K Supply, Inc. Jewelry Supplies 608 S. Hill St. Suite 602, Los Angeles, Calif. 90014. These pen platers can use formulated pen plating solutions, also available from Gorbet USA®, such as Gorbet USA® No. 45.414 Pro-Crafts plating solution, for plating rhodium. Other pen plating solutions are available for plating metals other than rhodium plating solutions. For example Gorbet USA® Nos. 45.410 through 45.412 are Pro-Craft® gold plating solutions, and No. 45.415 is a Pro-Craft® black rhodium plating solution.

Another method for plating rhodium, gold, or other precious metal on only one helical rope strand, or to selected portions, of an assembled rope chain plating involves three major steps: protective coating all areas of an assembled rope chain that are not to be plated; immersing the partially protected chain in a plating bath (e.g., an electro-plating bath); and removing the protective coating. This results in a chain having some non-plated areas (that were protected) and some plated areas added by the plating process. This method is a widely known and therefore does not warrant listing sources for plating materials or plating equipment.

In lieu of rhodium or gold plating, the link elements, prior to assembly, and/or the exterior surface, or portions of the exterior surface, of one or both rope strands of an assembled length of rope chain can be colorized by a blackener process, by an oxidizer process, or by applying and curing a hard colored enamel. The above-mentioned Gorbet USA® source supplies Jax® Blackeners such as No. 45.906, Vigor® Oxidizers such as No. 45.0329, and Ceramit™ low temperature curing, hard enamels such as No. 45.800.

All of the above-mentioned plating, blackening, oxidizing, and enameling process result in either a visually attractive color coordinated length of rope chain, or a rope chain in which the different colors exhibited are in much greater contrast than conventional rope chains without any post assembly surface colorization.

It will also be understood that, for all of the link elements described herein in which segments of a link element have different link widths, either the relatively smaller or relatively larger, segment may be of standard size.

In the examples herein showing segmented link elements with one side having different physical characteristics than the other side, the drawings and accompanying text referred to the transition being opposite the placement of the gap. It is within the scope of the present invention to provide segmented regions having different physical characteristics or properties as described herein placed in other positions along the extent of the link elements. One example is providing a dividing line horizontally positioned in any of the accompanying figures.

Instead of, or in addition to, differently textured and/or colored major surfaces, the two major surfaces of a link element may exhibit differently textured or colored portions, e.g., one portion of a link element may be shiny and yellow gold in color, while another portion may have a sandblasted, frosted, patterned, matte, or simulated diamond cut finish appearance and white gold in color. Also, either major surface may be of a uniform shape and/or texture, while the other major surface is portioned as described.

A further variation has a portion of the link at a reduced annular width, which reduces material but nonetheless gives the appearance of a rope chain having an effective diameter the same as if the reduced portion was of normal annular width.

The interconnecting link elements may have differently colored, patterned, and/or textured portions, and may have different irregular or patterned shapes or shaped portions. For example, some or all of the link elements making up the rope chain may be partially or wholly smoothly circular with patterned major surfaces, circular with peripheral undulations, circular with peripheral gear-like teeth, circular with gouges or notches, may have constantly varying cross sectional portions, and/or may have an overall configuration that is star shaped, baguette shaped, square shaped, rectangular shaped, oval shaped, diamond shaped, D-shaped, heart shaped, etc. Similarly, different portions of each link element may have such different physical shapes.

A jewelry rope chain link element constructed in accordance with the invention preferably, but not necessarily, may have the shape and configuration of a standard annular link element with at least a portion removed and has a maximum link width equal to that of a similar standard annular link element without any portion removed.

Similarly, a length of rope chain employing link elements as described in the previous paragraph, has an effective maximum diameter equal to that of a similar length of rope chain constructed of solid, standard size annular link elements without any portion removed.

From the viewpoint of a finished length of rope chain, the invention provides a further improvement over the prior art, wherein: each link element in the length of rope chain may comprise a link portion exhibiting a first visual property, and another link portion exhibiting a second, different, visual property; whereby, when viewed from one side of the length of rope chain, the appearance of one of the helical rope strands is different than the appearance of the other, adjacent, helical rope strand along the length of rope chain.

For example, in one variation, the one helical rope strand is of a predetermined effective diameter, and the adjacent helical rope strand is of a different effective diameter than that of the one rope strand.

When stamped from a sheet of material comprised of a number of edge-joined flat strips or regions, one helical rope strand may be a helical cylindrical tube displaying a particular color pattern and intertwined with the adjacent helical rope strand which may display the same or a different color pattern. For example, one helical rope strand may be of a solid color, while the adjacent helical rope strand may have an outer surface portion thereof of one color and an inner surface portion, adjacent a channel of the rope chain, of another color.

In the description herein wherein at least some of the link elements of a rope chain are formed with varying cross sections along the extent of such link elements, it is to be understood that such variation in cross section includes: variation in link width, e.g. as in FIGS. 41, 43, and 44; variation in link thickness, e.g. as in FIGS. 11, and 16; variation in both widths and thicknesses, e.g. as in FIGS. 17, 27, 29, and 31; and continuous or stepped variations from one geometric cross sectional shape to another geometric cross sectional shape along the extent of the link element, e.g. as in FIGS. 78–81.

These and other alternatives are considered equivalents and within the spirit and scope of the present invention.

What is claimed is:

1. A method for manufacturing a length of six-link rope chain, comprising:

forming generally C-shaped link elements from a material to define a gap between facing ends thereof, each link element having an axis, a first major surface perpendicular to said axis, an opposite second major surface perpendicular to said axis, an interior edge, and an exterior edge having a curved surface portion defined by a straight linear component that is parallel to, or inclined to, said axis at all points along said curved surface portion, said curved surface portion being smooth and highly light reflective; and assembling a plurality of said link elements to produce a length of six-link rope chain, wherein:

said material is a sheet of material having a plurality of regions, adjacent ones of which exhibit different visual properties; whereby link elements formed from said sheet of material comprises a plurality of regions, adjacent ones of which exhibit different visual properties.

2. The method as claimed in claim 1, wherein:

transitions between said major surfaces and said exterior edge define corners; and in forming said link elements, at least one corner is rounded.

3. The method as claimed in claim 1, wherein said different visual properties are selected from the group consisting of different colors, different surface textures, different reflectivities, different materials, different gold karat weights, different shapes, different patterns, different sizes, and different designs.

4. The method as claimed in claim 3, wherein:

said different visual properties are different surface textures; and forming said link element includes forming at least one of said regions of different surface textures employing at least one process selected from the group consisting of serrating, scoring, knurling, lining, patterning, pressure stamping, impressing, sandblasting, etching, shaping, polishing, matting, frosting, and diamond cutting.

5. The method as claimed in claim 3, wherein:

said regions of different visual properties include regions of different surface textures superimposed on said regions of different colors; and forming said link element includes forming at least one of said regions of different surface textures employing at least one process selected from the group consisting of serrating, scoring, knurling, lining, patterning, pressure stamping, impressing, sandblasting, etching, shaping, polishing, matting, frosting, and diamond cutting.

6. The method as claimed in claim 3, wherein:

said regions of different visual properties include regions of different surface textures superimposed on said regions of different reflectivities; and forming said link element includes forming at least one of said regions of different surface textures employing at least one process selected from the group consisting of serrating, scoring, knurling, lining, patterning, pressure stamping, impressing, sandblasting, etching, shaping, polishing, matting, frosting, and diamond cutting.

7. The method as claimed in claim 3, wherein:

said regions of different visual properties include regions of different surface textures superimposed on said regions of different materials; and forming said link element includes forming at least one of said regions of different surface textures employing at least one process selected from the group consisting of serrating, scoring, knurling, lining, patterning, pressure stamping, impressing, sandblasting, etching, shaping, polishing, matting, frosting, and diamond cutting.

8. The method as claimed in claim 1, wherein:

said at least one link element is formed with a varying cross section along the extent of such link element.

9. The method as claimed in claim 8, wherein:

a cross section of said link element at a first location along the extent of said link element is of a first configuration;

a cross section of said link element at a second location along the extent of said link element is of a second configuration; and the cross section of said link continuously changes along its extent from said first location to said second location.

10. The method as claimed in claim 8, wherein;

a cross section of said link element at a first location along the extent of said link element is of a first configuration;

a cross section of said link element at a second location along the extent of said link element is of a second configuration; and the cross section of said link changes in discrete stages along its extent from said first location to said second location.

11. The method as claimed in claim 1, comprising:

treating said exterior edge to have enhanced reflectivity.

12. The method as claimed in claim 1, wherein:

forming a link element from said material includes stamping said sheet of material with a stamping device.

13. The method as claimed in claim 1, wherein:

said material is a sheet of material;

said at least one link element is stamped from said sheet of material in a stamping procedure; and at least a portion of said link element has a textured surface formed during said stamping procedure.

14. A length of six-link jewelry rope chain manufactured by the method as claimed in claim 1.

15. The method as claimed in claim 1, wherein said material comprises precious metal.

16. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein said at least one link element comprises a plurality of regions, adjacent ones of which exhibit different visual properties, wherein at least one region of said regions of different visual properties is textured by employing at least one process selected from the group consisting of serrating, scoring, knurling, lining, patterning, pressure stamping, impressing, sandblasting, etching, shaping, polishing, matting, frosting, and diamond cutting.

17. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to or inclined to, said axis at all points along said curved surface portion, said curved surface portion being smooth and highly light reflective, wherein said at least one link element comprises a plurality of regions, adjacent ones of which exhibit different visual properties, and wherein:

said regions of different visual properties include regions of different surface textures superimposed on said regions of different colors; and at least one of said regions of different surface textures is formed therein by employing at least one process selected from the group consisting of serrating, scoring, knurling, lining, patterning, pressure stamping, impressing, sandblasting, etching, shaping, polishing, matting, frosting, and diamond cutting.

18. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein said at least one link element comprises a plurality of regions, adjacent ones of which exhibit different visual properties, and wherein:

said regions of different visual properties include regions of different surface textures superimposed on said regions of different reflectivities; and at least one of said regions of different surface textures is formed therein by employing at least one process selected from the group consisting of serrating, scoring, knurling, lining, patterning, pressure stamping, impressing, sandblasting, etching, shaping, polishing, matting, frosting, and diamond cutting.

19. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to or inclined to, said axis at all points along said curved surface portion, said curved surface portion being smooth and highly light reflective, wherein said at least one link element comprises a plurality of regions, adjacent ones of which exhibit different visual properties, and wherein:

said regions of different visual properties include regions of different surface textures superimposed on said regions of different materials; and at least one of said regions of different surface textures is formed therein by employing at least one process selected from the group consisting of serrating, scoring, knurling, lining, patterning, pressure stamping, impressing, sandblasting, etching, shaping, polishing, matting, frosting, and diamond cutting.

20. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to or inclined to, said axis at all points along said curved surface portion, said curved surface portion being smooth and highly light reflective, wherein:

said at least one link element is stamped from a sheet of material in a stamping procedure; and at least a portion of said link element has a textured surface formed during said stamping procedure.

21. A method for manufacturing a length of rope chain comprised of a plurality of link elements assembled to form a length of six-link rope chain, said method comprising:

providing an elongated strip of material having a prescribed length, width, and thickness;

forming said strip into a generally C-shaped rope chain link element to define a gap between facing ends thereof, said formed link element having an axis, a first major surface perpendicular to said axis, an opposite second major surface perpendicular to said axis, an interior edge, and an exterior edge having a curved surface portion defined by a straight linear component that is parallel to, or inclined to, said axis at all points along said curved surface portion, said curved surface portion being smooth and highly light reflective;

assembling a plurality of said link elements to form a length of six-link rope chain;

providing a sheet of material having a plurality of regions, adjacent ones of which exhibit different visual properties; and slicing said elongated strip from said sheet of material, whereby the formed link element so produced comprises portions of said sheet of material that exhibit at least two different ones of said visual properties.

22. The method as claimed in claim 21, comprising:

producing a pattern of textured segments on at least one surface of said elongated strip prior to forming said strip into a generally C-shaped link element.

23. The method as claimed in claim 21, wherein:

providing a sheet of material having a plurality of regions includes providing said sheet of material having a flat, smooth, highly reflective surface which defines said smooth and highly reflective exterior surface portion of said link element.

24. The method as claimed in claim 21, wherein said different visual properties are selected from the group consisting of different colors, different surface textures, different reflectivities, different materials, different gold karat weights, different shapes, different patterns, different sizes, and different designs.

25. The method as claimed in claim 24, wherein providing said strip of material includes texturing at least one of said regions by employing at least one process selected from the group consisting of serrating, scoring, knurling, lining, patterning, pressure stamping, impressing, sandblasting, etching, shaping, polishing, matting, frosting, and diamond cutting.

26. The method as claimed in claim 21, comprising: treating said exterior edge portion to have enhanced reflectivity.

27. The method as claimed in claim 21, comprising:

forming a textured surface on at least a portion of said link element in a stamping operation.

28. A length of jewelry rope chain manufactured by the method as claimed in claim 21.

29. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands; and said first and second helical strands exhibit at least two distinctly different visual properties selected from the group consisting of different colors, different textures, and different materials, along the length of said rope chain;

link thickness is defined as a distance between and perpendicular to planes containing said first and second major surfaces;

a portion of said at least one link element has a first link thickness;

another portion of said at least link element has a second link thickness less than said first link thickness; and a major surface of said link element portion having said second link thickness is textured.

30. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands; and said first and second helical strands exhibit at least two distinctly different visual properties selected from the group consisting of different colors, different textures, and different materials, along the length of said rope chain;

link thickness is defined as a distance between and perpendicular to planes containing said first and second major surfaces;

a portion of said at least one link element has a first link thickness;

another portion of said at least link element has a second link thickness less than said first link thickness; and at least one other portion of said link element has a link thickness less than that of said first or second link thickness.

31. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

first and second helical channels are defined at the transition between said intertwined first and second helical rope strands;

each channel has two sides which include respective portions of adjacent ones of said first and second rope strands; and one side of one channel exhibits a visual property different than the other side of said one channel.

32. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

first and second helical channels are defined at the transition between said intertwined first and second helical rope strands;

each channel has two sides which include respective portions of adjacent ones of said first and second rope strands; and one side of one channel exhibits a visual property different than the rest of the length of rope chain.

33. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

first and second helical channels are defined at the transition between said intertwined first and second helical rope strands;

each channel has two sides which include respective portions of adjacent ones of said first and second rope strands; and both sides of one channel exhibit visual properties different than the rest of the length of rope chain.

34. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

first and second helical channels are defined at the transition between said intertwined first and second helical rope strands;

each channel has two sides which include respective portions of adjacent ones of said first and second rope strands; and one side of both channels exhibits visual properties different than the rest of the length of rope chain.

35. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

first and second helical channels are defined at the transition between said intertwined first and second helical rope strands;

each channel has two sides which include respective portions of adjacent ones of said first and second rope strands; and both sides of both channels exhibit visual properties different than the rest of the length of rope chain.

36. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

the most outwardly portions of said first and second helical rope strands are defined, respectively, as first and second helical outer periphery regions; and said first periphery region exhibits a visual property different than that of the rest of the length of rope chain.

37. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

said gapped link elements are generally square in shape, having two spaced apart straight sides joined by two spaced apart straight ends, a gap located at one of said ends;

link width is defined as the distance between said interior and said exterior edges at any point along the extent of said link element; and one of said straight sides has a link width greater than that of the other of said straight sides.

38. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

said gapped link elements are generally heart-shaped, having two spaced apart curved sides and two spaced apart ends, said ends having,respectively, an outwardly directed apex and an inwardly directed inverted apex, a gap located at said end with the outwardly directed apex; and one of said sides is textured.

39. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

said first major surface exhibits a visual property different than that of said second major surface.

40. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain; element comprises:

a first link layer having the shape and configuration of said link elements, but with half the link thickness defined as the distance between said first major surface and said second major surface of said link element; and a second link layer having the same shape, configuration, and thickness as said first link layer; wherein said two link layers are joined together by bonding one major surface of said first link layer with a major surface of said second link layer to form said link element; and the exposed major surface of said first link layer exhibits a different visual property than the exposed major surface of said second link layer.

41. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

said gap of each of said C-shaped gapped link elements defines a space between facing ends thereof;

a heel portion of said link element is defined as that portion directly opposite said gap;

a link arm is defined as a part of the link element between either one of said facing ends and said heel portion;

the exterior edge of one of said arms has scalloped segments; and the exterior edge of the other of said arms is smooth and absent scalloped segments.

42. The length of jewelry rope chain as claimed in claim 41, wherein:

at least one scalloped segment has a textured surface.

43. The length of jewelry rope chain as claimed in claim 42, wherein said textured surface is a major surface of said link element.

44. The length of jewelry rope chain as claimed in claim 42, wherein said textured surface is the exterior edge of said scalloped segment.

45. The length of jewelry rope chain as claimed in claim 42, wherein one scalloped segment is textured differently than other scalloped segments.

46. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

said gap of each of said C-shaped gapped link elements defines a space between facing ends thereof;

a heel portion of said link element is defined as that portion directly opposite said gap;

a link arm is defined as a part of the link element between either one of said facing ends and said heel portion;

link width is defined as the distance between said interior and said exterior edges at any point along the extent of said link element; and the link width of one of said arms progressively increases from said gap toward the center of said one arm, progressively increases from said heel toward said arm center, and decreases in the vicinity of said arm center.

47. The length of jewelry rope chain as claimed in claim 46, wherein the other of said arms is textured on at least one of said first major surface, second major surface, and exterior edge.

48. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

said gap of each of said C-shaped gapped link elements defines a space between facing ends thereof;

a heel portion of said link element is defined as that portion directly opposite said gap;

a link arm is defined as a part of the link element between either one of said facing ends and said heel portion;

link width is defined as the distance between said interior and said exterior edges at any point along the extent of said link element; and the exterior edge of said link element is shaped to reduce link width on a portion of said link element at the location of said heel.

49. The length of jewelry rope chain as claimed in claim 48, wherein said exterior edge is further shaped to reduce link width on a portion of said link element at the location of said gap.

50. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

said gap of each of said C-shaped gapped link elements defines a space between facing ends thereof;

a heel portion of said link element is defined as that portion directly opposite said gap;

a link arm is defined as a part of the link element between either one of said facing ends and said heel portion;

link width is defined as the distance between said interior and said exterior edges at any point along the extent of said link element; and the exterior edge of said link element is shaped to reduce link width on a portion of said link element at a first location between said gap and the center of said one arm, and at a second location between said heel and said arm center.

51. The length of jewelry rope chain as claimed in claim 50, wherein link width is decreased at the arm center of the other arm.

52. The length of jewelry rope chain as claimed in claim 50, wherein said link element is textured on at least one of said first major surface, second major surface, and exterior edge.

53. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

said gap of each of said C-shaped gapped link elements defines a space between facing ends thereof;

a heel portion of said link element is defined as that portion directly opposite said gap;

a link arm is defined as a part of the link element between either one of said facing ends and said heel portion;

link width is defined as the distance between said interior and said exterior edges at any point along the extent of said link element; and the exterior edge of said link element is shaped to reduce link width on a portion of said link element at a location on one of said arms between said gap and the center of said one arm.

54. The length of jewelry rope chain as claimed in claim 53, wherein said one arm is textured at a location between said heel and said one arm center.

55. The length of jewelry rope chain as claimed in claim 53, wherein the other one of said arms is shaped to reduce link width on a portion of said link element at a location on the other one of said arms between said heel and the center of said other arm.

56. The length of jewelry rope chain as claimed in claim 55, wherein:

said link element is textured on a major surface at one of said arm locations; and said link element is textured on the exterior surface of the other of said arm locations.

57. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

said gap of each of said C-shaped gapped link elements defines a space between facing ends thereof;

a heel portion of said link element is defined as that portion directly opposite said gap;

a link arm is defined as a part of the link element between either one of said facing ends and said heel portion;

at least one of said arms has a single flat surface formed on its exterior edge parallel to a line passing through said gap and said heel; and at least one of said flat surface and a major surface in the vicinity of said flat surface is textured.

58. The length of jewelry rope chain as claimed in claim 57, wherein:

a single flat surface is formed on both said arms; and at least one of said flat surfaces is textured.

59. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

said gap of each of said C-shaped gapped link elements defines a space between facing ends thereof;

a heel portion of said link element is defined as that portion directly opposite said gap;

a link arm is defined as a part of the link element between either one of said facing ends and said heel portion;

each of said arms has a single flat surface formed on its exterior edge parallel to a line passing through said gap and said heel; and at least one major surface of at least one of said arms is textured.

60. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

said gap of each of said C-shaped gapped link elements defines a space between facing ends thereof;

a heel portion of said link element is defined as that portion directly opposite said gap;

a link arm is defined as a part of the link element between either one of said facing ends and said heel portion;

said link element is D-shaped, one of said arms having a substantially straight portion, and the other of said arms having a substantially semi-circular portion; and one of said straight portion and said semi-circular portion is textured.

61. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

said gap of each of said C-shaped gapped link elements defines a space between facing ends thereof;

a heel portion of said link element is defined as that portion directly opposite said gap;

a link arm is defined as a part of the link element between either one of said facing ends and said heel portion;

said link element is annular with a substantially circular cross section;

a plurality of flat surfaces are formed on said exterior edge of one of said arms; and at least one major surface of said one arm is textured.

62. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

said gap of each of said C-shaped gapped link elements defines a space between facing ends thereof;

a heel portion of said link element is defined as that portion directly opposite said gap;

a link arm is defined as a part of the link element between either one of said facing ends and said heel portion;

said link element is annular;

the exterior edge of at least one arm is textured; and a plurality of flat surfaces are formed on said exterior edge of one of said arms superimposed over said textured exterior edge.

63. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

said gap of each of said C-shaped gapped link elements defines a space between facing ends thereof;

a heel portion of said link element is defined as that portion directly opposite said gap;

a link arm is defined as a part of the link element between either one of said facing ends and said heel portion;

said link element is annular with a substantially circular cross section;

a plurality of flat surfaces are formed on said exterior edge of one of said arms; and said plurality of flat surfaces are arranged in serial fashion along the extent of the exterior edge of said one arm with little or no space between said flat surfaces.

64. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

at least one of said first and second helical strands exhibits multiple visual properties;

first and second helical channels are defined between said intertwined first and second helical rope strands;

each channel has two sides which include respective portions of adjacent ones of said first and second rope strands; and one side of one channel exhibits a visual property the same as that of the other side of said one channel.

65. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

at least one of said first and second helical strands exhibits multiple visual properties;

first and second helical channels are defined between said intertwined first and second helical rope strands;

each channel has two sides which include respective portions of adjacent ones of said first and second rope strands; and one side of one channel exhibits a visual property different than the rest of the length of rope chain.

66. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

at least one of said first and second helical strands exhibits multiple visual properties;

first and second helical channels are defined between said intertwined first and second helical rope strands;

each channel has two sides which include respective portions of adjacent ones of said first and second rope strands; and both sides of one channel exhibit visual properties different than the rest of the length of rope chain.

67. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

at least one of said first and second helical strands exhibits multiple visual properties;

first and second helical channels are defined between said intertwined first and second helical rope strands;

each channel has two sides which include respective portions of adjacent ones of said first and second rope strands; and one side of both channels exhibits visual properties different than the rest of the length of rope chain.

68. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

at least one of said first and second helical strands exhibits multiple visual properties;

first and second helical channels are defined between said intertwined first and second helical rope strands;

each channel has two sides which include respective portions of adjacent ones of said first and second rope strands; and both sides of both channels exhibit a visual property different than the rest of the length of rope chain.

69. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

at least one of said first and second helical strands exhibits multiple visual properties;

first and second helical outer periphery regions are defined on the most outwardly portion of said first and second helical rope strands, respectively; and said first periphery region exhibits a visual property different than that of said second periphery region.

70. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

at least one of said first and second helical strands exhibits multiple visual properties;

first and second helical outer periphery regions are defined on the most outwardly portion of said first and second helical rope strands, respectively; and said first periphery region exhibits the same visual property as said second periphery region.

71. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

said rope chain has the appearance of intertwining first and second helical rope strands;

said first and second helical strands exhibit at least two distinctly different visual properties selected from the group consisting of different colors, different textures, and different materials, along the length of said rope chain;

at least one of said first and second helical strands exhibits multiple visual properties;

first and second helical outer periphery regions are defined on the most outwardly portion of said first and second helical rope strands, respectively;

first and second helical channels are defined between said intertwined first and second helical rope strands;

each channel has two sides which include respective portions of adjacent ones of said first and second rope strands; and said helical outer periphery regions and said channel sides exhibit combinations of visual properties selected from the group consisting of different colors, different surface textures, different reflectivities, different materials, different gold karat weights, different shapes, different patterns, different sizes, and different designs.

72. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

a heel portion of said at least one link element is defined as a portion directly opposite said gap;

link width is defined as the distance between said interior and said exterior edges at any point along the extent of said link element;

said exterior edge is formed with shape variations to enhance the outward appearance of said length of rope chain;

said interior edge is formed with shape variations to reduce the amount of precious metal material used in the manufacture of said at least one link element; and said interior and exterior shape variations are complementary at said heel portion to maintain a prescribed link width at said heel portion.

73. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

a heel portion of said at least one link element is defined as a portion directly opposite said gap;

link width is defined as the distance between said interior and said exterior edges at any point along the extent of said link element;

said exterior edge is formed with shape variations to enhance the outward appearance of said length of rope chain;

said interior edge is formed with shape variations to reduce the amount of precious metal material used in the manufacture of said at least one link element; and said interior and exterior shape variations are complementary at said gap portion to maintain a prescribed link width of said facing ends at the location of said gap.

74. A length of jewelry rope chain constructed of a plurality of link elements assembled to form a length of six-link rope chain, wherein each of said link elements has an axis and is generally C-shaped in configuration to define a gap between facing ends thereof, at least one of said link elements comprises:

a first major surface perpendicular to said axis;

an opposite second major surface perpendicular to said axis;

an interior edge; and an exterior edge having a curved surface portion defined by a straight linear component that is parallel to, or inclined to, said axis at all points along said curved surface portion, said curved surface portion being smooth and highly light reflective, wherein:

a heel portion of said at least one link element is defined as a portion directly opposite said gap;

link width is defined as the distance between said interior and said exterior edges at any point along the extent of said link element;

said exterior edge is formed with shape variations to enhance the outward appearance of said length of rope chain;

said interior edge is formed with shape variations to reduce the amount of precious metal material used in the manufacture of said at least one link element;

said interior edge is formed with a void at said heel portion; and said exterior edge is formed with an outwardly directed extended portion at said heel portion at a location opposite said void to maintain a prescribed minimum link width at said heel portion.

* * * * *